US006479230B1

(12) United States Patent
Morimoto

(10) Patent No.: US 6,479,230 B1
(45) Date of Patent: Nov. 12, 2002

(54) LIGHT SENSITIVE SILVER HALIDE PHOTOGRAPHIC EMULSION AND SILVER HALIDE PHOTOGRAPHIC LIGHT-SENSITIVE MATERIAL CONTAINING THE EMULSION

(75) Inventor: Kiyoshi Morimoto, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/513,579

(22) Filed: Feb. 25, 2000

(30) Foreign Application Priority Data

Feb. 26, 1999 (JP) ..... 11-049670

(51) Int. Cl.[7] ..... G03C 1/005; G03C 1/28
(52) U.S. Cl. ..... 430/567; 430/569; 430/597
(58) Field of Search ..... 430/567, 569, 430/597

(56) References Cited

U.S. PATENT DOCUMENTS

| | | | | | |
|---|---|---|---|---|---|
| 4,983,508 | A | * | 1/1991 | Ishiguro et al. | 430/569 |
| 5,382,496 | A | | 1/1995 | Sakai et al. | |
| 5,654,133 | A | * | 8/1997 | Oikawa | 430/567 |
| 5,756,277 | A | * | 5/1998 | Sano | 430/569 |
| 5,882,841 | A | * | 3/1999 | Ezoe et al. | 430/264 |
| 5,928,852 | A | * | 7/1999 | Ohzeki | 430/567 |
| 5,981,138 | A | * | 11/1999 | Suzuki et al. | 430/264 |
| 5,998,124 | A | * | 12/1999 | Ouzeki et | 430/569 |
| 6,007,977 | A | * | 12/1999 | Nishikawa | 430/567 |
| 6,074,799 | A | * | 6/2000 | Ezoe et al. | 430/264 |

FOREIGN PATENT DOCUMENTS

| | | | |
|---|---|---|---|
| JP | 61-43740 | * | 7/1984 |
| JP | A6143740 | | 3/1986 |

* cited by examiner

*Primary Examiner*—Janet Baxter
*Assistant Examiner*—Amanda C. Walke
(74) *Attorney, Agent, or Firm*—Birch, Stewart, Kolasch & Birch, LLP

(57) ABSTRACT

A silver halide photographic light-sensitive emulsion containing, at a ratio of 50% or more of the total projected area of silver halide grains, tabular silver halide grains each having faces as parallel major faces and an aspect ratio of 2 or more and including 10 or more dislocation lines per grain, and containing at least one compound represented by formula (1) or (2) below:

Formula (1)

Formula (2)

wherein A represents an atomic group required to form a nitrogen-containing hetero ring, each of B and E independently represents a divalent group containing at least one divalent group selected from the group consisting of alkylene, arylene, —O—, —S—, —$SO_2$—, —$CO_2$—, and —N(R5)-, wherein R5 represents a hydrogen atom, an alkyl group, or an aryl group, provided that each of —O—, —S—, —$SO_2$—, —$CO_2$—, and —N(R5)- is adjacent to and connects with alkylene or arylene, and that B does not bond to the nitrogen atom which forms a hetero ring and which bonds to the carbon atom by a double bond, each of R1 and R2 independently represents an alkyl group or an aralkyl group, each of R3 and R4 represents a substituent, and X represents an anion group, provided that no X exists in the case of intramolecular salt.

18 Claims, No Drawings

LIGHT SENSITIVE SILVER HALIDE PHOTOGRAPHIC EMULSION AND SILVER HALIDE PHOTOGRAPHIC LIGHT-SENSITIVE MATERIAL CONTAINING THE EMULSION

BACKGROUND OF THE INVENTION

The present invention relates to a light-sensitive silver halide photographic emulsion and, more particularly, to a tabular silver halide grain photographic emulsion having an aspect ratio of 2 or more. The present invention also relates to a silver halide photographic light-sensitive material using the emulsion.

Methods of manufacturing and techniques of using tabular grains are disclosed in U.S. Pat. Nos. 4,434,226, 4,439,520, 4,414,310, 4,433,048, 4,414,306, and 4,459,353. Known advantages of tabular grains are improvements of sensitivity including improvements of color sensitization efficiency by sensitizing dyes, and improvements of the sensitivity/graininess relationship.

Dislocations of silver halide grains are described in references such as C. R. Berry, J. Appl. Phys., 27, 636 (1956), C. R. Berry, D. C. Skillman, J. Appl. Phys., 35, 2165 (1964), J. F. Hamilton, Phot. Sci. Eng., 11, 57 (1967), T. Shiozawa, J. Soc. Phot. Sci. Japan, 34, 16, (1971), and T. Shiozawa, J. Soc. Phot. Sci. Japan, 35, 213, (1972). These references describe that dislocations in crystals can be observed by an X-ray diffraction method or low-temperature transmission electron microscopy and diverse dislocations are produced in crystals by intentionally giving distortion to the crystals.

Attempts to improve various photographic properties by intentionally introducing under control these dislocations to tabular silver halide grains are known. Jpn. Pat. Appln. KOKAI Publication No. (hereinafter referred to as JP-A-) 63-220238 has disclosed a method of introducing dislocation lines onto the peripheral region of a tabular grain. JP-A-1-102547 has disclosed a method of introducing dislocation lines onto the major faces of a tabular grain. JP-A-3-237450 has disclosed tabular grains having dislocation lines, which are chemically sensitized with a selenium sensitizer, a gold sensitizer, and a sulfur sensitizer and have an aspect ratio of 3 or more. JP-A-6-27564 has disclosed tabular grains having dislocation lines only in fringes.

On the other hand, JP-A-61-43740 has disclosed an emulsion spectrally sensitized to have high red sensitivity by the combination of bispyridinium salt and a cyanine dye. JP-A-61-43740 describes that an advantageous addition amount of this bispyridinium salt is, as a weight ratio, 0.25 to 100 times the addition amount of a cyanine dye. In practice, bispyridinium salt is added in amount equimolar with a cyanine dye or more. When large amounts of sensitizing dyes are allowed to effectively function, the color sensitization efficiency by these sensitizing dyes improve. However, examinations by the present inventors have found that in a system to which large amounts of sensitizing dyes are added, the sensitivity increasing effect is little even if bispyridinium salt having adsorptivity to an emulsion is added in amount equimolar with a cyanine dye or more. Accordingly, the development of a technique which achieves a remarkable sensitivity increasing effect with small addition amounts is being desired.

JP-A-6-242534 has disclosed a silver halide sensitized material containing a bis heterocyclic onium salt compound. JP-A-6-242534 describes that the photographic properties of an emulsion containing 60% or more of silver chloride are improved in a high-contrast negative sensitized material for photographic process which also contains a hydrazine derivative. JP-A-10-83040 describes that the sensitivity and storage stability of a direct positive photographic light-sensitive material using both an onium salt compound and previously fogged emulsions are improved.

As described above, the combination of onium salt such as bispyridinium salts and photographic emulsions is known. However, the effect of using this combination together with tabular grains to which dislocation lines are introduced is unknown.

The present inventors made extensive studies and have found a means capable of significantly improving photographic sensitivity by using specific onium salt in particularly tabular grains to which dislocation lines are introduced.

BRIEF SUMMARY OF THE INVENTION

It is an object of the present invention to provide a high-sensitivity silver halide emulsion having a high sensitivity/fog ratio.

It is another object of the present invention to provide a silver halide photographic light-sensitive material containing such an emulsion.

DETAILED DESCRIPTION OF THE INVENTION

The object of the present invention can be achieved by the following silver halide emulsions and the silver halide photographic light-sensitive materials.

(I) A silver halide photographic light-sensitive emulsion containing, at a ratio of 50% or more of the total projected area of silver halide grains, tabular silver halide grains each having (111) faces as parallel major faces and an aspect ratio of 2 or more and including 10 or more dislocation lines per grain, and containing at least one compound represented by formula (1) or (2) below:

Formula (1)

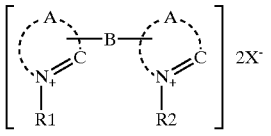

Formula (2)

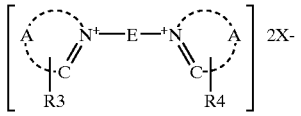

wherein A represents an atomic group required to form a nitrogen-containing hetero ring, and each of B and E represents one or a combination of alkylene, arylene, —O—, —S—, —$SO_2$—, —$CO_2$— and —N(R5)—. R5 represents a hydrogen atom, an alkyl group, or an aryl group. Each of —O—, —S—, —$SO_2$—, —$CO_2$— and —N(R5)— is adjacent to and connects with alkylene or arylene provided that each of —O—, —S—, —$SO_2$—, —$CO_2$—, and —N(R5)— is adjacent to and connects with alkylene or arylene at both ends thereof. B does not bond to the nitrogen atom which forms a hereto ring together with A and which bonds to the carbon atom by a double bond. Each of R1 and R2 represents an alkyl group or an aralkyl group, a n d each of R3 and R4 represents a substituent. Although X represents an anion group, no X exists in the case of intramolecular salt.

(II) The emulsion described in item (I) above, wherein the silver halide grains are made red-sensitive by a sensitizing dye, and the addition amount of a compound represented by formula (1) or (2) is 25 mol % of the addition amount of the sensitizing dye or less.

(III) The emulsion described in item (I) or (II) above, wherein the surface silver iodide content of the silver halide grains is 5 mol % or less.

(IV) The emulsion described in one of items (I) to (III) above, wherein the silver halide grains are subjected to reduction sensitization.

(V) The emulsion described in one of items (I) to (IV) above, wherein the compound represented by formula (2) is represented by formula (3) below:

Formula (3)

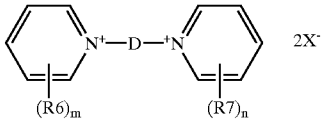

wherein D represents one or an alternate combination of alkylene and —O—. Each of m and n represents 0, 1, or 2. Each of R6 and R7 represents a 4- to 20-carbon alkyl group, a 6- to 20-carbon aryl group, or a 7- to 20-carbon aralkyl group. If m=2 and n=2, R6 or R7 can form a condensed ring as a benzene ring. Although X represents an anion group, no X is necessary in the case of intramolecular salt.

(VI) A silver halide photographic light-sensitive material having at least one silver halide light-sensitive emulsion layer on a support, wherein the silver halide light-sensitive emulsion layer contains the light-sensitive emulsion described in one of items (I) to (V) above.

The present invention will be described in detail below.

Details of formulas (1), (2), and (3) will be described below. In these formulas, A represents an atomic group required to form a nitrogen-containing hetero ring and can contain a carbon atom, a hydrogen atom, an oxygen atom, a nitrogen atom, or a sulfur atom. Additionally, a benzene ring can further condensed to the ring formed with A. Preferable examples are a pyridine ring, a quinoline ring, and an isoquinoline ring. A can also be substituted. Preferable examples of this substituent are a halogen atom, a substituted or nonsubstituted alkyl group (e.g., methyl and hydroxyethyl), a substituted or nonsubstituted aryl group (e.g., phenyl and p-chlorophenyl), a substituted or nonsubstituted aralkyl group (e.g., benzyl), an acyl group, a hydroxy group, a nitro group, an acylamino group, an alkoxy group, and a carbamoyl group.

Each of B and E represents one or a combination of alkylene, arylene, —O—, —S—, —$SO_2$—, —$CO_2$—, and —N(R5)—.

There is no limitation of the number of these groups mentioned above in the combination, and two same groups can be combined together to form each of B and E, provided that at least both ends of the combination are terminated with alkylene or arylene. Alkylene can be substituted by a substituent such as a hydroxy group. R5 represents a hydrogen atom, an alkyl group, or an aryl group. Each of —O—, —S—, —$SO_2$—, —$CO_2$—, and —N(R5)— is adjacent to and connects with alkylene or arylene at both ends thereof. The group, —O—, —S—, —$SO_2$—, —$CO_2$—, or —N(R5)—, can not represent each of B and E alone. B does not bond to a nitrogen atom which forms a hetero ring together with A and which bonds to a carbon atom by a double bond. Preferably, each of B and E represents one or a combination of alkylene, arylene, —O—, and —S—, for example, alkylene-O-alkylene-O-alkylene.

Each of R1 and R2 represents an alkyl group or an aralkyl group. Preferably, each of R1 and R2 represents a 4- to 20-carbon alkyl group (e.g., a butyl group, a hexyl group, or a dodecyl group) or a 7- to 20-carbon aralkyl group (e.g., a benzyl group, a phenethyl group, or a p-chlorobenzyl group).

Each of R3 and R4 represents a substituent. Examples of this substituent are a hydrogen atom, a halogen atom, a substituted or nonsubstituted alkyl group (e.g., methyl and hydroxyethyl), a substituted or nonsubstituted aryl group (e.g., phenyl and p-chlorophenyl), and a substituted or nonsubstituted aralkyl group (e.g., benzyl). Each of R3 and R4 can be substituted by one or a plurality of substituents.

Although X represents an anion group, no X is necessary in the case of intramolecular salt. Examples of X are chlorine ion, bromine ion, iodine ion, nitric acid ion, sulfuric acid ion, p-toluenesulfonic acid ion, and oxalate.

D represents one or an alternate combination of alkylene and —O—. Examples of D are trimethylene, pentamethylene, heptamethylene, nonamethylene, —$CH_2CH_2OCH_2CH_2$—, —$(CH_2CH_2O)_2$—$CH_2CH_2$—, and —$(CH_2CH_2O)_3$—$CH_2CH_2$—.

Each of m and n represents 0, 1, or 2. Each of R6 and R7 represents a 4- to 20-carbon alkyl group (e.g., butyl, hexyl, or dodecyl), a 6- to 20-carbon aryl group, or a 7- to 20-carbon aralkyl group (e.g., benzyl, phenethyl, or p-chlorobenzyl). If m=2 and n=2, R6 or R7 can form a condensed ring as a benzene ring, i.e., can represent a quinoline ring or an isoquinoline ring.

Of compounds represented by formulas (1), (2), and (3) of the present invention, compounds represented by formulas (2) and (3) are preferred, and a compound represented by formula (3) is more preferred.

Practical preferable examples are: a compound in which m=1, n=1, R6 and R7 are phenyl, D is —$(CH_2CH_2O)_2$—$CH_2CH_2$—, and X is Cl; a compound in which m=1, n=1, R6 and R7 are benzyl, D is —$(CH_2CH_2O)_2$—$CH_2CH_2$—, and X is Cl; a compound in which m=2, n=2, R6 and R7 are benzene condensed rings, D is —$(CH_2CH_2O)_2$—$CH_2CH_2$—, and X is Cl; a compound in which R6 and R7 are phenyl, D is trimethylene, and X is Br; and a compound in which A is a pyridine ring, R1 and R2 are p-chlorobenzyl, B is trimethylene, and x is paratoluenesulfonic acid.

Compounds represented by formulas (1), (2), and (3) of the present invention are preferably added by dissolving in a water-soluble solvent such as water, methanol, or ethanol, or in a solvent mixture of these solvents.

The addition timing of compounds represented by formulas (1), (2), and (3) of the present invention can be before or after the addition timing of sensitizing dyes. These compounds are contained in a silver halide emulsion such that the addition amount is preferably 1 to 25 mol %, and more preferably, 2 to 15 mol % of sensitizing dyes. If the addition amount of compounds represented by formulas (1) to (3) used in the present invention is too large, the amount of sensitizing dyes which can be adsorbed to emulsion grains may decrease. Therefore, the above addition amounts are preferred.

Compounds represented by formulas (1) to (3) of the present invention can be readily synthesized by methods similar to those described in Quart. Rev. 16, 163 (1962), the disclosure of which is herein incorporated by reference.

Representative examples of compounds represented by formulas (1), (2), and (3) used in the present invention are presented below, but the present invention is not limited to these examples.

I-1
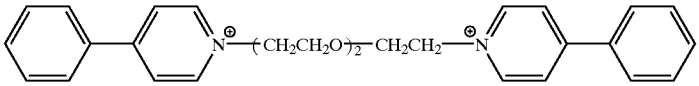
2 Cl⊖
I-2
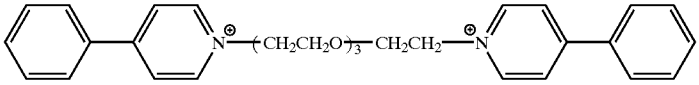
2 Cl⊖
I-3
I-4
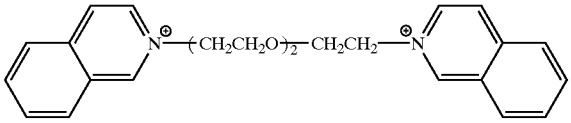
2 Cl⊖
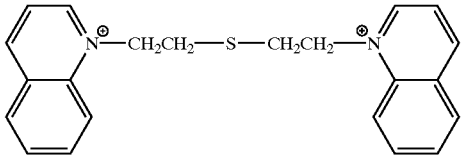
2 Br⊖
I-5
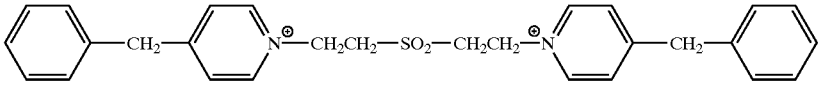
2 Br⊖
I-6
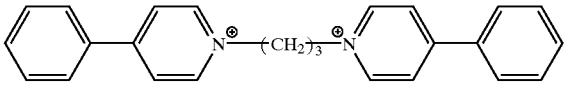
2 Br⊖
I-7
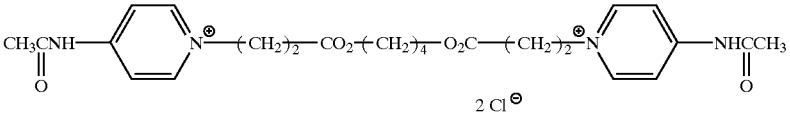
2 Cl⊖
I-8
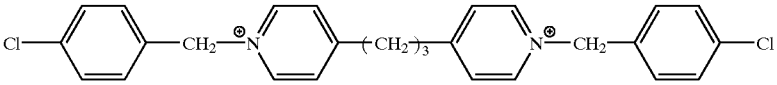
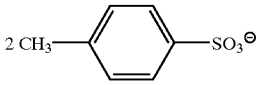
I-9
I-10
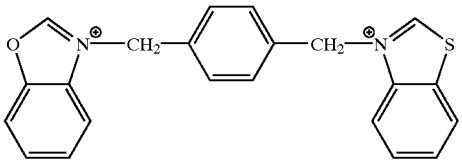
2 Cl⊖
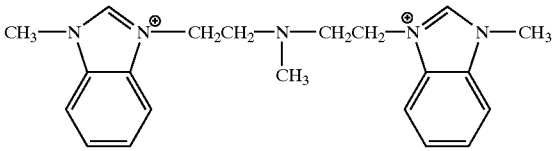
2 NO$_3$⊖
I-11
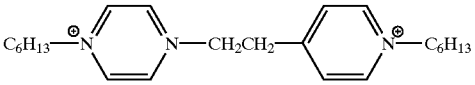
SO$_4$$^{2}$⊖
I-12
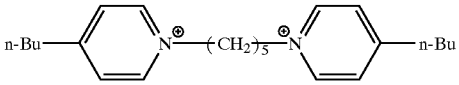
2 Cl⊖
I-13
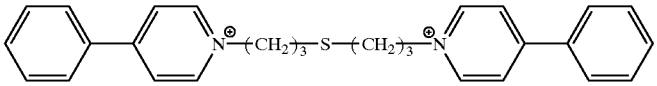
2 Cl⊖

-continued
I-14
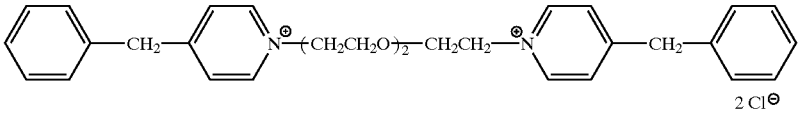
2 Cl⊖
I-15
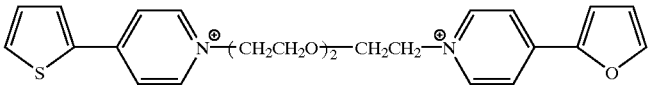
2 Cl⊖
I-16
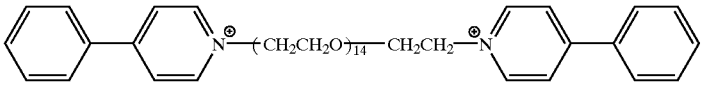
2 Cl⊖
I-17
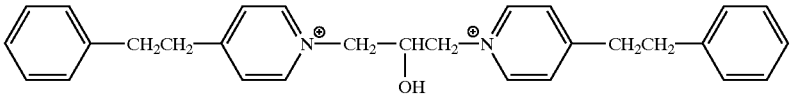
2 Cl⊖
I-18
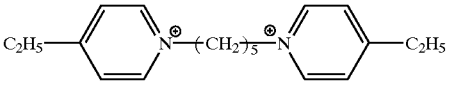
2 Cl⊖
I-19
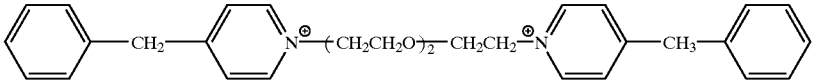
2 Cl⊖
I-20
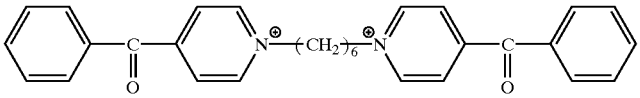
2 Br⊖
I-21
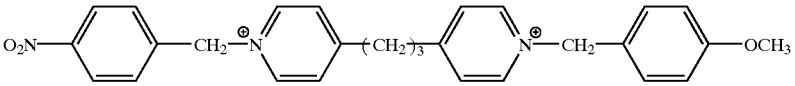
2 Br⊖
I-22
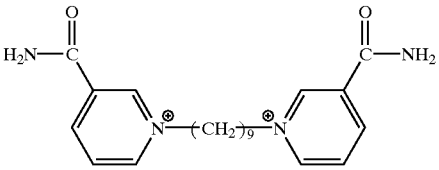
2 Br⊖
I-23
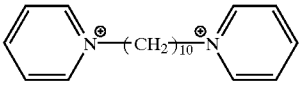
2 Br⊖
I-24
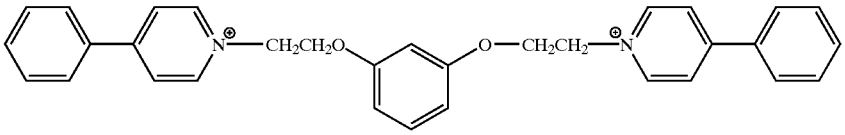
2 Cl⊖
I-25
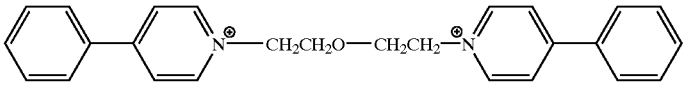
2 Cl⊖

The present invention relates to a silver iodobromide or silver bromochloroiodide tabular grain emulsion.

The tabular grain emulsion used in the present invention is composed of (111) major surfaces facing each other and side faces connecting these major surfaces. This tabular grain emulsion is made from silver iodobromide or silver bromoiodochloride. Although the emulsion can also contain silver chloride, the content of this silver chloride is preferably 8 mol % or less, more preferably, 3 mol % or less, and most preferably, 0 mol %. The content of silver iodide is preferably 20 mol % or less, since the variation coefficient of the distribution of grain sizes in a tabular grain emulsion is preferably 25% or less. Reducing the silver iodide content facilitates decreasing the variation coefficient of the distribution of grain sizes of a tabular grain emulsion. In particular, the variation coefficient of the distribution of grain sizes of a tabular grain emulsion is more preferably 20% or less, and the silver iodide content is preferably 10 mol % or less.

Regardless of the silver iodide content, the variation coefficient of the distribution of inter-grain silver iodide contents is preferably 20% or less, and particularly preferably, 10% or less.

The tabular grain emulsion used in the present invention preferably has a structure inside a grain in terms of a silver iodide distribution. This silver iodide distribution structure can be a double structure, a triple structure, a quadruple structure, or a structure of higher order.

In the tabular grain emulsion of the present invention, 50% or more of the total projected area are accounted for by grains having an aspect ratio of 2 or more. The projected surface area and aspect ratio of a tabular grain can be measured from an electron micrograph obtained by shadowing the tabular grain together with a reference latex sphere by using a carbon replica method. When viewed from the direction perpendicular to the major surface, a tabular grain commonly has the shape of a hexagon, triangle, or circle. An aspect ratio is the value obtained by dividing the diameter of a circle having an area equal to the projected surface area of a tabular grain by the thickness of the grain. As the shape of a tabular grain, the ratio of hexagons is preferably as high as possible. Also, the ratio of the lengths of adjacent sides of a hexagon is preferably 1:2 or less. The higher the aspect ratio, the more remarkable the effect of the present invention. Therefore, in a tabular grain emulsion 50% or more of the total projected surface area are accounted for by grains having an aspect ratio of preferably 5 or more, and more preferably, 8 or more. If the aspect ratio is too high, however, the variation coefficient of the grain size distribution described above tends to increase. Accordingly, it is usually preferable that the aspect ratio be 50 or less.

In the present invention, a tabular grain emulsion is composed of (111) major surfaces and side faces connecting these major surfaces. At least one twin plane exists between the major surfaces. In a tabular grain emulsion of the present invention, two twin planes are usually observed. As described in U.S. Pat. No. 5,219,720, the spacing between these two twin planes can be decreased to less than 0.012 μm. Also, as described in JP-A-5-249585, the value obtained by dividing the distance between the (111) major surfaces by the twin plane spacing can be increased to 15 or more.

In the present invention, it is significantly preferable that 75% or less of all side faces connecting the opposing (111) major surfaces of a tabular grain emulsion, be composed of (111) faces. "75% or less of all side faces are composed of (111) faces" means that crystallographic faces other than a (111) face exist at a ratio of 25% or more of all side faces. Although commonly it can be understood that this face is a (100) face, the face can also be a (110) face or a higher-index face.

The tabular grains of the present invention have dislocation lines. Dislocation lines in tabular grains can be observed by a direct method performed at a low temperature using a transmission electron microscope, as described in, e.g., J. F. Hamilton, Phot. Sci. Eng., 11, 57, (1967) or T. Shiozawa, J. Soc. Phot. Sci. Japan, 35, 213, (1972). That is, silver halide grains, extracted carefully from an emulsion so as not to apply a pressure at which dislocations are produced in the grains, are placed on a mesh for electron microscopic observation. Observation is performed by a transmission method while the sample is cooled to prevent damages (e.g., print out) due to electron rays. In this case, the larger the thickness of a grain, the more difficult it becomes to transmit electron rays through it. Therefore, grains can be observed more clearly by using an electron microscope of high voltage type (200 kV or more for a grain having a thickness of 0.25 μm). From photographs of grains obtained by the above method, it is possible to obtain the positions and the number of dislocation lines in each grain viewed in a direction perpendicular to the major faces of the grain.

The average number of dislocation lines is preferably 10 or more, and more preferably, 20 or more per grain. If dislocation lines are densely present or they cross each other when observed, it is sometimes impossible to correctly count dislocation lines per grain. Even in these situations, however, dislocation lines can be roughly counted to such an extent as in units of 10 lines, like 10, 20, or 30 dislocation lines, thereby making it possible to distinguish these grains from those in which obviously only a few dislocation lines are present. The average number of dislocation lines per grain is obtained as a number average by counting dislocation lines of 100 or more grains.

Dislocation lines can be introduced to, e.g., a portion near the peripheral of a tabular grain, hereinafter, this portion is referred to as near peripheral region. In this case, dislocations are substantially perpendicular to the peripheral and produced from a position x % of the length between the center and the edge (peripheral) of a tabular grain to the peripheral. The value of X is preferably 10 to less than 100, more preferably, 30 to less than 99, and most preferably, 50 to less than 98. In this case, although a shape obtained by connecting the start positions of the dislocations is almost similar to the shape of the grain, it is not perfectly similar but sometimes distorted. Dislocations of this type are not found in the central region of a grain. The direction of dislocation lines is crystallographically, approximately a (211) direction. Dislocation lines, however, are often zigzagged and sometimes cross each other.

The tabular grain may have dislocation lines either almost uniformly across the whole near peripheral region or at a particular position of the near peripheral region. That is, in the case of a hexagonal tabular silver halide grain, dislocation lines may be limited to either portions near the six corners or only a portion near one of the six corners. Conversely, it is also possible to limit dislocation lines to only portions near the edges except for the portions near the six corners.

Dislocation lines can also be formed across a region containing the centers of two parallel major faces of a tabular grain. When dislocation lines are formed across the entire region of the major faces, the direction of the dislocation lines is sometimes crystallographically, approximately a (211) direction with respect to a direction perpendicular to the major faces. In some cases, however, the direction is a (110) direction or random. The lengths of the individual dislocation lines are also random; the dislocation lines are sometimes observed as short lines on the major faces and sometimes observed as long lines reaching the edges (peripheral). Although dislocation lines are sometimes straight, they are often zigzagged. In many cases, dislocation lines cross each other.

As described above, the dislocations can be positioned over the peripheral region or over the major faces or the dislocations can be localized in the peripheral region or on the major faces, or the dislocations can be positioned at combination of above mentioned areas. That is, dislocation lines can be present on both the peripheral region and the major faces.

In the present invention, dislocation lines are most preferably introduced by adding a sparingly soluble silver halide emulsion to a silver bromide, silver chlorobromide, silver bromochloroiodide, or silver iodobromide emulsion described above. A sparingly soluble silver halide emulsion is more sparingly soluble than a tabular grain emulsion to which the sparingly soluble silver halide emulsion is added in terms of a halogen composition, and is preferably a silver iodide fine grain emulsion.

In the present invention, dislocation lines are preferably introduced by abruptly adding a silver iodide fine grain emulsion to a tabular grain emulsion described above. This procedure substantially includes two steps: a step of abruptly adding a silver iodide fine grain emulsion to a tabular grain emulsion, and a step of introducing dislocation lines by growing silver bromide or silver iodobromide. These two steps are sometimes performed completely separately and can also be performed at the same time. Preferably, the steps are performed separately. The first step of abruptly adding a silver iodide fine grain emulsion to a tabular grain emulsion will be described below.

"Abruptly adding a silver iodide fine grain emulsion" is to add a silver iodide fine grain emulsion within preferably ten minutes, and more preferably, seven minutes. This condition can vary in accordance with the temperature, pBr, and pH of the system to which the fine grain emulsion is added, the type and concentration of a protective colloid agent such as gelatin, and the presence/absence, type, and concentration of a silver halide solvent. However, a shorter addition time is more preferable as described above. During the addition, it is preferable that an aqueous solution of silver salt such as silver nitrate be not essentially added. The temperature of the system during the addition is preferably 40° C. to 90° C., and particularly preferably, 50° C. to 80° C. The pBr of a silver iodide fine grain emulsion during the addition is not particularly limited.

A silver iodide fine grain emulsion essentially need only be silver iodide and can contain silver bromide and/or silver chloride as long as a mixed crystal can be formed. The emulsion is preferably 100% silver iodide. The crystal structure of silver iodide can be a β body, a γ body, or, as described in U.S. Pat. No. 4,672,026, the disclosure of which is herein incorporated by reference, an α body or an α body similar structure. In the present invention, the crystal structure is not particularly restricted but is preferably a mixture of β and γ bodies, and more preferably, a β body. The silver iodide fine grain emulsion can be either an emulsion formed immediately before addition described in U.S. Pat. No. 5,004,679 the disclosure of which is herein incorporated by reference, or an emulsion subjected to a regular washing step. In the present invention, an emulsion subjected to a regular washing step is used. The silver iodide fine grain emulsion can be readily formed by a method described in, e.g., aforementioned U.S. Pat. No. 4,672,026. A double-jet addition method using an aqueous silver salt solution and an aqueous iodide salt solution in which grain formation is performed with a fixed pI value is preferred. The pI is the logarithm of the reciprocal of the $I^-$ ion concentration of the system. The temperature, pI, and pH of the system, the type and concentration of a protective colloid agent such as gelatin, and the presence/absence, type, and concentration of a silver halide solvent are not particularly limited. However, a grain size of preferably 0.1 μm or less, and more preferably, 0.08 μm or less is convenient for the present invention. Although the grain shapes cannot be perfectly specified because the grains are fine grains, the variation coefficient of a grain size distribution is preferably 25% or less. The effect of the present invention is particularly remarkable when the variation coefficient is 20% or less. The sizes and the size distribution of the silver iodide fine grain emulsion are obtained by placing silver iodide fine grains on a mesh for electron microscopic observation and directly observing the grains by a transmission method instead of a carbon replica method. This is because measurement errors are increased by observation done by the carbon replica method since the grain sizes are small. The grain size is defined as the diameter of a circle having an area equal to the projected surface area of the observed grain. The grain size distribution also is obtained by using this equivalent-circle diameter of the projected surface area. In the present invention, the most effective silver iodide fine grains have a grain size of 0.07 to 0.02 μm and a grain size distribution variation coefficient of 18% or less.

After the grain formation described above, a silver iodide fine grain emulsion is preferably subjected to regular washing described in, e.g., U.S. Pat. No. 2,614,929, the disclosure of which is herein incorporated by reference, and adjustments of the pH, the pI, the concentration of a protective colloid agent such as gelatin, and the concentration of the contained silver iodide are performed. The pH is preferably 5 to 7. The pI value is preferably the one at which the solubility of silver iodide is a minimum or the one higher than that value. As the protective colloid agent, a common gelatin having an average molecular weight of approximately 100,000 is preferably used. A low-molecular-weight gelatin having an average molecular weight of 20,000 or less also is preferably used. It is sometimes convenient to use a mixture of gelatins having different molecular weights. The gelatin amount is preferably 10 to 100 g, and more preferably, 20 to 80 g per kg of an emulsion. The silver amount is preferably 10 to 100 g, and more preferably, 20 to 80 g, in terms of silver atoms, per kg of an emulsion. As the gelatin amount and/or the silver amount, it is preferable to choose values suited to abrupt addition of the silver iodide fine grain emulsion.

The addition amount of a silver iodide fine grain emulsion is preferably 1 to 10 mol %, and most preferably, 2 to 7 mol %, in terms of silver, with respect to a finished or final tabular grain emulsion. By choosing this addition amount, dislocation lines are preferably introduced, and the effect of the present invention becomes conspicuous. The silver iodide fine grain emulsion is usually dissolved before being added. During the addition it is necessary to sufficiently raise the efficiency of stirring of the system. The rotating speed of stirring is preferably set to be higher than usual. The addition of an antifoaming agent is effective to prevent the formation of foam during the stirring. More specifically, an antifoaming agent described in, e.g., examples of U.S. Pat. No. 5,275,929 is used.

After a silver iodide fine grain emulsion is abruptly added to the tabular grain emulsion, silver bromide or silver iodobromide is grown to introduce dislocation lines. Although the growth of silver bromide or silver iodobromide can be started before or at the same time the addition of a silver iodide fine grain emulsion, the growth of silver bromide or silver iodobromide is preferably started after the addition of the silver iodide fine grain emulsion. The time from the addition of the silver iodide fine grain emulsion to the start of the growth of silver bromide or silver iodobromide is preferably 10 min to 1 sec, more preferably, 5 min to 3 sec, and most preferably, within 1 min. This time interval is preferably as short as possible.

Silver bromide is preferably grown after the addition of the silver iodide fine grain emulsion. When silver iodobromide is used, the silver iodide content of the silver iodobromide to be grown is 3 mol % or less. Assume that the total silver amount of a completed tabular grain emulsion is 100, the silver amount of a layer grown after the addition of this silver iodide fine grain emulsion is preferably 5 to 50, and most preferably, 10 to 30. The temperature, pH, and pBr during the formation of this layer are not particularly restricted. However, the temperature is usually 40° C. to 90° C., and more preferably, 50° C. to 80° C., and the pH is usually 2 to 9, and more preferably, 3 to 7. In the present invention, the pBr at the end of the formation of the layer is preferably higher than that in the initial stages of the layer formation. Preferably, the pBr in the initial stages of the layer formation is 2.9 or less, and the pBr at the end of the layer formation is 1.7 or more. More preferably, the pBr in the initial stages of the layer formation is 2.5 or less, and the pBr at the end of the layer formation is 1.9 or more. Most preferably, the pBr in the initial stages of the layer formation is 1 to 2.3, and pBr at the end of the layer formation is 2.1 to 4.5. Dislocation lines are preferably introduced in the present invention by the above method.

Reduction sensitization performed in the present invention can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. It is also possible to combine two or more of these methods.

The method of adding reduction sensitizers is preferred in that the level of reduction sensitization can be finely adjusted.

Known examples of the reduction sensitizer are stannous chloride, ascorbic acid and its derivatives, hydroquinone and its derivatives, catechol and its derivatives, hydroxylamine and its derivatives, amines and polyamines, hydrazine and its derivatives, paraphenylenediamine and its derivatives, formamidinesulfinic acid (thiourea dioxide), a silane compound, and a borane compound. In reduction sensitization of the present invention, it is possible to selectively use these reduction sensitizers or to use two or more types of compounds together. As methods of reduction sensitization, it is possible to use methods disclosed in U.S. Pat. Nos. 2,518,698, 3,201,254, 3,411,917, 3,779,777, and 3,930,867, the disclosures of which are herein incorporated by reference. As methods of using reducing agents, methods disclosed in Jpn. Pat. Appln. KOKOKU Publication No. (hereinafter referred to as JP-B-)57-33572, JP-B-58-1410, and JP-A-57-179835, the disclosures of which are herein incorporated by reference can be used. Preferable compounds as the reduction sensitizer are stannous chloride, thiourea dioxide, dimethylamineborane (borane-dimethylamine complex), and ascorbic acid and its derivatives. Although the addition amount of reduction sensitizers must be so selected as to meet the emulsion manufacturing conditions, a proper amount is $10^{-7}$ to $10^{-2}$ mol per mol of a silver halide.

Reduction sensitizers are dissolved in water or a solvent, such as alcohols, glycols, ketones, esters, or amides, and the resultant solution is added preferably during grain growth.

Reduction sensitizers are preferably added in the presence of a compound represented by formula (4) or (5) below:

(4)

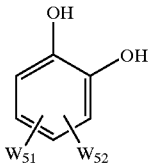

(5)

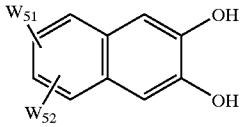

In formulas (4) and (5), each of W51 and W52 represents a sulfo group or a hydrogen atom. At least one of W51 and W52 represents a sulfo group. A sulfo group is generally an alkali metal salt such as sodium or potassium, or a water-soluble salt such as ammonium salt. Practical examples of preferable compounds are 3,5-disulfocatecholdisodium salt, 4-sulfocatecholammonium salt, 2,3-dihydroxy-7-sulfonaphthalenesodium salt, and 2,3-dihydroxy-6,7-disulfonaphthalenepotassium salt. A preferable addition amount can change in accordance with the temperature, pBr, and pH of a system to which this compound is added, the type and concentration of a protective colloid agent such as gelatin, and the presence/absence, type, and concentration of a silver halide solvent. However, the addition amount is generally 0.005 to 0.5 mol, and more preferably, 0.003 to 0.02 mol, per mol silver halide.

Examples of the silver halide solvent usable in the present invention are (a) organic thioethers described in, e.g., U.S. Pat. Nos. 3,271,157, 3,531,289, and 3,574,628, and JP-A-54-1019 and JP-A-54-158917, (b) thiourea derivatives described in, e.g., JP-A-53-82408, JP-A-55-77737, and JP-A-55-2982, (c) a silver halide solvent having a thiocarbonyl group sandwiched between an oxygen or sulfur atom and a nitrogen atom described in JP-A-53-144319, (d) imidazoles described in JP-A-54-100717, (e) ammonia, and (f) thiocyanate.

Particularly preferable solvents are thiocyanate, ammonia, and tetramethylthiourea. Although the amount of a solvent used changes in accordance with the type of the solvent, a preferable amount of, e.g., thiocyanate is $1\times10^{-4}$ to $1\times10^{-2}$ mol per mol of a silver halide.

EP515894A1 and the like can be referred to as a method of changing the face index of a side face of a tabular grain emulsion. Also, polyalkyleneoxide compounds described in, e.g., U.S. Pat. No. 5,252,453 can be used. It is effective to use face index modifiers described in, e.g., U.S. Pat. Nos. 4,680,254, 4,680,255, 4,680,256, and 4,684,607. Common photographic spectral sensitizing dyes also can be used as face index modifiers.

In the present invention, as long as the aforesaid required conditions are met a silver iodobromide or silver bromochloroiodide tabular grain emulsion can be prepared by various methods. The preparation of a tabular grain emulsion basically includes three steps of nucleation, ripening, and growth. In the nucleation step of a tabular grain emulsion of the present invention, it is extremely effective to use gelatin having a small methionine content described in U.S. Pat. Nos. 4,713,320 and 4,942,120, perform nucleation at high pBr described in U.S. Pat. No. 4,914,014, and perform nucleation within short time periods described in JP-A-2-222940, all the disclosures of which are herein incorporated by reference. In the ripening step of a tabular grain emulsion of the present invention, it is sometimes effective to perform ripening in the presence of a low-concentration base described in U.S. Pat. No. 5,254,453 and perform ripening at high pH described in U.S. Pat. No. 5,013,641, the disclosures of which are herein incorporated by reference. In the growth step of a tabular grain emulsion of the present invention, it is particularly effective to perform growth at low temperature described in U.S. Pat. No. 5,248,587 and use fine silver iodide grains described in U.S. Pat. No. 4,693,964, the disclosures of which are herein incorporated by reference. Additionally, it is preferable to perform growth by adding and ripening silver bromide, silver iodobromide, and silver bromochloroiodide fine grain emulsions. It is also possible to supply these fine grain emulsions by using a stirring device described in JP-A-10-43570, the disclosure of which is herein incorporated by reference.

The silver iodide content on the grain surface of a tabular grain emulsion of the present invention is preferably 10 mol % or less, and particularly preferably, 5 mol % or less. The silver iodide content on the grain surface of the present invention is measured by using XPS (X-ray Photoelectron Spectroscopy). The principle of XPS used in an analysis of the silver iodide content near the surface of a silver halide grain is described in Junnich Aihara et al., "Spectra of Electrons" (Kyoritsu Library 16: issued Showa 53 by Kyoritsu Shuppan). A standard measurement method of XPS is to use Mg-Kα as excitation X-rays and measure the intensities of photoelectrons (usually I-3d5/2 and Ag-3d5/2) of iodine (I) and silver (Ag) released from silver halide grains in an appropriate sample form. The content of iodine can be calculated from a calibration curve of the photoelectron intensity ratio (intensity (I)/intensity (Ag)) of iodine (I) to silver (Ag) formed by using several different standard samples having known iodine contents. XPS measurement for a silver halide emulsion must be performed after gelatin adsorbed by the surface of a silver halide grain is decomposed and removed by, e.g., proteinase. A tabular grain emulsion in which the silver iodide content on the grain surface is 10 mol % or less is an emulsion whose silver iodide content is 10 mol % or less when the emulsion grains are analyzed by XPS. If obviously two or more types of emulsions are mixed, appropriate preprocessing such as centrifugal separation or filtration must be performed before one type of emulsion is analyzed.

The effect of the present invention is noticeable when the grain surface of a tabular grain emulsion of the present invention contains 10 mol % or less of silver iodide. More preferably, the silver iodide content on the grain surface is 1 to 5 mol %. The structure of a tabular grain emulsion of the present invention is preferably a triple structure of silver bromide/silver iodobromide/silver bromide or a higher-order structure. The boundary of silver iodide content between structures can be either a clear boundary or a continuously gradually changing boundary. Commonly, when measured by using a powder X-ray diffraction method, the silver iodide content does not show any two distinct peaks; it shows an X-ray diffraction profile whose tail extends in the direction of high silver iodide content.

In the present invention, the silver iodide content in a layer (or phase) inside the surface is preferably higher than that on the surface; the silver iodide content in a layer inside the surface is preferably 5 mol % or more, and more preferably, 7 mol % or more.

A photographic emulsion in the present invention is preferably spectrally sensitized to have red sensitivity. "Red sensitivity" means that an emulsion is so spectrally sensitized that the spectral sensitization sensitivity is a maximum at 600 nm to less than 700 nm.

Useful sensitizing dyes are described in, e.g., JP-A-2-68539, page 4, lower right column, line 4 to page 8, lower right column, and JP-A-2-58041, page 12, lower left column, line 8 to lower right column, line 19, disclosures of which are herein incorporated by reference. Other examples of useful sensitizing dyes are described in German Patent 929,080, U.S. Pat. Nos. 2,493,748, 2,503,776, 2,519,001, 2,912,329, 3,656,959, 3,672,897, and 4,025,349, British Patent 1,242,588, and JP-B-44-14030, all disclosures of which are herein incorporated by reference.

Although these sensitizing dyes can be used singly, combinations of these sensitizing dyes can also be used. Combinations of sensitizing dyes are often used for a supersensitization purpose. Representative examples of combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281 and 1,507,803, JP-B-43-4936, JP-B-53-12375, JP-A-52-110618, and JP-A-52-109925, all the disclosures of which are herein incorporated by reference.

In the present invention, it is particularly preferable to perform red-sensitive spectral sensitization by adding two or more types of cyanine dyes. Not all of these two or more types of cyanine dyes need to be red-sensitive; it is only necessary to perform spectral sensitization such that the spectral sensitization sensitivity has its maximum at the spectral region of red as a result of addition of two or more types of cyanine dyes.

In addition to sensitizing dyes, emulsions can also contain dyes having no spectral sensitizing effect or substances not essentially absorbing visible light and presenting supersensitization. Sensitizing dyes can be added to an emulsion at any point in preparation of an emulsion, which is conventionally known to be useful. Most ordinarily, the addition is performed after completion of chemical sensitization and before coating. However, it is possible to perform the addition at the same timing as addition of chemical sensitizing dyes to perform spectral sensitization and chemical sensitization simultaneously, as described in U.S. Pat. Nos. 3,628,969 and 4,225,666, the disclosures of which are herein incorporated by reference. It is also possible to perform the addition prior to chemical sensitization, as described in JP-A-58-113928, the disclosure of which is herein incorporated by reference, or before completion of formation of a silver halide grain precipitation to start spectral sensitization. Alternatively, as disclosed in U.S. Pat. No. 4,225,666, the disclosure of which is herein incorporated by reference, these compounds can be added separately; a portion of the compounds may be added prior to chemical sensitization, while the remaining portion is added after that. That is, the compounds can be added at any timing during formation of silver halide grains, including the method disclosed in U.S. Pat. No. 4,183,756, the disclosure of which is herein incorporated by reference.

The addition amount of sensitizing dyes to the tabular grain emulsion of the present invention is preferably $2\times10^{-4}$ mol or more per mol of a silver halide.

In the formation of silver halide grains of the present invention, at least one of sulfur sensitization, selenium sensitization, and noble metal sensitization including gold sensitization and palladium sensitization, and reduction sensitization can be performed at any point during the process of manufacturing a silver halide emulsion. The use of two or more different sensitizing methods is preferable. Several different types of emulsions can be prepared by changing the timing at which the chemical sensitization is performed. The emulsion types are classified into: a type in which a chemical sensitization speck is embedded inside a grain, a type in which it is embedded in a shallow position from the surface of a grain, and a type in which it is formed on the surface of a grain. In emulsions of the present invention, the position of a chemical sensitization speck can be selected in accordance with the intended use. However, it is preferable to form at least one type of a chemical sensitization speck in the vicinity of the surface.

One chemical sensitization which can be preferably performed in the present invention is chalcogen sensitization, noble metal sensitization, or a combination of these. The sensitization can be performed by using active gelatin as described in T.H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferred. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, i.e., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

It is preferable to also perform gold sensitization for emulsions of the present invention. An amount of a gold sensitizer is preferably $1\times10^{-4}$ to $1\times10^{-7}$ mol, and more preferably, $1\times10^{-5}$ to $5\times10^{-7}$ mol per mol of a silver halide. A preferable amount of a palladium compound is $1\times10^{-3}$ to $5\times10^{-7}$. A preferable amount of a thiocyan compound or a selenocyan compound is $5\times10^{-2}$ to $1\times10^{-6}$.

An amount of a sulfur sensitizer with respect to silver halide grains of the present invention is preferably $1\times10^{-4}$ to $1\times10^{-7}$ mol, and more preferably, $1\times10^{-5}$ to $5\times10^{-7}$ mol per mol of a silver halide.

Selenium sensitization is a preferable sensitizing method for emulsions of the present invention. Known labile selenium compounds are used in the selenium sensitization. Practical examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

In the present invention, preferably thiocyanate is added before the addition of spectral sensitizing dyes and chemical sensitizers described above. Thiocyanate is added preferably after grain formation, and more preferably, after a desalting step. Since thiocyanate is preferably added in chemical sensitization, the addition of thiocyanate is performed twice or more. Examples of thiocyanate are potassium thiocyanate, sodium thiocyanate, and ammonium thiocyanate.

Thiocyanate is usually added by dissolving in an aqueous solution or a water-soluble solvent. The addition amount is preferably $1\times10^{-5}$ to $1\times10^{-2}$ mol, more preferably, $5\times10^{-5}$ to $5\times10^{-3}$ mol per mol of a silver halide.

It is advantageous to use gelatin as a protective colloid for use in preparation of emulsions of the present invention or as a binder for other hydrophilic colloid layers. However, another hydrophilic colloid can also be used in place of gelatin.

Examples of the hydrophilic colloid are protein, such as a gelatin derivative, a graft polymer of gelatin and another high polymer, albumin, and casein; sugar derivatives, such as cellulose derivatives, e.g., cellulose sulfates, hydroxyethylcellulose, and carboxymethylcellulose, soda alginate, and starch derivatives; and a variety of synthetic hydrophilic high polymers, such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole.

Examples of gelatin are lime-processed gelatin, acid-processed gelatin, and enzyme-processed gelatin described in Bull. Soc. Sci. Photo. Japan. No. 16, page 30 (1966). In addition, a hydrolyzed product or an enzyme-decomposed product of gelatin can also be used.

It is preferable to wash an emulsion of the present invention to form a newly prepared protective colloid dispersion for a desalting purpose. Although the temperature of washing can be selected in accordance with the intended use, it is preferably 5° C. to 50° C. Although the pH of washing can also be selected in accordance with the intended use, it is preferably 2 to 10, and more preferably 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

In the preparation of an emulsion of the present invention, it is preferable to make salt of metal ion exist during grain formation, desalting, or chemical sensitization, or before coating in accordance with the intended use. The metal ion salt is preferably added during grain formation when doped into grains, and after grain formation and before completion of chemical sensitization when used to decorate the grain surface or used as a chemical sensitizer. The salt can be doped in any of an overall grain, only the core, the shell, or the epitaxial portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroacid salt, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in the form of a combination of two or more types of them.

The metal compounds are preferably dissolved in an appropriate solvent, such as methanol or acetone, and added in the form of a solution. To stabilize the solution, an aqueous halogenated hydrogen solution (e.g., HCl and HBr) or an alkali halide (e.g., KCl, NaCl, KBr, and NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, and KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

It is sometimes useful to perform a method of adding a chalcogen compound during preparation of an emulsion, such as described in U.S. Pat. No. 3,772,031. In addition to S, Se, and Te, cyanate, thiocyanate, selenocyanic acid, carbonate, phosphate, and acetate can be present.

It is preferable to use an oxidizer for silver during the process of manufacturing emulsions of the present invention. However, hole capturing silver nuclei on the grain surface must remain to some extent. An oxidizer for silver means a compound having an effect of converting metal silver into silver ion. A particularly effective compound is the one that converts very fine silver grains, as a by-product in the process of formation of silver halide grains and chemical sensitization, into silver ion. The silver ion produced can form a silver salt hard to dissolve in water, such as a silver halide, silver sulfide, or silver selenide, or a silver salt easy to dissolve in water, such as silver nitrate. An oxidizer for silver can be either an inorganic or organic substance. Examples of the inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O)$, permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers of the present invention are ozone, hydrogen peroxide and its adduct, a halogen element, an inorganic oxidizer of thiosulfonate, and an organic oxidizer of quinones.

Photographic emulsions used in the present invention can contain various compounds in order to prevent fog during the manufacturing process, storage, or photographic processing of a sensitized material, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly hydroxy-substituted(1,3,3a,7)tetrazaindenes), and pentazaindenes. For example, compounds described in U.S. Pat. Nos. 3,954,474 and 3,982,947 and JP-B-52-28660 can be used. One preferable compound is described in Japanese Patent Application No. 62-47225. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

Techniques such as a layer arrangement technique, silver halide emulsions, dye formation couplers, functional couplers such as DIR couplers, various additives, and development usable in emulsions of the present invention and photographic light-sensitive materials using the emulsions are described in European Patent No. 0565096A1 (laid open in Oct. 13, 1993) and the patents cited in it, all the disclosures of which are herein incorporated by reference. The individual items and the corresponding portions are enumerated below.

1. Layer arrangements: page 61, lines 23–35, page 61, line 41-page 62, line 14
2. Interlayers: page 61, lines 36–40
3. Interimage effect donor layers: page 62, lines 15–18
4. Silver halide halogen compositions: page 62, lines 21–25
5. Silver halide grain crystal habits: page 62, lines 26–30
6. Silver halide grain size: page 62, lines 31–34
7. Emulsion preparation methods: page 62, lines 35–40
8. Silver halide grain size distribution: page 62, lines 41–42
9. Tabular grains: page 62, lines 43–46
10. Internal structures of grains: page 62, lines 47–53
11. Latent image formation types of emulsions: page 62, line 54-page 63, line 5
12. Physical ripening-chemical ripening of emulsions: page 63, lines 6–9

13. Use of emulsion mixtures: page 63, lines 10–13
14. Fogged emulsions: page 63, lines 14–31
15. Non-light-sensitive emulsions: page 63, lines 32–43
16. Silver coating amount: page 63, lines 49–50
17. Photographic additives: described in Research Disclosure (RD) Item 17643 (December, 1978), RD Item 18716 (November, 1979), and RD Item 307105 (November, 1989). The individual items and the corresponding portions are presented below.

| | Additives | RD17643 | RD18716 |
|---|---|---|---|
| 1. | Chemical sensitizers | page 23 | page 648, right column |
| 2. | Sensitivity increasing agents | | same as above |
| 3. | Spectral sensitizers, super sensitizers | pages 23–24 | page 648, right column to page 649, right column |
| 4. | Brighteners | page 24 | page 647, right column |
| 5. | Antifoggants and stabilizers | pages 24–25 | page 649, right column |
| 6. | Light absorbent, filter dye, ultraviolet absorbents | pages 25–26 | page 649, right column to page 650, left column |
| 7. | Stain preventing agents | page 25, right column | page 650, left to right columns |
| 8. | Dye image stabilizer | page 25 | page 650, left column |
| 9. | Hardening agents | page 26 | page 651, left column |
| 10. | Binder | page 26 | same as above |
| 11. | Plasticizers, lubricants | page 27 | page 650, right column |
| 12. | Coating aids, surface active agents | pages 26–27 | same as above |
| 13. | Antistatic agents | page 27 | same as above |
| 14. | Matting agent | | |

| | Additives | RD307105 |
|---|---|---|
| 1. | Chemical sensitizers | page 866 |
| 2. | Sensitivity increasing agents | |
| 3. | Spectral sensitizers, super sensitizers | pages 866–868 |
| 4. | Brighteners | page 868 |
| 5. | Antifoggants and stabilizers | pages 868–870 |
| 6. | Light absorbent, filter dye, ultraviolet absorbents | page 873 |
| 7. | Stain preventing agents | page 872 |
| 8. | Dye image stabilizer | page 872 |
| 9. | Hardening agents | pages 874–875 |
| 10. | Binder | pages 873–874 |
| 11. | Plasticizers, lubricants | page 876 |
| 12. | Coating aids, surface active agents | pages 875–876 |
| 13. | Antistatic agents | pages 876–877 |
| 14. | Matting agent | pages 878–879 |

18. Formaldehyde scavengers: page 64, lines 54–57
19. Mercapto-based antifoggants: page 65, lines 1–2
20. Agents releasing, e.g., fogging agent: page 65, lines 3–7
21. Dyes: page 65, lines 7–10

-continued

22. General color couplers: page 65, lines 11–13
23. Yellow, magenta, and cyan couplers: page 65, lines 14–25
24. Polymer couplers: page 65, lines 26–28
25. Diffusing dye forming couplers: page 65, lines 29–31
26. Colored couplers: page 65, lines 32–38
27. Functional couplers in general: page 65, lines 39–44
28. Bleaching accelerator-releasing couplers: page 65, lines 45–48
29. Development accelerator-releasing couplers: page 65, lines 49–53
30. Other DIR couplers: page 65, line 54–page 66, line 4
31. Coupler diffusing methods: page 66, lines 5–28
32. Antiseptic mildewproofing agents: page 66, lines 29–33
33. Types of sensitized materials: page 66, lines 34–36
34. Light-sensitive layer film thickness and swelling speed: page 66, line 40–page 67, line 1
35. Back layers: page 67, lines 3–8
36. Development processing in general: page 67, lines 9–11
37. Developers and developing agents: page 67, lines 12–30
38. Developer additives: page 67, lines 31–44
39. Reversal processing: page 67, lines 45–56
40. Processing solution aperture ratio: page 67, line 57–page 68, line 12
41. Development time: page 68, lines 13–15
42. Bleach-fix, bleaching, and fixing: page 68, line 16–page 69, line 31
43. Automatic processor: page 69, lines 32–40
44. Washing, rinsing, and stabilization: page 69, line 41–page 70, line 18
45. Replenishment and reuse of processing solutions: page 70, lines 19–23
46. Incorporation of developing agent into sensitized material: page 70, lines 24–33
47. Development temperature: page 70, lines 34–38
48. Application to filin with lens: page 70, lines 39–41

It is also possible to preferably use a bleaching solution described in European Patent No. 602600 which contains 2-pyridinecarboxylic acid or 2,6-pyridinedicarboxylic acid, ferric salt such as ferric nitrate, and persulfate. When this bleaching solution is to be used, it is preferable to interpose a stop step and a washing step between the color development step and the bleaching step and use organic acid such as acetic acid, succinic acid, or maleic acid as the stop bath. Furthermore, for the purposes of pH adjustment and bleaching fog, the bleaching solution preferably contains 0.1 to 2 mols/litter (litter will be referred to as "L" hereinafter) of organic acid such as acetic acid, succinic acid, maleic acid, glutaric acid, or adipic acid.

When the silver halide photographic lightsensitive material of the present invention is preferably used in a color lightsensitive material, layers are generally arranged in the order of red-, green- and blue-sensitive unit layers from a support side. However, according to the intended use, this arrangement order may be reversed, or an arrangement order can be employed in which a different lightsensitive layer is interposed between the layers of the same color sensitivity. Nonlightsensitive layers can be formed between the silver halide lightsensitive layers and as the uppermost layer and the lowermost layer. These may contain, e.g., couplers, DIR compounds and color mixing inhibitors described later. As a plurality of silver halide emulsion layers constituting each unit light-sensitive layer, a two-layered structure of high- and low-speed emulsion layers is preferably arranged so that the sensitivity is sequentially decreased toward a support as described in DE No. 1,121,470 or GB No. 923,045, the disclosures of which are herein incorporated by reference. Also, as described in JP-A's-57-112751, 62-200350, 62-206541 and 62-206543, the disclosures of which are herein incorporated by reference, layers can be arranged so that a low-speed emulsion layer is formed on a side apart from a support while a high-speed emulsion layer is formed on a side closer to the support.

Specifically, layers can be arranged, from the farthest side from a support, in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932, the disclosure of which is herein incorporated by reference, layers can be arranged, from the farthest side from a support, in the order of blue-sensitive layer/GH/RH/GL/RL.

Furthermore, as described in JP-A-56-25738 and JP-A-62-63936, the disclosures of which are herein incorporated by reference, layers can be arranged, from the farthest side from a support, in the order of blue-sensitive layer/GL/RL/GH/RH.

As described in JP-B-49-15495, the disclosure of which is herein incorporated by reference, three layers can be arranged so that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged so that the sensitivity is sequentially decreased toward the support. Even when a layer structure is constituted by three layers having different sensitivities as mentioned above, these layers can be arranged in the order of medium-speed emulsion layer/high-speed emulsion layer/low-speed emulsion layer from the farthest side from a support in a layer sensitive to one color as described in JP-A-59-202464, the disclosure of which is herein incorporated by reference.

In addition, the order of high-speed emulsion layer/low-speed emulsion layer/medium-speed emulsion layer or low-speed emulsion layer/medium-speed emulsion layer/high-speed emulsion layer can be adopted. Furthermore, the arrangement can be changed as described above even when four or more layers are formed.

In order to improve the color reproducibility, a donor layer (CL) of an interlayer effect having a spectral sensitivity distribution different from the main lightsensitive layers BL, GL and RL as described in U.S. Pat. Nos. 4,663,271, 4,705,744, 4,707,436, JP-A-62-160448 and JP-A-63-89850, the disclosures of which are herein incorporated by reference, is preferably arranged adjacent to or close to the main lightsensitive layers.

In the photographic material of present invention, it is preferable to use a nonlightsensitive fine grain silver halide. The nonlightsensitive fine grain silver halide preferably consists of silver halide fine grains which are not sensitive during imagewise exposure for obtaining a dye image and are substantially not developed during a development step. These silver halide grains are preferably not fogged in advance. In the fine grain silver halide, the content of silver bromide is 0 to 100 mol %, and silver chloride and/or silver iodide can be contained if necessary. The fine grain silver halide preferably contains 0.5 to 10 mol % of silver iodide. The average grain size, i.e., the average value of equivalent circle diameters of projected areas, of the fine grain silver halide is preferably 0.01 to 0.5 $\mu$m, more preferably 0.02 to 0.2 $\mu$m.

The fine grain silver halide can be prepared in the same manner as that of common lightsensitive silver halide. The surface of silver halide grains need not be optically sensitized nor spectrally sensitized. However, before the addition of silver halide grains to a coating solution, it is preferable to add thereto a generally known stabilizer such as a triazole compound, an azaindene compound, a benzothiazolium compound, a mercapto compound, or a zinc compound. Colloidal silver can be incorporated in this fine grain silver halide containing layer.

The silver coating amount of the lightsensitive material of the present invention is preferably 10.0 g/m$^2$ or less, most preferably 6.0 g/m$^2$ or less.

Various dye forming couplers can be used in the lightsensitive material of the present invention, and the following couplers are particularly preferable.

Yellow couplers: couplers represented by formulas (I) and (II) in EP No. 502,424A; couplers represented by formulas (1) and (2) in EP No. 513,496A (particularly Y-28 on page 18); a coupler represented by formula (I) in claim 1 of EP No. 568,037A; a coupler represented by general formula (I) in column 1, lines 45 to 55, in U.S. Pat. No. 5,066,576; a coupler represented by general formula (I) in paragraph 0008 of JP-A-4-274425; couplers described in claim 1 on page 40 in EP No. 498,381A1 (particularly D-35 on page 18);

couplers represented by formula (Y) on page 4 in EP No. 447,969A1 (particularly Y-1 (page 17) and Y-54 (page 41)); and couplers represented by formulas (II) to (IV) in column 7, lines 36 to 58, in U.S. Pat. No.

No. B4,476,219 (particularly II-17, II-19 (column 17), and II-24 (column 19)), all the disclosures of which are herein incorporated by reference.

Magenta couplers: JP-A-3-39737 (L-57 (page 11, lower right column), L-68 (page 12, lower right column), and L-77 (page 13, lower right column); [A-4]-63 (page 134), and [A-4]-73 and [A-4]-75 (page 139) in EP No. 456,257; M-4 and M-6 (page 26), and M-7 (page 27) in EP No. 486,965; M-45 (page 19) in EP No. 571,959A; (M-1) (page 6) in JP-A-5-204106; and M-22 in paragraph 0237 of JP-A-4-362631, all the disclosures of which are herein incorporated by reference.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by general formulas (Ia) and (Ib) in claim 1 of JP-A-6-67385, all the disclosures of which are herein incorporated by reference.

Polymer couplers: P-1 and P-5 (page 11) in JP-A-2-44345, the disclosure of which is herein incorporated by reference.

Couplers for forming a colored dye with a proper diffusibility are preferably those described in U.S. Pat. No. 4,366,237, GB No. 2,125,570, EP No. 96,873B, and DE No. 3,234,533, all the disclosures of which are herein incorporated by reference.

Couplers for correcting the unnecessary absorption of a colored dye are preferably yellow colored cyan couplers represented by formulas (CI), (CII), (CIII), and (CIV) described on page 5 in EP No. 456,257A1 (particularly YC-86 on page 84); yellow colored magenta couplers ExM-7 (page 202), Ex-1 (page 249), and EX-7 (page 251)

described in EP No. 456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers represented by formula (A) in claim 1 of WO No. 92/11575 (particularly compound examples on pages 36 to 45), all the disclosures of which are herein incorporated by reference.

Examples of compounds (including a coupler) which react with a developing agent in an oxidized for to thereby release a photographically useful compound residue are as follows and all the disclosures of the documents are herein incorporated by reference. Development inhibitor release compounds: compounds represented by formulas (I), (II), (III), and (IV) on page 11 of EP No. 378,236A1 (particularly T-101 (page 30), T-104 (page 31), T-113 (page 36), T-131 (page 45), T-144 (page 51), and T-158 (page 58)); a compound represented by formula (I) on page 7 of EP No. 436,938A2 (particularly D-49 (page 51)); a compound represented by formula (1) in EP No. 568,037A (particularly (23) (page 11)); and compounds represented by formulas (I), (II), and (III) on pages 5 and 6 of EP No. 440,195A2 (particularly I-(1) on page 29). Bleaching accelerator release compounds: compounds represented by formulas (I) and (I') on page 5 of EP No. 310,125A2 (particularly (60) and (61) on page 61); and compounds represented by formula (I) in claim 1 of JP-A-6-59411 (particularly (7) (page 7)). Ligand release compounds: compounds represented by LIG-X described in claim 1 of U.S. Pat. No. 4,555,478 (particularly compounds in column 12, lines 21 to 41). Leuco dye release compounds: compounds 1 to 6 in columns 3 to 8 of U.S. Pat. No. 4,749,641. Fluorescent dye release compounds: compounds represented by COUP-DYE in claim 1 of U.S. Pat. No. 4,774,181 (particularly compounds 1 to 11 in columns 7 to 10). Development accelerator or fogging agent release compounds: compounds represented by formulas (1), (2), and (3) in column 3 of U.S. Pat. No. No. 4,656,123 (particularly (I-22) in column 25); and ExZK-2 on page 75, lines 36 to 38, in EP No. 450,637A2. Compounds which release a group which does not function as a dye unless it splits off: compounds represented by formula (I) in claim 1 of U.S. Pat. No. 4,857,447 (particularly Y-1 to Y-19 in columns 25 to 36).

Preferable examples of additives other than couplers are as follows and all the disclosures of the following documents are herein incorporated by reference.

Dispersion mediums of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272. Impregnating latexes of an oil-soluble organic compound: latexes described in U.S. Pat. No. 4,199,363. Developing agent oxidation product scavengers: compounds represented by formula (I) in column 2, lines 54 to 62, in U.S. Pat. No. No. 4,978,606 (particularly I-(1), I-(2), I-(6), and I-(12) (columns 4 and 5)), and formulas in column 2, lines 5 to 10, in U.S. Pat. No. 4,923,787 (particularly compound 1 (column 3)). Stain inhibitors: formulas (I) to (III) on page 4, lines 30 to 33, particularly I-47, I-72, III-1, and III-27 (pages 24 to 48) in EP No. 298321A. Discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP No. 298,321A; II-1 to III-23, particularly III-10, in columns 25 to 38 of U.S. Pat. No. 5,122,444; I-1 to III-4, particularly II-2, on pages 8 to 12 in EP No. 471,347A; and A-1 to A-48, particularly A-39 and A-42, in columns 32 to 40 of U.S. Pat. No. 5,139,931. Materials which reduce the use amount of a color enhancer or a color amalgamation inhibitor: I-1 to II-15, particularly I-46, on pages 5 to 24 in EP No. 411,324A. Formalin scavengers: SCV-1 to SCV-28, particularly SCV-8, on pages 24 to 29 in EP No. 477,932A. Film hardeners: H-1, H-4, H-6, H-8, and H-14 on page 17 in JP-A-1-214845; compounds (H-1 to H-54) represented by formulas (VII) to (XII) in columns 13 to 23 of U.S. Pat. No. 4,618,573;, compounds (H-1 to H-76), particularly H-14, represented by formula (6) on page 8, lower right column, in JP-A-2-214852; and compounds described in claim 1 of U.S. Pat. No. 3,325,287. Development inhibitor precursors: P-24, P-37, and P-39 (pages 6 and 7) in JP-A-62-168139; and compounds described in claim 1, particularly 28 and 29 in column 7, of U.S. Pat. No. 5,019,492. Antiseptic agents and mildewproofing agents; I-1 to III-43, particularly II-1, II-9, II-10, II-18, and III-25, in columns 3 to 15 of U.S. Pat. No. 4,923,790. Stabilizers and antifoggants: I-1 to (14), particularly I-1, I-60, (2), and (13), in columns 6 to 16 of U.S. Pat. No. 4,923,793; and compounds 1 to 65, particularly compound 36, in columns 25 to 32 of U.S. Pat. No. 4,952,483. Chemical sensitizers: triphenylphosphine, selenide, and compound 50 in JP-A-5-40324. Dyes: a-1 to b-20, particularly a-1, a-12, a-18, a-27, a-35, a-36, and b-5, on pages 15 to 18 and V-1 to V-23, particularly V-1, on pages 27 to 29 in JP-A-3-156450; F-I-1 to F-II-43, particularly F-I-11 and F-II-8, on pages 33 to 55 in EP No. 445,627A; III-1 to III-36, particularly III-1 and III-3, on pages 17 to 28 in EP No. 457,153A; microcrystalline dispersions of Dye-1 to Dye-124 on pages 8 to 26 in WO No. 88/04794; compounds 1 to 22, particularly compound 1, on pages 6 to 11 in EP No. 319,999A; compounds D-1 to D-87 (pages 3 to 28) represented by formulas (1) to (3) in EP No. 519,306A; compounds 1 to 22 (columns 3 to 10) represented by formula (I) in U.S. Pat. No. 4,268,622; and compounds (1) to (31) (columns 2 to 9) represented by formula (I) in U.S. Pat. No. 4,923,788. UV absorbents: compounds (18b) to (18r) and 101 to 427 (pages 6 to 9) represented by formula (1) in JP-A-46-3335; compounds (3) to (66) (pages 10 to 44) represented by formula (I) and compounds HBT-1 to HBT-10 (page 14) represented by formula (III) in EP No. 520,938A; and compounds (1) to (31) (columns 2 to 9) represented by formula (1) in EP No. 521,823A.

The photographic material of the present invention can be applied to various color lightsensitive materials such as color negative films for general purposes or cinemas, color reversal films for slides and TV, color paper, color positive films and color reversal paper. Moreover, the photographic material of the present invention is suitable to lens equipped film units described in JP-B-2-32615 and Jpn. Utility Model Appln. KOKOKU Publication No. 3-39784.

Supports which can be suitably used in the present invention are described in, e.g., RD. No. 17643, page 28; RD. No. 18716, from the right column of page 647 to the left column of page 648; and RD. No. 307105, page 879.

In the lightsensitive material of the present invention, the total of film thicknesses of all hydrophilic colloid layers on the side having emulsion layers is preferably 28 $\mu$m or less, more preferably 23 $\mu$m or less, still more preferably 18 $\mu$m or less, and most preferably 16 $\mu$m or less. Film swelling speed $T_{1/2}$ is preferably 30 sec or less, more preferably 20 sec or less. The film swelling speed $T_{1/2}$ is defined as the time that, when the saturation film thickness means 90% of the maximum swollen film thickness realized by the processing in a color developing solution at 30° C. for 3 min 15 sec, spent for the film thickness to reach ½ of the saturation film thickness. The film thickness means one measured under moisture conditioning at 25° C. and at a relative humidity of 55% (two days). The film swelling speed $T_{1/2}$ can be measured by using a swellometer described in A. Green et al., Photogr. Sci. Eng., Vol. 19, No. 2, pp. 124 to 129. The film swelling speed $T_{1/2}$ can be regulated by adding a film hardening agent to gelatin as a binder or by changing aging conditions after coating.

The swelling ratio preferably ranges from 150 to 400%.

The swelling ratio can be calculated from the maximum swollen film thickness measured under the above conditions in accordance with the formula:

(maximum swollen film thickness−film thickness)/film thickness.

In the lightsensitive material of the present invention, hydrophilic colloid layers (called "back layers") having a total dried film thickness of 2 to 20 μm are preferably formed on the side opposite to the side having emulsion layers. The back layers preferably contain the above light absorbent, filter dye, ultraviolet absorbent, antistatic agent, film hardener, binder, plasticizer, lubricant, coating aid and surfactant. The swelling ratio of the back layers is preferably 150% to 500%.

The lightsensitive material according to the present invention can be developed by conventional methods described in above mentioned RD. No. 17643, pp. 28 and 29; RD. No. 18716, page 651, left to right columns; and RD No. 307105, pp. 880 and 881.

The color negative film processing solution for use in the present invention will be described below.

The compounds listed in page 9, right upper column, line 1 to page 11, left lower column, line 4 of JP-A-4-121739 can be used in the color developing solution for use in the present invention. Preferred color developing agents for use in especially rapid processing are, for example, 2-methyl-4-[N-ethyl—N-(2-hydroxyethyl)amino]aniline, 2-methyl-4-[N-ethyl—N-(3-hydroxypropyl)amino]aniline and 2-methyl-4-[N-ethyl—N-(4-hydroxybutyl)amino]aniline.

These color developing agents are preferably used in an amount of 0.01 to 0.08 mol, more preferably 0.015 to 0.06 mol, and most preferably 0.02 to 0.05 mol, per liter of the color developing solution. The replenisher of the color developing solution preferably contains the color developing agent in an amount corresponding to 1.1 to 3 times the above concentration, more preferably 1.3 to 2.5 times the above concentration.

Hydroxylamine can widely be used as preservatives of the color developing solution. When enhanced preserving properties are required, it is preferred to use hydroxylamine derivatives having substituents such as alkyl, hydroxyalkyl, sulfoalkyl and carboxyalkyl groups, examples of which include N,N-di(sulfoehtyl)hydroxylamine, monomethylhydroxylamine, dimethylhydroxylamine, monoethylhydroxylamine, diethylhydroxylamine and N,N-di(carboxyethyl)hydroxylamine. Of these, N,N-di(sulfoehtyl)hydroxylamine is most preferred. Although these may be used in combination with the hydroxylamine, it is preferred that one or at least two members thereof be used in place of the hydroxylamine.

These preservatives are preferably used in an amount of 0.02 to 0.2 mol, more preferably 0.03 to 0.15 mol, and most preferably 0.04 to 0.1 mol per liter of the color developing solution. The replenisher of the color developing solution preferably contains the preservative in an amount corresponding to 1.1 to 3 times the concentration of the mother liquor (processing tank solution) as in the color developing agent.

Sulfurous salts are used as tarring preventives for the color developing agent in an oxidized form in the color developing solution. Each sulfurous salt is preferably used in the color developing solution in an amount of 0.01 to 0.05 mol, more preferably 0.02 to 0.04 mol per liter, and is preferably used in the replenisher in an amount corresponding to 1.1 to 3 times the above concentration.

The pH value of the color developing solution preferably ranges from 9.8 to 11.0, more preferably from 10.0 to 10.5. That of the replenisher is preferably set at 0.1 to 1.0 higher than the above value. Common buffers such as carbonic salts, phosphoric salts, sulfosalicylic salts and boric salts are used for stabilizing the above pH value.

Although the amount of the replenisher of the color developing solution preferably ranges from 80 to 1300 milliliters (hereinafter also referred to as "mL") per $m^2$ of the lightsensitive material, it is desired that the amount be smaller from the viewpoint of reducing environmental pollution load. Specifically, the amount of the replenisher more preferably ranges from 80 to 600 mL, most preferably from 80 to 400 mL.

Although the bromide ion concentration of the color developing solution generally ranges from 0.01 to 0.06 mol per liter, it is preferred that the above concentration be set at 0.015 to 0.03 mol per liter for inhibiting fog while maintaining sensitivity to thereby improve discrimination and for bettering graininess. When the bromide ion concentration is set so as to fall within the above range, the replenisher preferably contains bromide ion in a concentration as calculated by the following formula. However, when C is negative, it is preferred that no bromide ion be contained in the replenisher.

$$C=A-W/V$$

Wherein

C: bromide ion concentration of the color developing replenisher (mol/L),

A: target bromide ion concentration of the color developing solution (mol/L),

W: amount of bromide ion leached from the lightsensitive material into the color developing solution when a color development of 1 $m^2$ of the lightsensitive material has been carried out (mol), and V: amount of color developing replenisher supplied per $m^2$ of the lightsensitive material (L).

Development accelerators such as pyrazolidones represented by 1-phenyl-3-pyrazolidone and 1-phenyl-2-methyl-2-hydroxymethyl-3-pyrazolidone and thioether compounds represented by 3,6-dithia-1,8-octanediol are preferably used for means for enhancing sensitivity when the amount of the replenisher has been reduced or when a high bromide ion concentration has been set.

Compounds and processing conditions described on page 4, left lower column, line 16 to page 7, left lower column, line 6 of JP-A-4-125558 can be applied to the processing solution having bleaching capability for use in the present invention. Bleaching agents having redox potentials of at least 150 mV are preferably used. Specifically, suitable examples thereof are those described in JP-A's-5-72694 and 5-173312, and especially suitable examples thereof are 1,3-diaminopropanetetraacetic acid and ferric complex salts of Example 1 compounds listed on page 7 of JP-A-5-173312.

For improving the biodegradability of the bleaching agent, it is preferred that ferric complex salts of compounds listed in JP-A-4-251845, JP-A-4-268552, EP No. 588,289, EP No. 591,934 and JP-A-6-208213 be used as the bleaching agent. The concentration of the above bleaching agent preferably ranges from 0.05 to 0.3 mol per liter of the solution having bleaching capability, and it is especially preferred that a design be made at 0.1 to 0.15 mol per liter for reducing the discharge to the environment. When the solution having bleaching capability is a bleaching solution, a bromide is preferably incorporated therein in an amount of 0.2 to 1 mol, more preferably 0.3 to 0.8 mol per liter.

Each component is incorporated in the replenisher of the solution having bleaching capability fundamentally in a concentration calculated by the following formula. This enables holding the concentration of the mother liquor constant.

$$CR=CT\times(V1+V2)/V1+CP$$

wherein

CR: concentration of each component in the replenisher,

CT: concentration of the component in the mother liquor (processing tank solution), CP: component concentration consumed during processing, V1; amount of replenisher having bleaching capability supplied per $m^2$ of lightsensitive material (mL), and V2: amount carried from previous bath by 1 $m^2$ of lightsensitive material (mL).

In addition, a pH buffer is preferably incorporated in the bleaching solution, and it is especially preferred to incorporate a dicarboxylic acid of low order such as succinic acid, maleic acid, malonic acid, glutaric acid or adipic acid. It is also preferred to use common bleaching accelerators listed in JP-A-53-95630, RD No. 17129 and U.S. Pat. No. 3,893,858.

The bleaching solution is preferably replenished with 50 to 1000 mL, more preferably 80 to 500 mL, and most preferably 100 to 300 mL, of a bleaching replenisher per $m^2$ of the lightsensitive material. Further, the bleaching solution is preferably aerated.

Compounds and processing conditions described on page 7, left lower column, line 10 to page 8, right lower column, line 19 of JP-A-4-125558 can be applied to a processing solution having fixing capability.

For enhancing the fixing velocity and preservability, it is especially preferred to incorporate compounds represented by the general formulae (I) and (II) of JP-A-6-301169 either individually or in combination in the processing solution having fixing capability. Further, the use of p-toluenesulfinic salts and sulfinic acids listed in JP-A-1-224762 is preferred from the viewpoint of enhancing the preservability. Although the incorporation of an ammonium as a cation in the solution having bleaching capability or solution having fixing capability is preferred from the viewpoint of enhancing the bleach ability, it is preferred that the amount of ammonium be reduced or brought to nil from the viewpoint of minimizing environmental pollution.

Conducting jet agitation described in JP-A-1-309059 is especially preferred in the bleach, bleach-fix and fixation steps.

The amount of replenisher supplied in the bleach-fix or fixation step is in the range of 100 to 1000 mL, preferably 150 to 700 mL, and more preferably 200 to 600 mL, per $m^2$ of the lightsensitive material.

Silver is preferably recovered by installing any of various silver recovering devices in an in-line or off-line mode in the bleach-fix or fixation step. In-line installation enables processing with the silver concentration of the solution lowered, so that the amount of replenisher can be reduced. It is also suitable to conduct an off-line silver recovery and recycle residual solution for use as a replenisher.

The bleach-fix and fixation steps can each be constructed by a plurality of processing tanks. Preferably, the tanks are provided with cascade piping and a multistage counterflow system is adopted. A 2-tank cascade structure is generally effective from the viewpoint of a balance with the size of the developing machine. The ratio of processing time in the former-stage tank to that in the latter-stage tank is preferably in the range of 0.5:1 to 1:0.5, more preferably 0.8:1 to 1:0.8.

From the viewpoint of enhancing the preservability, it is preferred that a chelating agent which is free without forming any metal complex be present in the bleach-fix and fixing solutions. Biodegradable chelating agents described in connection with the bleaching solution are preferably used as such a chelating agent.

Descriptions made on page 12, right lower column, line 6 to page 13, right lower column, line 16 of JP-A-4-125558 mentioned above can preferably be applied to water washing and stabilization steps. In particular, with respect to stabilizing solutions, the use of azolylmethylamines described in EP Nos. 504,609 and 519,190 and N-methylolazoles described in JP-A-4-362943 in place of formaldehyde and the dimerization of magenta coupler into a surfactant solution not containing an image stabilizer such as formaldehyde are preferred from the viewpoint of protecting working environment. Further, stabilizing solutions described in JP-A-6-289559 can preferably be used for reducing the adhesion of refuse to a magnetic recording layer applied to the lightsensitive material.

The replenishing amount of water washing and stabilizing solutions is preferably in the range of 80 to 1000 mL, more preferably 100 to 500 mL, and most preferably 150 to 300 mL, per $m^2$ of the lightsensitive material from the viewpoint that water washing and stabilizing functions are ensured and that the amount of waste solution is reduced to contribute to environment protection. In the processing with the above replenishing amount, known mildewproofing agents such as thiabenzazole, 1,2-benzoisothiazolin-3-one and 5-chloro-2-methylisothiazolin-3-one, antibiotics such as gentamicin and water deionized by the use of, for example, an ion exchange resin are preferably used for preventing the breeding of bacteria and mildew. The use of deionized water, a mildewproofing agent and an antibiotic in combination is more effective than individual uses.

With respect to the solution placed in the water washing or stabilizing solution tank, it is also preferred that the replenishing amount be reduced by conducting a reverse osmosis membrane treatment as described in JP-A's-3-46652, 3-53246, 3-55542, 3-121448 and 3-126030. A low-pressure reverse osmosis membrane is preferably used in the above treatment.

In the processing of the present invention, it is especially preferred that an evaporation correction of processing solution be carried out as disclosed in JIII (Japan Institute of Invention and Innovation) Journal of Technical Disclosure No. 94-4992. In particular, the method in which a correction is effected with the use of information on the temperature and humidity of developing machine installation environment in accordance with Formula 1 on page 2 thereof is preferred. Water for use in the evaporation correction is preferably harvested from the washing replenishing tank. In that instance, deionized water is preferably used as the washing replenishing water.

Processing agents set forth on page 3, right column, line 15 to page 4, left column, line 32 of the above journal of technical disclosure are preferably used in the present invention. Film processor described on page 3, right column, lines 22 to 28 thereof is preferably used as the developing machine in the processing of the present invention.

Specific examples of processing agents, automatic developing machines and evaporation correction schemes preferably employed in carrying out the present invention are described on page 5, right column, line 11 to page 7, right column, last line of the above journal of technical disclosure.

The processing agent used for the photographic material of the present invention may be supplied in any form, for example, a liquid agent with the same concentration as in use or concentrated one, granules, powder, tablets, a paste or an emulsion. For example, a liquid agent stored in a container of low oxygen permeability is disclosed in JP-A-63-17453, vacuum packed powder or granules in JP-A's-4-19655 and 4-230748, granules containing a water soluble polymer in JP-A-4-221951, tablets in JP-A's-51-61837 and 6-102628 and a paste processing agent in PCT National Publication 57-500485. Although any of these can be suitably used, from the viewpoint of easiness in use, it is preferred to employ a liquid prepared in the same concentration as in use in advance.

The container for storing the above processing agent is composed of, for example, any one or a mixture of polyethylene, polypropylene, polyvinyl chloride, polyethylene terephthalate and nylon. A selection is made in accordance with the required level of oxygen permeability. A material of low oxygen permeability is preferably used for storing an easily oxidized liquid such as a color developing solution, which is, for example, polyethylene terephthalate or a composite material of polyethylene and nylon. It is preferred that each of these materials be used in the container at a thickness of 500 to 1500 $\mu$m so that the oxygen permeability therethrough is 20 mL/m$^2$.24 hrs.atm or less.

The processing solution for the color reversal film to which the present invention is applicable will be described below.

With respect to the processing of color reversal films, detailed descriptions are made in Public Technology No. 6 (Apr. 1, 1991) issued by Aztek, page 1, line 5 to page 10, line 5 and page 15, line 8 to page 24, line 2, any of which can be preferably applied thereto. In the color reversal film processing, an image stabilizer is added to a conditioning bath or a final bath. Examples of suitable image stabilizers include formalin, formaldehyde sodium bisulfite and N-methylolazoles. Formaldehyde sodium bisulfite and N-methylolazoles are preferred from the viewpoint of working environment. Among the N-methylolazoles, N-methyloltriazole is especially preferred. The contents of descriptions on color developing solution, bleaching solution, fixing solution and washing water made in connection with the processing of color negative films are also preferably applicable to the processing of color reversal films.

Processing agent E-6 available from Eastman Kodak and processing agent CR-56 available from Fuji Photo Film Co., Ltd. can be mentioned as preferred color reversal film processing agents including the above feature.

The color photographic lightsensitive material to which the present invention has been applied is suitably used as a negative film for Advanced Photo System (hereinafter referred to as "AP system"). It is, for example, one obtained by working the film into AP system format and accommodating the same in a special purpose cartridge, such as NEXIA A, NEXIA F or NEXIA H (sequentially, ISO 200/100/400) produced by Fuji Photo Film Co., Ltd. (hereinafter referred to as "Fuji Film"). This cartridge film for AP system is charged in a camera for AP system such as Epion series, e.g., Epion 300Z, produced by Fuji Film and put to practical use. Moreover, the color photographic lightsensitive material of the present invention is suitable to a lens equipped film, such as Fuji Color Uturundesu Super Slim produced by Fuji Film.

The thus photographed film is printed through the following steps in a minilabo system:

(1) acceptance (receiving an exposed cartridge film from a customer),
(2) detaching (transferring the film from the above cartridge to an intermediate cartridge for development),
(3) film development,
(4) rear touching (returning the developed negative film to the original cartridge),
(5) printing (continuous automatic printing of C/H/P three type print and index print on color paper (preferably, Super FA8 produced by Fuji Film)), and
(6) collation and delivery (collating the cartridge and index print with ID number and delivering the same with prints).

The above system is preferably Fuji Film Minilao Champion Super FA-298/FA-278/FA-258/FA-238 or Fuji Film Digital Labo System Frontier. Film processor of the Minilabo Champion is, for example, FP922AL/FP562B/FP562B, AL/FP362B/FP3622B, AL, and recommended processing chemical is Fuji Color Just It CN-16L or CN-16Q. Printer processor is, for example, PP3008AR/PP3008A/PP1828AR/PP1828A/PP1258AR/PP1258A/PP72 8AR/PP728A, and recommended processing chemical thereof is Fuji Color Just It CP-47L or CP-40FAII. In the Frontier System, use is made of scanner & image processor SP-1000 and laser printer & paper processor LP-1000P or Laser Printer LP-1000W. Fuji Film DT200/DT100 and AT200/AT100 are preferably used as detacher in the detaching step and as rear toucher in the rear touching step, respectively.

The AP system can be enjoyed by photo joy system whose center unit is Fuji Film digital image work station Aladdin 1000. For example, developed AP system cartridge film is directly charged in Aladdin 1000, or negative film, positive film or print image information is inputted with the use of 35 mm film scanner FE-550 or flat head scanner PE-550 therein, and obtained digital image data can easily be worked and edited. The resultant data can be outputted as prints by current labo equipment, for example, by means of digital color printer NC-550AL based on photofixing type thermal color printing system or Pictrography 3000 based on laser exposure thermal development transfer system or through a film recorder. Moreover, Aladdin 1000 is capable of directly outputting digital information to a floppy disk or Zip disk or outputting it through a CD writer to CD-R.

On the other hand, at home, photography can be enjoyed on TV only by charging the developed AP system cartridge film in photoplayer AP-1 manufactured by Fuji Film. Charging it in Photoscanner AS-1 manufactured by Fuji Film enables continuously feeding image information into a personal computer at a high speed. Further, Photovision FV-10/FV-5 manufactured by Fuji Film can be utilized for inputting a film, print or three-dimensional object in the personal computer. Still further, image information recorded on a floppy disk, zip disk, CD-R or a hard disk can be enjoyed by conducting various workings on the personal computer by the use of Fuji Film Application Soft Photofactory. Digital color printer NC-2/NC-2D based on photofixing type thermal color printing system, manufactured by Fuji Film, is suitable for outputting high-quality prints from the personal computer.

Fuji Color Pocket Album AP-5 Pop L, AP-1 Pop L or AP-1 Pop KG or Cartridge File 16 is preferably employed for storing the developed AP system cartridge film.

Examples of the present invention will be described below. However, the present invention is not restricted to these examples.

EXAMPLE 1

Gelatin-1 to gelatin-4 used as dispersion media in emulsion preparations described below have the following attributes.

Gelatin-1: Common alkali-processed ossein gelatin made from beef bones. No —$NH_2$ groups in the gelatin were chemically modified.

Gelatin-2: Gelatin formed by adding phthalic anhydride to an aqueous solution of gelatin-1 at 50° C. and pH 9.0 to cause chemical reaction, removing the residual phthalic acid, and drying the resultant material. The ratio of the number of chemically modified —$NH_2$ groups in the gelatin was 95%.

Gelatin-3: Gelatin formed by adding trimellitic anhydride to an aqueous solution of gelatin-1 at 50C and pH 9.0 to cause chemical reaction, removing the residual trimellitic acid, and drying the resultant material. The ratio of the number of chemically modified —$NH_2$ groups in the gelatin was 95%.

Gelatin-4; Gelatin formed by decreasing the molecular weight of gelatin-1 by allowing enzyme to act on it such that the average molecular weight was 15,000, deactivating the enzyme, and drying the resultant material. No —$NH_2$ groups in the gelatin were chemically modified.

All of gelatin-1 to gelatin-4 described above were deionized and so adjusted that the pH of an aqueous 5% solution at 35° C. was 6.0.

Preparation of Emulsion A-1)

1,300 mL of an aqueous solution containing 1.0 g of Br and 1.1 g of gelatin-4 described above was stirred at 35° C. (1st solution preparation). 38 mL of an aqueous solution Ag-1 (containing 4.9 g of $AgNO_3$ in 100 mL), 29 mL of an aqueous solution X-1 (containing 5.2 g of KBr in 100 mL), and 8.5 mL of an aqueous solution G-1 (containing 8.0 g of gelatin-4 described above in 100 mL) were added over 30 sec at fixed flow rates by the triple jet method (addition 1). After that, 6.5 g of KBr were added, and the temperature was raised to 75° C. After a ripening step was performed for 12 min, 300 mL of an aqueous solution G-2 (containing 12.7 g of gelatin-1 described above in 100 mL) were added. When reduction sensitization was to be performed, 2.1 g of 4,5-dihydroxy-1,3-disodium disulfonate-hydrate and 0.002 g of thiourea dioxide were sequentially added at an interval of 1 min. Whether reduction sensitization was performed was described in a table of the example is to be set forth below.

Next, 157 mL of an aqueous solution Ag-2 (containing 22.1 g of $AgNO_3$ in 100 mL) and an aqueous solution X-2 (containing 15.5 g of KBr in 100 mL) were added over 39.2 min by the double jet method. The flow rate of the aqueous solution Ag-2 during the addition was accelerated such that the final flow rate was 3.4 times the initial flow rate. Also, the aqueous solution X-2 was so added that the pAg of the bulk emulsion solution in the reaction vessel was held at 6.80 (addition 2). Subsequently, 329 mL of an aqueous solution Ag-3 (containing 32.0 g of $AgNO_3$ in 100 mL) and an aqueous solution X-3 (containing 21.5 g of KBr and 1.2 g of KI in 100 mL) were added over 74.2 min by the double jet method. The flow rate of the aqueous solution Ag-3 during the addition was accelerated such that the final flow rate was 1.6 times the initial flow rate. Also, the aqueous solution X-3 was so added that the pAg of the bulk emulsion solution in the reaction vessel was held at 6.80 (addition 3). Furthermore, 156 mL of an aqueous solution Ag-4 (containing 32.0 g of $AgNO_3$ in 100 mL) and an aqueous solution X-4 (containing 22.4 g of KBr in 100 mL) were added over 17 min by the double jet method. The addition of the aqueous solution Ag-4 was performed at a fixed flow rate. The addition of the aqueous solution X-4 was so performed that the pAg of the bulk emulsion solution in the reaction vessel was held at 7.52 (addition 4).

After that, 0.0025 g of sodium benzenethiosulfonate and 125 mL of an aqueous solution G-3 (containing 12.0 g of gelatin-1 described above in 100 mL) were sequentially added at an interval of 1 min. 43.7 g of KBr were then added to adjust the pAg of the bulk emulsion solution in the reaction vessel to 9.00. 73.9 g of an AgI fine grain emulsion (containing 13.0 g of AgI fine grains having an average grain size of 0.047 $\mu$m in 100 g) were added. Two minutes after that, 249 mL of the aqueous solution Ag-4 and the aqueous solution X-4 were added by the double jet method. The addition of the aqueous solution Ag-4 was performed at a fixed flow rate over 9 min. The addition of the aqueous solution X-4 was performed only for the first 3.3 min such that the pAg of the bulk emulsion solution in the reaction vessel was held at 9.00. For the remaining 5.7 min the aqueous solution X-4 was not added so that the pAg of the bulk emulsion solution in the reaction vessel was finally 8.4 (addition 5). After that, desalting was performed by normal flocculation. Water, NaOH, and gelatin-1 described above were added under stirring, and the pH and the pAg were adjusted to 6.4 and 8.6, respectively, at 56° C.

The resultant emulsion consisted of tabular silver halide grains having an equivalent-sphere diameter of 0.99 $\mu$m and a grain volume weighted mean of aspect ratios of 1.5. Silver halide grains having an aspect ratio of 2 or less accounted for 50% or more of the total projected area. The average value of AgI contents of the tabular grains was 3.94 mol %, and their parallel major faces were (111) faces. An AgI content on the surface of a silver halide grain measured by XPS was 2.0 mol %.

Subsequently, compounds of formulas (1) to (3) of the present invention (whether these compounds were added or not is described in the table of the example to be set forth below), a sensitizing dye ExS-1 presented below, potassium thiocyanate, chloroauric acid, sodium thiosulfate, and N,N-dimethylselenourea were sequentially added to optimally perform chemical sensitization. After that, the chemical sensitization was completed by adding water-soluble mercapto compounds MER-1 and MER-2 presented below at a ratio of 4:1 such that the total amount was $3.6\times10^{-4}$ mol per mol of a silver halide. This emulsion A-1 was optimally chemically sensitized when the addition amount of ExS-1 was $3.21\times10^{-4}$ mol per mol of a silver halide.

ExS-1

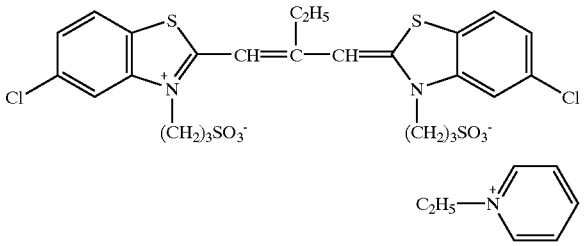

-continued

MER-1

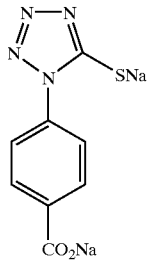

MER-2

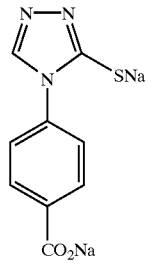

(Preparation of Emulsion A-2)

An emulsion A-2 was prepared by changing the preparation conditions of the emulsion A-1 as follows.

(1) The addition amount of the AgI fine grain emulsion added two minutes before (addition 5) was changed to 133.0 g.

(2) In (addition 5), the addition time of the aqueous solution Ag-4 was reduced to 8.37 min without changing the flow rate, and the addition time of the aqueous solution X-4 was reduced to 2.67 min. The resultant emulsion consisted of tabular silver halide grains having an equivalent-sphere diameter of 0.99 $\mu$m and a grain volume weighted mean of aspect ratios of 1.5. Silver halide grains having an aspect ratio of 2 or less accounted for 50% or more of the total projected area. The average value of AgI contents of the tabular grains was 5.94 mol %, and their parallel major faces were (111) faces. An AgI content on the surface of a silver halide grain measured by XPS was 5.9 mol %. Note that this emulsion A-2 was optimally chemically sensitized when the addition amount of the sensitizing dye ExS-1 was $3.21\times10^{-4}$ mol per mol of silver halide.

(Preparation of Emulsion B-1)

An emulsion B-1 was prepared by changing the preparation conditions of the emulsion A-1 as follows.

(1) In (addition 2), the addition flow rate of the aqueous solution Ag-2 was changed such that the addition time was 33.6 min with the addition amount kept at 157 mL. The flow rate was so accelerated that the final flow rate was 3.4 times the initial flow rate. Also, the aqueous solution X-2 was added such that the pAg of the bulk emulsion solution in the reaction vessel was held at 7.20.

(2) In (addition 3), the addition flow rate of the aqueous solution Ag-3 was changed such that the addition time was 63.6 min with the addition amount kept at 329 mL. The flow rate was so accelerated that the final flow rate was 1.6 times the initial flow rate. Also, the aqueous solution X-3 was added such that the pAg of the bulk emulsion solution in the reaction vessel was held at 7.20. The resultant emulsion consisted of tabular silver halide grains having an equivalent-sphere diameter of 0.99 $\mu$m and a grain volume weighted mean of aspect ratios of 2.1. Silver halide grains having an aspect ratio of 2.1 or more accounted for 50% or more of the total projected area. The average value of AgI contents of the tabular grains was 3.94 mol %, and their parallel major faces were (111) faces. An AgI content on the surface of a silver halide grain measured by XPS was 2.0 mol %. Note that this emulsion B-1 was optimally chemically sensitized when the addition amount of the sensitizing dye ExS-1 was $3.39\times10^{-4}$ mol per mol of a silver halide.

(Preparation of Emulsion B-2)

An emulsion B-2 was prepared by changing the preparation conditions of the emulsion B-1 as follows.

(1) The addition amount of the AgI fine grain emulsion added two minutes before (addition 5) was changed to 133.0 g.

(2) In (addition 5), the addition time of the aqueous solution Ag-4 was reduced to 8.37 min without changing the flow rate, and the addition time of the aqueous solution X-4 was reduced to 2.67 min. The resultant emulsion consisted of tabular silver halide grains having an equivalent-sphere diameter of 0.99 $\mu$m and a grain volume weighted mean of aspect ratios of 2.1. Silver halide grains having an aspect ratio of 3.1 or more accounted for 50% or more of the total projected area. The average value of AgI contents of the tabular grains was 5.94 mol %, and their parallel major faces were (111) faces. An AgI content on the surface of a silver halide grain measured by XPS was 6.2 mol %. Note that this emulsion B-2 was optimally chemically sensitized when the addition amount of the sensitizing dye ExS-1 was $3.39\times10^{-4}$ mol per mol of a silver halide.

(Preparation of Emulsion B-3)

An emulsion B-3 was prepared by changing the preparation conditions of the emulsion B-1 as follows.

(1) In (addition 2), the addition flow rate of the aqueous solution Ag-2 was changed such that the addition time was 28 min with the addition amount kept at 157 mL. The flow rate was so accelerated that the final flow rate was 3.4 times the initial flow rate. Also, the aqueous solution X-2 was added such that the pAg of the bulk emulsion solution in the reaction vessel was held at 7.52.

(2) In (addition 3), the addition flow rate of the aqueous solution Ag-3 was changed such that the addition time was 53 min with the addition amount kept at 329 mL. The flow rate was so accelerated that the final flow rate was 1.6 times the initial flow rate. Also, the aqueous solution X-3 was added such that the pAg of the bulk emulsion solution in the reaction vessel was held at 7.52. The resultant emulsion consisted of tabular silver halide grains having an equivalent-sphere diameter of 0.99 $\mu$m and a grain volume weighted mean of aspect ratios of 3.1. Silver halide grains having an aspect ratio of 3.1 or more accounted for 50% or more of the total projected area. The average value of AgI contents of the tabular grains was 3.94 mol %, and their parallel major faces were (111) faces. An AgI content on the surface of a silver halide grain measured by XPS was 2.1 mol %. Note that this emulsion B-3 was optimally chemically sensitized when the addition amount of the sensitizing dye ExS-1 was $3.66\times10^{-4}$ mol per mol of a silver halide.

(Preparation Emulsion B-4)

An emulsion B-4 was prepared by changing the preparation conditions of the emulsion B-3 as follows.

(1) The addition amount of the AgI fine grain emulsion added two minutes before (addition 5) was changed to 133.0 g.

(2) In (addition 5), the addition time of the aqueous solution Ag-4 was reduced to 8.37 min without changing the flow rate, and the addition time of the aqueous solution X-4 was reduced to 2.67 min. The resultant emulsion consisted of tabular silver halide grains having an equivalent-sphere diameter of 0.99 a m and a grain volume weighted mean of aspect ratios of 3.1. Silver halide grains having an aspect ratio of 3.1 or more accounted for 50% or more of the total projected area. The average value of AgI contents of the tabular grains was 5.94 mol %, and their parallel major faces were (111) faces. An AgI content on the surface of a silver halide grain measured by XPS was 6.7 mol %. Note that this emulsion B-4 was optimally chemically sensitized when the addition amount of the sensitizing dye ExS-1 was $3.66\times10^{-4}$ mol per mol of a silver halide.

(Preparation Emulsion B-5)

An emulsion B-5 was prepared by changing the preparation conditions of the emulsion B-1 as follows.

(1) Gelatin in the aqueous solution G-2 added after the temperature was raised to 75° C. and the ripening step was performed for 12 min, was changed from gelatin-1 to gelatin-2.

(2) In (addition 2), the addition flow rate of the aqueous solution Ag-2 was changed such that the addition time was 22.4 min with the addition amount kept at 157 mL. The flow rate was so accelerated that the final flow rate was 3.4 times the initial flow rate. Also, the aqueous solution X-2 was added such that the pAg of the bulk emulsion solution in the reaction vessel was held at 7.83.

(3) In (addition 3), the addition flow rate of the aqueous solution Ag-3 was changed such that the addition time was 42.4 min with the addition amount kept at 329 mL. The flow rate was so accelerated that the final flow rate was 1.6 times the initial flow rate.

Also, the aqueous solution X-3 was added such that the pAg of the bulk emulsion solution in the reaction vessel was held at 7.83. The resultant emulsion consisted of tabular silver halide grains having an equivalent-sphere diameter of 0.99 $\mu$m and a grain volume weighted mean of aspect ratios of 5.9. Silver halide grains having an aspect ratio of 5.9 or more accounted for 50% or more of the total projected area. The average value of AgI contents of the tabular grains was 3.94 mol %, and their parallel major faces were (111) faces. An AgI content on the surface of a silver halide grain measured by XPS was 2.4 mol %. Note that this emulsion B-5 was optimally chemically sensitized when the addition amount of the sensitizing dye ExS-1 was $4.62\times10^{-4}$ mol per mol of a silver halide.

(Preparation Emulsion B-6)

An emulsion B-6 was prepared by changing the preparation conditions of the emulsion B-5 as follows.

(1) The addition amount of the AgI fine grain emulsion added two minutes before (addition 5) was changed to 133.0 g.

(2) In (addition 5), the addition time of the aqueous solution Ag-4 was reduced to 8.37 min without changing the flow rate, and the addition time of the aqueous solution X-4 was reduced to 2.67 min. The resultant emulsion consisted of tabular silver halide grains having an equivalent-sphere diameter of 0.99 $\mu$m and a grain volume weighted mean of aspect ratios of 5.9. Silver halide grains having an aspect ratio of 5.9 or more accounted for 50% or more of the total projected area. The average value of AgI contents of the tabular grains was 5.94 mol %, and their parallel major faces were (111) faces. An AgI content on the surface of a silver halide grain measured by XPS was 7.5 mol %. Note that this emulsion B-6 was optimally chemically sensitized when the addition amount of the sensitizing dye ExS-1 was $4.62\times10^{-4}$ mol per mol of a silver halide.

(Preparation Emulsion C-1)

An emulsion C-1 was prepared by changing the preparation conditions of the emulsion A-1 as follows.

(1) Gelatin in the aqueous solution G-2 added after the temperature was raised to 75° C. and the ripening step was performed for 12 min, was changed from gelatin-1 to gelatin-3.

(2) In (addition 2), the addition flow rate of the aqueous solution Ag-2 was changed such that the addition time was 14 min with the addition amount kept at 157 mL. The flow rate was so accelerated that the final flow rate was 3.4 times the initial flow rate. Also, the aqueous solution X-2 was added such that the pAg of the bulk emulsion solution in the reaction vessel was held at 8.30.

(3) In (addition 3), the addition flow rate of the aqueous solution Ag-3 was changed such that the addition time was 27 min with the addition amount kept at 329 mL. The flow rate was so accelerated that the final flow rate was 1.6 times the initial flow rate. Also, the aqueous solution X-3 was added such that the pAg of the bulk emulsion solution in the reaction vessel was held at 8.30. The resultant emulsion consisted of tabular silver halide grains having an equivalent-sphere diameter of 0.99 $\mu$m and a grain volume weighted mean of aspect ratios of 12.5. Silver halide grains having an aspect ratio of 12.5 or more accounted for 50% or more of the total projected area. The average value of AgI contents of the tabular grains was 3.94 mol %, and their parallel major faces were (111) faces. An AgI content on the surface of a silver halide grain measured by XPS was 2.6 mol %. Note that this emulsion C-1 was optimally chemically sensitized when the addition amount of the sensitizing dye ExS-1 was $6.43\times10^{-4}$ mol per mol of a silver halide.

(Preparation Emulsion C-2)

An emulsion C-2 was prepared by changing the preparation conditions of the emulsion C-1 as follows.

(1) The addition amount of the AgI fine grain emulsion added two minutes before (addition 5) was changed to 93.7 g.

(2) In (addition 5), the addition time of the aqueous solution Ag-4 was reduced to 8.80 min without changing the flow rate, and the addition time of the aqueous solution X-4 was reduced to 3.10 min. The resultant emulsion consisted of tabular silver halide grains having an equivalent-sphere diameter of 0.99 $\mu$m and a grain volume weighted mean of aspect ratios of 12.5. Silver halide grains having an aspect ratio of 12.5 or more accounted for 50% or more of the total projected area. The average value of AgI contents of the tabular grains was 4.61 mol %, and their parallel major faces were (111) faces. An AgI content on the surface of a silver halide grain measured by XPS was 4.4 mol %. Note that this emulsion C-2 was optimally chemically sensitized when the addition amount of the sensitizing dye ExS-1 was $6.43\times10^{-4}$ mol per mol of a silver halide.

(Preparation Emulsion C-3)

An emulsion C-3 was prepared by changing the preparation conditions of the emulsion C-1 as follows.

(1) The addition amount of the AgI fine grain emulsion added two minutes before (addition 5) was changed to 113.2 g.

(2) In (addition 5), the addition time of the aqueous solution Ag-4 was reduced to 8.58 min without changing the flow rate, and the addition time of the aqueous solution X-4 was reduced to 2.88 min. The resultant emulsion consisted of tabular silver halide grains having an equivalent-sphere diameter of 0.99 μm and a grain volume weighted mean of aspect ratios of 12.5. Silver halide grains having an aspect ratio of 12.5 or more accounted for 50% or more of the total projected area. The average value of AgI contents of the tabular grains was 5.27 mol %, and their parallel major faces were (111) faces. An AgI content on the surface of a silver halide grain measured by XPS was 6.1 mol %. Note that this emulsion C-3 was optimally chemically sensitized when the addition amount of the sensitizing dye ExS-1 was $6.43\times10^{-4}$ mol per mol of a silver halide.

(Preparation Emulsion C-4)

An emulsion C-4 was prepared by changing the preparation conditions of the emulsion C-1 as follows.

(1) The addition amount of the AgI fine grain emulsion added two minutes before (addition 5) was changed to 133.0 g.

(2) In (addition 5), the addition time of the aqueous solution Ag-4 was reduced to 8.37 min without changing the flow rate, and the addition time of the aqueous solution X-4 was reduced to 2.67 min. The resultant emulsion consisted of tabular silver halide grains having an equivalent-sphere diameter of 0.99 μm and a grain volume weighted mean of aspect ratios of 12.5. Silver halide grains having an aspect ratio of 12.5 or more accounted for 50% or more of the total projected area. The average value of AgI contents of the tabular grains was 5.94 mol %, and their parallel major faces were (111) faces. An AgI content on the surface of a silver halide grain measured by XPS was 8.0 mol %. Note that this emulsion C-4 was optimally chemically sensitized when the addition amount of the sensitizing dye EXS-1 was $6.43\times10^{-4}$ mol per mol of a silver halide.

(Preparation Emulsion C-5)

An emulsion C-5 was prepared by changing the preparation conditions of the emulsion C-1 as follows.

(1) The addition amount of the AgI fine grain emulsion added two minutes before (addition 5) was changed to 167.0 g.

(2) In (addition 5), the addition time of the aqueous solution Ag-4 was reduced to 8.03 min without changing the flow rate, and the addition time of the aqueous solution X-4 was reduced to 2.32 min. The resultant emulsion consisted of tabular silver halide grains having an equivalent-sphere diameter of 0.99 μm and a grain volume weighted mean of aspect ratios of 12.5. Silver halide grains having an aspect ratio of 12.5 or more accounted for 50% or more of the total projected area. The average value of AgI contents of the tabular grains was 7.01 mol %, and their parallel major faces were (111) faces. An AgI content on the surface of a silver halide grain measured by XPS was 11.0 mol %. Note that this emulsion C-5 was optimally chemically sensitized when the addition amount of the sensitizing dye ExS-1 was $6.43\times10^{-4}$ mol per mol of a silver halide.

The emulsions A-1, A-2, B-1 to B-6, and C-1 to C-5 described above were observed at liquid nitrogen temperature by using a 400-kV transmission electron microscope. Consequently, 10 or more dislocation lines were found in the near peripheral region of every tabular grain.

Also, these emulsions A-1, A-2, B-1 to B-6, and C-1 to C-5 were red-sensitive silver halide emulsions having maximum spectral sensitivity at a wavelength of 652 nm, since in the chemical sensitization step of the aforementioned emulsion preparations the sensitizing dye ExS-1 was added to perform spectral sensitization.

A cellulose triacetate film support having an undercoat layer was coated with the emulsions A-1, A-2, B-1 to B-6, and C-1 to C-5 under coating conditions as shown in Table 1 below.

Table 1 Emulsion coating conditions (1) Emulsion layer

Emulsions . . . Various emulsions (Silver $1.63\times10^{-2}$ mol/m$^2$)

Coupler ($2.26\times10^{-3}$ mol/m$^2$)

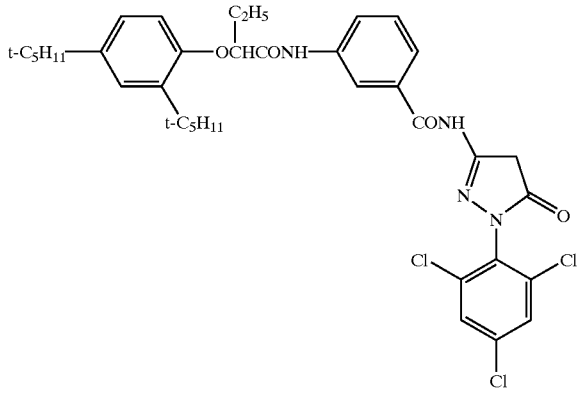

Tricresylphosphate (1.32 g/m$^2$)

Gelatin (3.24 g/m$^2$)

(2) Protective layer 2,4-dichloro-6-hydroxyl-s-triazine sodium solt (0.08 g/m$^2$)

Gelatine (1.80 g/m$^2$)

Samples 101 to 126 were formed by changing emulsions to be applied as shown in Table 2 below.

These samples were subjected to film hardening for 14 hr at 40° C. and a relative humidity of 70%. After that, the samples were exposed for 1/100 sec through a gelatin filter SC-50 (a long-wavelength light transmitting filter having a cutoff wavelength of 500 nm) manufactured by Fuji Photo Film Co., Ltd. and a continuous wedge. The densities of the samples subjected to the following development were measured through a green filter to evaluate their photographic properties.

The development was done as follows by using an automatic processor FP-362B manufactured by Fuji Photo Film Co., Ltd.

The processing steps and the processing solution compositions are presented below.

(Processing Steps)

| Step | Time | Temperature | Replenishment rate* | Tank volume |
|---|---|---|---|---|
| Color development | 3 min 5 sec | 38.0° C. | 15 mL | 10.3 L |
| Bleaching | 50 sec | 38° C. | 5 mL | 3.6 L |
| Fixing (1) | 50 sec | 38° C. | — | 3.6 L |
| Fixing (2) | 50 sec | 38° C. | 7.5 mL | 3.6 L |
| Stabilization (1) | 30 sec | 38° C. | — | 1.9 L |
| Stabilization (2) | 20 sec | 38° C. | — | 1.9 L |
| Stabilization (3) | 20 sec | 38° C. | 30 mL | 1.9 L |
| Drying | 1 min 30 sec | 60° C. | | |

The stabilizer was counterflowed in the order of (3)→(2)→(1), and the fixer was also connected from (2) to (1) by counterflow piping. Also, the tank solution of stabilizer (2) was supplied to fixer (2) in an amount of 15 mL as a replenishment rate. Additionally, as the developer a color developer (A) replenisher and a color developer (B) replenisher having the following compositions were replenished in amounts of 12 mL and 3 mL, respectively, i.e., a total of 15 mL, as a replenishment rate. Note that the amounts of the developer, bleaching solution, and fixer carried over to the bleaching step, fixing step, and washing step, respectively, were 2.0 mL per 1.1 m of a 35-mm wide sensitized material. Note also that each crossover time was 6 sec, and this time was included in the processing time of each preceding step.

The compositions of the processing solutions are presented below.

| (Color developer (A)) | [Tank solution] | [Replenisher] |
|---|---|---|
| Diethylenetriamine pentaacetic acid | 2.0 g | 4.0 g |
| Sodium 4,5-dihydroxy benzene-1,3-disulfonate | 0.4 g | 0.5 g |
| Disodium-N,N-bis(2-sulfonateethyl) hydroxylamine | 10.0 g | 15.0 g |
| Sodium sulfite | 4.0 g | 9.0 g |
| Hydroxylamine sulfate | 2.0 g | — |
| Potassium bromide | 1.4 g | — |
| Diethyleneglycol | 10.0 g | 17.0 g |
| Ethyleneurea | 3.0 g | 5.5 g |
| 2-methyl-4-[N-ethyl-N-(β-hydroxyethyl)amino] aniline sulfate | 4.7 g | 11.4 g |
| Potassium carbonate | 39 g | 59 g |
| Water to make | 1.0 L | 1.0 L |
| pH (controlled by sulfuric acid and KOH) | 10.05 | 10.50 |

The above tank solution indicates the composition after (color developer (B)) below was mixed.

| (Color developer (B)) | [Tank solution] | [Replenisher] |
|---|---|---|
| Hydroxylamine sulfate | 2.0 g | 4.0 g |
| Water to make | 1.0 L | 1.0 L |
| pH (controlled by sulfuric acid and KOH) | 10.05 | 4.0 |

The above tank solution indicates the composition after (color developer (A)) described above was mixed.

| (Bleaching solution) | [Tank solution] | [Replenisher] |
|---|---|---|
| Ferric ammonium 1,3-diaminopropanetetra acetate monohydrate | 120 g | 180 g |
| Ammonium bromide | 50 g | 70 g |
| Succinic acid | 30 g | 50 g |
| Maleic acid | 40 g | 60 g |
| Imidazole | 20 g | 30 g |
| Water to make | 1.0 L | 1.0 L |
| pH (controlled by ammonia water and nitric acid) | 4.6 | 4.0 |

| (Fixer) | [Tank solution] | [Replenisher] |
|---|---|---|
| Ammonium thiosulfate (750 g/L) | 280 mL | 1,000 mL |
| Aqueous ammonium bisulfite solution (72%) | 20 g | 80 g |
| Imidazole | 5 g | 45 g |
| 1-mercapto-2-(N,N-dimethylaminoethyl)-tetrazole | 1 g | 3 g |
| Ethylenediamine tetraacetic acid | 8 g | 12 g |
| Water to make | 1 L | 1 L |
| pH (controlled by ammonia water and nitric acid) | 7.0 | 7.0 |

| (Stabilizer) | [Common to tank solution and replenisher] |
|---|---|
| Sodium p-toluenesulfinate | 0.03 g |
| p-Nonylphenoxypolyglycidol (glycidol average polymerization degree 10) | 0.4 g |
| Disodium ethylenediaminetetraacetate | 0.05 g |
| 1,2,4-triazole | 1.3 g |
| 1,4-bis(1,2,4-triazole-1-isomethyl) piperazine | 0.75 g |
| 1,2-benzoisothiazoline-3-one | 0.10 g |
| Water to make | 1.0 L |
| pH | 8.5 |

Table 2 below shows the results of evaluations performed by the above method. The sensitivity is represented by a relative value of the reciprocal of an exposure amount necessary to reach a density of fog density plus 0.2, assuming the sensitivity of the sample 101 is 100.

TABLE 2

| | Emulsions used in sample preparation | | | | | | Compounds added to emulsions | | Photographic properties | | |
|---|---|---|---|---|---|---|---|---|---|---|---|
| Sample No. | Emulsion No. | Aspect ratio | Sensitizing dye addition amount (mol/mol of silver) | AgI content (mol %) on emulsion surface | Presence/absence of 10 or more dislocation lines per grain | Reduction sensitization | Compound No. | Addition amount (mol/mol of silver) | Sensitivity *1) | Fog density | Remarks |
| No. 101 | A-1 | 1.5 | $3.21 \times 10^{-4}$ | 2.0 | Present | Not performed | None | — | 100 | 0.25 | Comparative example |
| No. 102 | A-1 | 1.5 | $3.21 \times 10^{-4}$ | 2.0 | Present | Not performed | Compound I-1 | $3.21 \times 10^{-5}$ | 103 | 0.26 | Comparative example |
| No. 103 | A-2 | 1.5 | $3.21 \times 10^{-4}$ | 5.9 | Present | Not performed | None | — | 100 | 0.26 | Comparative example |
| No. 104 | A-2 | 1.5 | $3.21 \times 10^{-4}$ | 5.9 | Present | Not performed | Compound I-1 | $3.21 \times 10^{-5}$ | 102 | 0.27 | Comparative example |

TABLE 2-continued

| | Emulsions used in sample preparation | | | | | | Compounds added to emulsions | | Photographic properties | | |
|---|---|---|---|---|---|---|---|---|---|---|---|
| Sample No. | Emulsion No. | Aspect ratio | Sensitizing dye addition amount (mol/mol of silver) | AgI content (mol %) on emulsion surface | Presence/ absence of 10 or more dislocation lines per grain | Reduction sensitization | Compound No. | Addition amount (mol/mol of silver) | Sensitivity *1) | Fog density | Remarks |
| No. 105 | B-1 | 2.1 | $3.39 \times 10^{-4}$ | 2.0 | Present | Not performed | None | — | 103 | 0.28 | Comparative example |
| No. 106 | B-1 | 2.1 | $3.39 \times 10^{-4}$ | 2.0 | Present | Not performed | Compound I-1 | $3.39 \times 10^{-5}$ | 122 | 0.26 | Present Invention |
| No. 107 | B-2 | 2.1 | $3.39 \times 10^{-4}$ | 6.2 | Present | Not performed | None | — | 104 | 0.27 | Comparative example |
| No. 108 | B-2 | 2.1 | $3.39 \times 10^{-4}$ | 6.2 | Present | Not performed | Compound I-1 | $3.39 \times 10^{-5}$ | 119 | 0.26 | Present invention |
| No. 109 | B-3 | 3.1 | $3.66 \times 10^{-4}$ | 2.1 | Present | Not performed | None | — | 110 | 0.28 | Comparative example |
| No. 110 | B-3 | 3.1 | $3.66 \times 10^{-4}$ | 2.1 | Present | Not performed | Compound I-1 | $3.66 \times 10^{-5}$ | 135 | 0.27 | Present invention |
| No. 111 | B-4 | 3.1 | $3.66 \times 10^{-4}$ | 6.7 | Present | Not performed | None | — | 111 | 0.26 | Comparative example |
| No. 112 | B-4 | 3.1 | $3.66 \times 10^{-4}$ | 6.7 | Present | Not performed | Compound I-1 | $3.66 \times 10^{-5}$ | 132 | 0.29 | Present invention |
| No. 113 | B-5 | 5.9 | $4.62 \times 10^{-4}$ | 2.4 | Present | Not performed | None | — | 135 | 0.27 | Comparative example |
| No. 114 | B-5 | 5.9 | $4.62 \times 10^{-4}$ | 2.4 | Present | Not performed | Compound I-1 | $4.62 \times 10^{-5}$ | 165 | 0.28 | Present invention |
| No. 115 | B-6 | 5.9 | $4.62 \times 10^{-4}$ | 7.5 | Present | Not performed | None | — | 133 | 0.26 | Comparative example |
| No. 116 | B-6 | 5.9 | $4.62 \times 10^{-4}$ | 7.5 | Present | Not performed | Compound I-1 | $4.62 \times 10^{-5}$ | 163 | 0.27 | Present invention |
| No. 117 | C-1 | 12.5 | $6.43 \times 10^{-4}$ | 2.6 | Present | Not performed | None | — | 160 | 0.25 | Comparative example |
| No. 118 | C-1 | 12.5 | $6.43 \times 10^{-4}$ | 2.6 | Present | Not performed | Compound I-1 | $6.43 \times 10^{-5}$ | 215 | 0.26 | Present invention |
| No. 119 | C-2 | 12.5 | $6.43 \times 10^{-4}$ | 4.4 | Present | Not performed | None | — | 162 | 0.27 | Comparative example |
| No. 120 | C-2 | 12.5 | $6.43 \times 10^{-4}$ | 4.4 | Present | Not performed | Compound I-1 | $6.43 \times 10^{-5}$ | 215 | 0.25 | Present invention |
| No. 121 | C-3 | 12.5 | $6.43 \times 10^{-4}$ | 6.1 | Present | Not performed | None | — | 159 | 0.27 | Comparative example |
| No. 122 | C-3 | 12.5 | $6.43 \times 10^{-4}$ | 6.1 | Present | Not performed | Compound I-1 | $6.43 \times 10^{-5}$ | 207 | 0.26 | Present invention |
| No. 123 | C-4 | 12.5 | $6.43 \times 10^{-4}$ | 8.0 | Present | Not performed | None | — | 158 | 0.28 | Comparative example |
| No. 124 | C-4 | 12.5 | $6.43 \times 10^{-4}$ | 8.0 | Present | Not performed | Compound I-1 | $6.43 \times 10^{-5}$ | 204 | 0.29 | Present invention |
| No. 125 | C-5 | 12.5 | $6.43 \times 10^{-4}$ | 11.0 | Present | Not performed | None | — | 159 | 0.25 | Comparative example |
| No. 126 | C-5 | 12.5 | $6.43 \times 10^{-4}$ | 11.0 | Present | Not performed | Compound I-1 | $6.43 \times 10^{-5}$ | 194 | 0.26 | Present invention |

*1) Each sensitivity is expressed in a relative value assuming the sensitivity of Sample 101 to 100.

The results shown in Table 2 reveal the following. In emulsions in which the aspect ratio=1.5, the sensitivity increasing effect of compounds of the present invention was little. In emulsions in which the aspect ratio >2, the addition of compounds of the present invention enhanced the sensitivity increasing effect without raising the fog density. The higher the aspect ratio, the more noticeable the effect. On the other hand, as is evident from the samples 117 to 126 the AgI content on the emulsion surface is preferably 10 mol % or less, and more preferably, 5 mol % or less.

EXAMPLE 2

(Preparations of Emulsions C-6, C-7, & C-8)

An emulsion C-6 was prepared by changing the preparation conditions of the emulsion C-1 in Example 1 as follows. This emulsion C-6 had an equivalent-sphere diameter of 0.99 $\mu$m, an average value of aspect ratios of 12.5, and an AgI content on the surface of a silver halide grain measured by XPS of 2.6 mol %.

(1) No AgI fine grain emulsion was added in (addition 5).

(2) In (addition 4) and (addition 5), the aqueous solution X-4 was changed to an aqueous solution containing 21.8 g of KBr and 0.81 g of KI in 100 mL.

An emulsion C-7 was prepared by changing the preparation conditions of the emulsion C-2 in Example 1 as follows. This emulsion C-7 had an equivalent-sphere diameter of 0.99 $\mu$m, an average value of aspect ratios of 12.5, and an AgI content on the surface of a silver halide grain measured by XPS of 4.4 mol %.

(1) No AgI fine grain emulsion was added in (addition 5).

(2) In (addition 4) and (addition 5), the aqueous solution X-4 was changed to an aqueous solution containing 21.4 g of KBr and 1.37 g of KI in 100 mL.

An emulsion C-8 was prepared by changing the preparation conditions of the emulsion C-3 in Example 1 as follows. This emulsion C-8 had an equivalent-sphere diameter of 0.99 $\mu$m, an average value of aspect ratios of 12.5, and an AgI content on the surface of a silver halide grain measured by XPS of 6.1 mol %.

(1) No AgI fine grain emulsion was added in (addition 5).

(2) In (addition 4) and (addition 5), the aqueous solution X-4 was changed to an aqueous solution containing 21.0 g of KBr and 1.91 g of KI in 100 mL.

These emulsions C-6 to C-8 were observed at liquid nitrogen temperature by using a 400-kV transmission electron microscope. Consequently, less than 10 dislocation lines were found in the near peripheral region of every tabular grain; substantially no dislocation lines existed.

Samples 201 to 212 were formed under the same coating conditions as in Example 1 by changing emulsions to be applied as shown in Table 3 below. Development was performed following the same procedures as in Example 1, and the photographic properties were evaluated (the sensitivity of the sample 101 in Example 1 is assumed to 100).

TABLE 3

| Emulsions used in sample preparation | | | | | | | Compounds added to emulsions | | Photographic properties | | |
|---|---|---|---|---|---|---|---|---|---|---|---|
| Sample No. | Emulsion No. | Aspect ratio | Sensitizing dye addition amount (mol/mol of silver) | AgI content (mol %) on emulsion surface | Number of dislocation lines per grain | Reduction Sensitization | Compound No. | Addition amount (mol/mol of silver) | Sensitivity *1) | Fog density | Remarks |
| No. 201 | C-1 | 12.5 | $6.43 \times 10^{-4}$ | 2.6 | 10 or more | Not performed | None | — | 160 | 0.25 | Comparative example |
| No. 202 | C-1 | 12.5 | $6.43 \times 10^{-4}$ | 2.6 | 10 or more | Not performed | Compound I-1 | $6.43 \times 10^{-5}$ | 215 | 0.26 | Present invention |
| No. 203 | C-6 | 12.5 | $6.43 \times 10^{-4}$ | 2.6 | less than 10 | Not performed | None | — | 70 | 0.29 | Comparative example |
| No. 204 | C-6 | 12.5 | $6.43 \times 10^{-4}$ | 2.6 | less than 10 | Not performed | Compound I-1 | $6.43 \times 10^{-5}$ | 72 | 0.28 | Comparative example |
| No. 205 | C-2 | 12.5 | $6.43 \times 10^{-4}$ | 4.4 | 10 or more | Not performed | None | — | 162 | 0.27 | Comparative example |
| No. 206 | C-2 | 12.5 | $6.43 \times 10^{-4}$ | 4.4 | 10 or more | Not performed | Compound I-1 | $6.43 \times 10^{-5}$ | 215 | 0.25 | Present invention |
| No. 207 | C-7 | 12.5 | $6.43 \times 10^{-4}$ | 4.4 | less than 10 | Not performed | None | — | 66 | 0.24 | Comparative example |
| No. 208 | C-7 | 12.5 | $6.43 \times 10^{-4}$ | 4.4 | less than 10 | Not performed | Compound I-1 | $6.43 \times 10^{-5}$ | 69 | 0.25 | Comparative example |
| No. 209 | C-3 | 12.5 | $6.43 \times 10^{-4}$ | 6.1 | 10 or more | Not performed | None | — | 159 | 0.27 | Comparative example |
| No. 210 | C-3 | 12.5 | $6.43 \times 10^{-4}$ | 6.1 | 10 or more | Not performed | Compound I-1 | $6.43 \times 10^{-5}$ | 207 | 0.26 | Present invention |
| No. 211 | C-8 | 12.5 | $6.43 \times 10^{-4}$ | 6.1 | less than 10 | Not performed | None | — | 62 | 0.29 | Comparative example |
| No. 212 | C-8 | 12.5 | $6.43 \times 10^{-4}$ | 6.1 | less than 10 | Not performed | Compound I-1 | $6.43 \times 10^{-5}$ | 63 | 0.27 | Comparative example |

*1) Each sensitivity is expressed in a relative value assuming the sensitivity of Sample 101 in Example 1 to 100.

The results shown in Table 3 reveal the following. As can be seen from the samples 201 to 212, in emulsions in which the number of dislocation lines was less than 10, the sensitivity increasing effect of compounds represented by formula (1), (2) or (3) of the present invention was very little. However, in emulsions in which the number of dislocation lines was 10 or more, the addition of the compounds enhanced the sensitivity increasing effect without raising the fog density.

EXAMPLE 3

Samples 301 to 320 were formed under the same coating conditions as in Example 1 by using the emulsion B-1 and changing the types and addition amounts of compounds of the present invention as shown in Table 4. Development was performed following the same procedures as in Example 1, and the photographic properties were evaluated (the sensitivity of the sample 101 in Example 1 is assumed to 100).

TABLE 4

| | Emulsions used in sample preparation | | | | | | Compounds added to emulsions | | Photographic properties | | |
|---|---|---|---|---|---|---|---|---|---|---|---|
| Sample No. | Emulsion No. | Aspect ratio | Sensitizing dye addition amount (mol/mol of silver) | AgI content (mol %) on emulsion surface | Presence/ absence of 10 or more dislocation lines per grain | Reduction Sensitization | Compound No. | Addition amount (mol %) with respect to sensitizing dye | Sensitivity *1) | Fog density | Remarks |
| No. 301 | B-5 | 5.9 | $4.62 \times 10^{-4}$ | 2.4 | Present | Performed | None | — | 137 | 0.29 | Comparative example |
| No. 302 | B-5 | 5.9 | $4.62 \times 10^{-4}$ | 2.4 | Present | Performed | Compound I-1 | 1 | 195 | 0.25 | Present invention |
| No. 303 | B-5 | 5.9 | $4.62 \times 10^{-4}$ | 2.4 | Present | Performed | Compound I-1 | 2 | 210 | 0.27 | Present invention |
| No. 304 | B-5 | 5.9 | $4.62 \times 10^{-4}$ | 2.4 | Present | Performed | Compound I-1 | 5 | 218 | 0.27 | Present invention |
| No. 305 | B-5 | 5.9 | $4.62 \times 10^{-4}$ | 2.4 | Present | Performed | Compound I-1 | 15 | 217 | 0.28 | Present invention |
| No. 306 | B-5 | 5.9 | $4.62 \times 10^{-4}$ | 2.4 | Present | Performed | Compound I-1 | 25 | 206 | 0.26 | Present invention |
| No. 307 | B-5 | 5.9 | $4.62 \times 10^{-4}$ | 2.4 | Present | Performed | Compound I-1 | 35 | 191 | 0.29 | Present invention |
| No. 308 | B-5 | 5.9 | $4.62 \times 10^{-4}$ | 2.4 | Present | Performed | Compound I-2 | 10 | 218 | 0.25 | Present invention |
| No. 309 | B-5 | 5.9 | $4.62 \times 10^{-4}$ | 2.4 | Present | Performed | Compound I-3 | 10 | 216 | 0.26 | Present invention |
| No. 310 | B-5 | 5.9 | $4.62 \times 10^{-4}$ | 2.4 | Present | Performed | Compound I-6 | 10 | 212 | 0.28 | Present invention |
| No. 311 | B-5 | 5.9 | $4.62 \times 10^{-4}$ | 2.4 | Present | Performed | Compound I-12 | 10 | 209 | 0.29 | Present invention |
| No. 312 | B-5 | 5.9 | $4.62 \times 10^{-4}$ | 2.4 | Present | Performed | Compound I-14 | 10 | 207 | 0.26 | Present invention |
| No. 313 | B-5 | 5.9 | $4.62 \times 10^{-4}$ | 2.4 | Present | Performed | Compound I-16 | 10 | 213 | 0.25 | Present invention |
| No. 314 | B-5 | 5.9 | $4.62 \times 10^{-4}$ | 2.4 | Present | Performed | Compound I-4 | 10 | 192 | 0.26 | Present invention |
| No. 315 | B-5 | 5.9 | $4.62 \times 10^{-4}$ | 2.4 | Present | Performed | Compound I-7 | 10 | 190 | 0.27 | Present invention |
| No. 316 | B-5 | 5.9 | $4.62 \times 10^{-4}$ | 2.4 | Present | Performed | Compound I-8 | 10 | 199 | 0.26 | Present invention |
| No. 317 | B-5 | 5.9 | $4.62 \times 10^{-4}$ | 2.4 | Present | Performed | Compound I-9 | 10 | 190 | 0.28 | Present invention |
| No. 318 | B-5 | 5.9 | $4.62 \times 10^{-4}$ | 2.4 | Present | Performed | Compound I-11 | 10 | 195 | 0.25 | Present invention |
| No. 319 | B-5 | 5.9 | $4.62 \times 10^{-4}$ | 2.4 | Present | Performed | Compound I-13 | 10 | 198 | 0.26 | Present invention |
| No. 320 | B-5 | 5.9 | $4.62 \times 10^{-4}$ | 2.4 | Present | Performed | Compound I-18 | 10 | 197 | 0.24 | Present invention |

*1) Each sensitivity is expressed in a relative value assuming the sensitivity of Sample 101 to 100.

The results shown in Table 4 reveal the following. As can be seen from the samples 301 to 307, the addition amount of compounds of the present invention is preferably 1 to 25 mol %, and more preferably, 2 to 15 mol % with respect to sensitizing dyes. As is apparent from the samples 308 to 320, a compound of formula (3) is most preferred of compounds used in the present invention.

EXAMPLE 4

Samples 401 to 408 were formed under the same coating conditions as in Example 1 by performing/not performing reduction sensitization by using the emulsions B-1 and B-2 and changing the presence/absence of the compounds represented by formula (1), (2) or (3) of the present invention as shown in Table 5. Development was performed following the same procedures as in Example 1, and the photographic properties were evaluated (the sensitivity of the sample 101 in Example 1 is assumed to 100).

TABLE 5

| Emulsions used in sample preparation | | | | | | | Compounds added to emulsions | | Photographic properties | | |
|---|---|---|---|---|---|---|---|---|---|---|---|
| Sample No. | Emulsion No. | Aspect ratio | Sensitizing dye addition amount (mol/mol of silver) | AgI content (mol %) on emulsion surface | Presence/absence of 10 or more dislocation lines per grain | Reduction sensitization | Compound No. | Addition amount (mol/mol of silver) | Sensitivity *1) | Fog density | Remarks |
| No. 401 | B-5 | 5.9 | $4.62 \times 10^{-4}$ | 2.4 | Present | Not performed | None | — | 135 | 0.27 | Comparative example |
| No. 402 | B-5 | 5.9 | $4.62 \times 10^{-4}$ | 2.4 | Present | Not performed | Compound I-1 | $4.62 \times 10^{-5}$ | 165 | 0.28 | Present invention |
| No. 403 | B-5 | 5.9 | $4.62 \times 10^{-4}$ | 2.4 | Present | Performed | None | — | 137 | 0.29 | Comparative example |
| No. 404 | B-5 | 5.9 | $4.62 \times 10^{-4}$ | 2.4 | Present | Performed | Compound I-1 | $4.62 \times 10^{-5}$ | 220 | 0.28 | Present invention |
| No. 405 | B-6 | 5.9 | $4.62 \times 10^{-4}$ | 7.5 | Present | Not performed | None | — | 133 | 0.26 | Comparative example |
| No. 406 | B-6 | 5.9 | $4.62 \times 10^{-4}$ | 7.5 | Present | Not performed | Compound I-1 | $4.62 \times 10^{-5}$ | 163 | 0.27 | Present invention |
| No. 407 | B-6 | 5.9 | $4.62 \times 10^{-4}$ | 7.5 | Present | Performed | None | — | 136 | 0.28 | Comparative example |
| No. 408 | B-6 | 5.9 | $4.62 \times 10^{-4}$ | 7.5 | Present | Performed | Compound I-1 | $4.62 \times 10^{-5}$ | 209 | 0.27 | Present invention |

*1) Each sensitivity is expressed in a relative value assuming the sensitivity of Sample 101 in Example 1 to 100.

The results shown in Table 5 reveal the following. As is evident from the samples 401 to 408, it is preferable that the compounds represented by formula (1), (2) or (3) of the present invention be combined with reduction sensitized emulsion, and that the AgI content on the emulsion surface be 5 mol % or less.

EXAMPLE 5

A supplementary test was conducted on the known patents using onium salt compounds described in "BACKGROUND OF THE INVENTION" of the present invention. Emulsions described in Examples 1 of JP-A-61-43740, JP-A-6-242534, and JP-A-10-83040 were prepared. As a chemical sensitization step, the compound represented by formula (1), (2) or (3) of the invention was added and chemical sensitization was optimally performed by sequentially adding the sensitizing dye ExS-1, potassium thiocyanate, chloroauric acid, sodium thiosulfate, and N,N-dimethylselenourea as in Example 1. Whether the compound of the invention was added to specific samples are listed in Table 6 below. After that, the chemical sensitization was completed by adding the same water-soluble mercapto compounds MER-1 and MER-2 as in Example 1 at a ratio of 4:1. Dislocation lines were observed at liquid nitrogen temperature by using a 400-kV transmission electron microscope.

Samples 501 to 512 were formed under the same coating conditions as in Example 1, except for the above mentioned changes. Development was performed following the same procedures as in Example 1, and the photographic properties were evaluated. Assuming that the sensitivity of a sample in which compounds of the present invention were not used in each emulsion was 100, the effect of adding compounds of the present invention was evaluated.

TABLE 6

| Emulsions used in sample preparation | | | | Compounds added to emulsions | | Photographic properties | | |
|---|---|---|---|---|---|---|---|---|
| Sample No. | Emulsion No. | Presence/absence of 10 or more dislocation lines per grain | Aspect ratio | Compound No. | Addition amount (mol %) with respect to sensitizing dye | Sensitivity *1) | Fog density | Remarks |
| No. 501 | Emulsion B-1 of present invention (subjected to reduction sensitization) | Present | 2.1 | None | — | 100 | 0.27 | Comparative example |
| No. 502 | Emulsion B-1 of present invention (subjected to reduction sensitization) | Present | 2.1 | Compound I-1 | 10 | 118 | 0.28 | Present invention |
| No. 503 | Emulsion B-1 of present invention (subjected to reduction sensitization) | Present | 2.1 | Compound I-1 | 25 | 117 | 0.27 | Present invention |
| No. 504 | Emulsion B-1 of present invention (subjected to reduction sensitization) | Present | 2.1 | Compound I-1 | 100 | 114 | 0.29 | Present invention |

TABLE 6-continued

| Sample No. | Emulsions used in sample preparation: Emulsion No. | Presence/absence of 10 or more dislocation lines per grain | Aspect ratio | Compounds added to emulsions: Compound No. | Addition amount (mol %) with respect to sensitizing dye | Photographic properties: Sensitivity *1) | Fog density | Remarks |
|---|---|---|---|---|---|---|---|---|
| No. 505 | Emulsion described in Example 1 of JP-A-61-43740 | Absent | 1.0 | None | — | 100 | 0.29 | Comparative example |
| No. 506 | Emulsion described in Example 1 of JP-A-61-43740 | Absent | 1.0 | Compound I-1 | 10 | 101 | 0.28 | Comparative example |
| No. 507 | Emulsion described in Example 1 of JP-A-61-43740 | Absent | 1.0 | Compound I-1 | 25 | 102 | 0.26 | Comparative example |
| No. 508 | Emulsion described in Example 1 of JP-A-61-43740 | Absent | 1.0 | Compound I-1 | 100 | 108 | 0.25 | Comparative example |
| No. 509 | Emulsion A described in Example 1 of JP-A-6-242534 | Absent | 1.0 | None | — | 100 | 0.25 | Comparative example |
| No. 510 | Emulsion A described in Example 1 of JP-A-61-242534 | Absent | 1.0 | Compound I-1 | 10 | 102 | 0.24 | Comparative example |
| No. 511 | Emulsion O described in Example 1 of JP-A-10-83040 | Absent | 1.0 | None | — | 100 | 0.22 | Comparative example |
| No. 512 | Emulsion O described in Example 1 of JP-A-10-83040 | Absent | 1.0 | Compound I-1 | 10 | 101 | 0.23 | Comparative example |

*1) Each sensitivity is expressed in a relative value assuming the sensitivity of each sample to which Compound I-1 is not added to 100.

The results shown in Table 6 reveal the following.

In JP-A-61-43740, as shown in Table 1 of Example 1 thereof, the sensitivity increasing effect was achieved when the addition amount of an onium salt compound was larger than that of a sensitizing dye. As data of the samples 501 to 508 shows, an onium salt compound in the emulsion of JP-A-61-43740 had a slight effect when the addition amount was 100 mol % of a sensitizing dye. However, the sensitivity increasing effect was very little when the addition amount was 25 mol % or less.

As data of the samples 509 to 512 shows, the sensitivity increasing effect obtained by the addition of onium salt compounds in the emulsions of JP-A-6-242534 and JP-A-10-83040 was much less than that in the emulsions of the present invention.

EXAMPLE 6

Silver halide emulsions D to R were prepared by the following methods.

(Manufacturing Method of Emulsion D)

42.2L of an aqueous solution containing 31.7 g of low-molecular-weight gelatin phthalated at a phthalation ratio of 97% and 31.7 g of KBr were vigorously stirred at 35° C. 1,583 mL of an aqueous solution containing 316.7 g of $AgNO_3$ and 1,583 mL of an aqueous solution containing 221.5 g of KBr and 52.7 g of gelatin-4 of Example 1 were added over 1 min by the double jet method. Immediately after the addition, 52.8 g of KBr were added, and 2,485 mL of an aqueous solution containing 398.2 g of $AgNO_3$ and 2,581 mL of an aqueous solution containing 291.lg of KBr were added over 2 min by the double jet method. Immediately after the addition, 44.8 g of KBr were added. After that, the temperature was raised to 40° C. to ripen the material. After the ripening, 923 g of gelatin-2 of Example 1 and 79.2 g of KBr were added, and 15,974 mL of an aqueous solution containing 5,103 g of $AgNO_3$ and an aqueous KBr solution were added over 10 min by the double jet method while the flow rate was accelerated such that the final flow rate was 1.4 times the initial flow rate. During the addition, the pAg of the bulk emulsion solution in the reaction vessel was held at 9.90. After washing with water, gelatin-1 of Example 1 was added, the pH and the pAg were adjusted to 5.7 and 8.8, respectively, and the silver amount and the gelatin amount were adjusted to 131.8 g and 64.1 g, respectively, per kg of the emulsion, thereby preparing a seed emulsion.

1,211 mL of an aqueous solution containing 46 g of gelatin-2 of Example 1 and 1.7 g of KBr were vigorously stirred at 75° C. After 9.9 g of the seed emulsion were added, 0.3 g of modified silicone oil (L7602 manufactured by Nippon Uniker K.K.) was added. $H_2SO_4$ was added to adjust the pH to 5.5, and 67.6 mL of an aqueous solution containing 7.0 g of $AgNO_3$ and an aqueous KBr solution were added over 6 min by the double jet method while the flow rate was accelerated such that the final flow rate was 5.1 times the initial flow rate. During the addition, the pAg of the bulk emulsion solution in the reaction vessel was held at 8.15. After 2 mg of sodium benzenethiosulfonate and 2 mg of thiourea dioxide were added, 328 mL of an aqueous solution containing 105.6 g of $AgNO_3$ and an aqueous KBr solution were added over 56 min by the double jet method while the flow rate was accelerated such that the final flow rate was 3.7 times the initial flow rate. During the addition, an AgI fine grain emulsion having a grain size of 0.037 $\mu$m was simultaneously added at an accelerated flow rate so that the silver iodide content was 27 mol %. At the same time, the pAg of the bulk emulsion solution in the reaction vessel was held at 8.60. 121.3 mL of an aqueous solution containing 45.6 g of $AgNO_3$ and an aqueous KBr solution were added over 22 min by the double jet method. During the addition, the pAg of the bulk emulsion solution in the reaction vessel was held at 7.60. The temperature was raised to 82° C., KBr was added to adjust the pAg of the bulk emulsion solution in the reaction vessel to 8.80, and the abovementioned AgI fine grain emulsion was added in an amount of 6.33 g in terms of a KI weight. Immediately after the addition, 206.2 mL of an aqueous solution containing 66.4 g of $AgNO_3$ were added over 16 min. For the first 5 min of the addition, the pAg of the bulk emulsion solution in the reaction vessel was held at 8.80. After washing with water, gelatin-1 of Example 1 was added, the pH and the pAg were adjusted to 5.8 and 8.7, respectively, at 40° C., a compound 1 was added, and the temperature was raised to 60° C. After sensitizing dyes ExS-2 and ExS-3 were added, potassium thiocyanate, chloroauric acid, sodium thiosulfate, and N,N-dimethylselenourea were added to optimally perform chemical sensitization. At the end of this chemical sensitization, compounds 2 and 3 set forth below were added. "Optimal chemical sensitization" means that the addition amount of each of the sensitizing dyes and the compounds was $10^{-1}$ to $10^{-8}$ mol per mol of a silver halide.

Compound 1

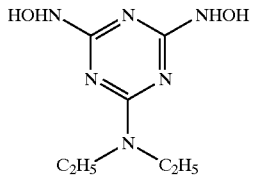

Compound 2

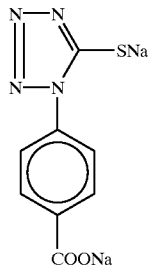

Compound 3

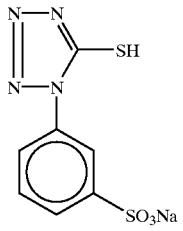

ExS-2

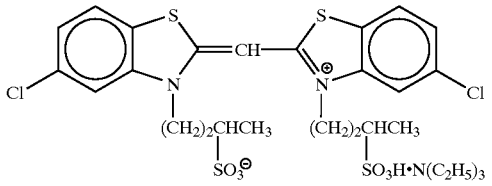

ExS-3

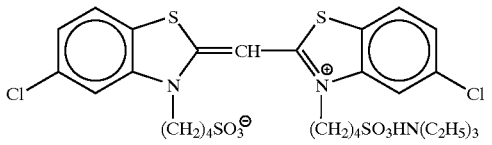

(Manufacturing Method of Emulsion E)

1,192 mL of an aqueous solution containing 0.96 g of gelatin-4 of Example 1 and 0.9 g of KBr were vigorously stirred at 40° C. 37.5 mL of an aqueous solution containing 1.49 g of $AgNO_3$ and 37.5 mL of an aqueous solution containing 1.05 g of KBr were added over 30 sec by the double jet method. After 1.2 g of KBr were added, the temperature was raised to 75° C. to ripen the material. After the ripening, 35 g of gelatin-3 of Example 1 were added, and the pH was adjusted to 7. 6 mg of thiourea dioxide were added. 116 mL of an aqueous solution containing 29 g of $AgNO_3$ and an aqueous KBr solution were added by the double jet method while the flow rate was accelerated such that the final flow rate was 3 times the initial flow rate. During the addition, the pAg of the bulk emulsion solution in the reaction vessel was held at 8.15. 440.6 mL of an aqueous solution containing 110.2 g of $AgNO_3$ and an aqueous KBr solution were added over 30 min by the double jet method while the flow rate was accelerated such that the final flow rate was 5.1 times the initial flow rate. During the addition, the AgI fine grain emulsion used in the preparation of the emulsion D was simultaneously added at an accelerated flow rate so that the silver iodide content was 15.8 mol %. At the same time, the pAg of the bulk emulsion solution in the reaction vessel was held at 7.85. 96.5 mL of an aqueous solution containing 24.1 g of $AgNO_3$ and an aqueous KBr solution were added over 3 min by the double jet method. During the addition, the pAg of the bulk emulsion solution in the reaction vessel was held at 7.85. After 26 mg of sodium ethylthiosulfonate were added, the temperature was raised to 55° C., an aqueous KBr solution was added to adjust the pAg of the bulk emulsion solution in the reaction vessel to 9.80. The aforementioned AgI fine grain emulsion was added in an amount of 8.5 g in terms of a KI weight. Immediately after the addition, 228 mL of an aqueous solution containing 57 g of $AgNO_3$ were added over 5 min. During the addition, an aqueous KBr solution was used to adjust the pAg of the bulk emulsion solution in the reaction vessel such that the pAg was 8.75 at the end of the addition. The resultant emulsion was washed with water and chemically sensitized in substantially the same manner as for the emulsion D.

(Manufacturing Method of Emulsion F)

1,192 mL of an aqueous solution containing 1.02 g of gelatin-2 of Example 1 and 0.9 g of KBr were vigorously stirred at 35° C. 42 mL of an aqueous solution containing 4.47 g of $AgNO_3$ and 42 mL of an aqueous solution containing 3.16 g of KBr were added over 9 sec by the double jet method. After 2.6 g of KBr were added, the temperature was raised to 63° C. to ripen the material. After the ripening, 41.2 g of gelatin-3 of Example 1 and 18.5 g of NaCl were added. After the pH was adjusted to 7.2, 8 mg of dimethylamineborane were added. 203 mL of an aqueous solution containing 26 g of $AgNO_3$ and an aqueous KBr solution were added by the double jet method while the flow rate was accelerated such that the final flow rate was 3.8 times the initial flow rate. During the addition, the pAg of the bulk emulsion solution in the reaction vessel was held at 8.65. 440.6 mL of an aqueous solution containing 110.2 g of $AgNO_3$ and an aqueous KBr solution were added over 24 min by the double jet method while the flow rate was accelerated such that the final flow rate was 5.1 times the initial flow rate. During the addition, the AgI fine grain emulsion used in the preparation of the emulsion D was simultaneously added at an accelerated flow rate so that the silver iodide content was 2.3 mol %. At the same time, the pAg of the bulk emulsion solution in the reaction vessel was held at 8.50. After 10.7 mL of an aqueous 1 N potassium thiocyanate solution were added, 153.5 mL of an aqueous solution containing 24.1 g of $AgNO_3$ and an aqueous KBr solution were added over 2 min 30 sec by the double jet method. During the addition, the pAg of the bulk emulsion solution in the reaction vessel was held at 8.05. An aqueous KBr solution was added to adjust the pAg of the bulk emulsion solution in the reaction vessel to 9.25. The aforementioned AgI fine grain emulsion was added in an amount of 6.4 g in terms of a KI weight. Immediately after the addition, 404 mL of an aqueous solution containing 57 g of $AgNO_3$ were added over 45 min. During the addition, an aqueous KBr solution was used to adjust the pAg of the bulk emulsion solution in the reaction vessel such that the pAg was 8.65 at the end of the addition. The resultant emulsion was washed with water and chemically sensitized in substantially the same manner as for the emulsion D.

(Manufacturing Method of Emulsion G)

In the preparation of the emulsion F, the $AgNO_3$ addition amount during nucleation was increased by 2.3 times. Also, in the final addition of 404 mL of an aqueous solution containing 57 g of $AgNO_3$, the pAg of the bulk emulsion solution in the reaction vessel was adjusted to 6.85 by using an aqueous KBr solution. An emulsiong was prepared following substantially the same procedures as for the emulsion F except the foregoing.

(Manufacturing Method of Emulsion H)

In the preparation of the emulsion C-1 of Example 1, the compounds represented by formula (1), (2) or (3) of the present invention were added where necessary (whether compounds were added or not is shown in a table of this example below) before chemical sensitization was performed. Also, the sensitizing dye added at the beginning of the chemical sensitization was changed to the combination of ExS-4, ExS-5, and ExS-6 set forth below. An emulsion H was prepared following substantially the same procedures as for the emulsion C-3 except the foregoing. Note that the use amounts of the sensitizing dyes ExS-4, ExS-5, and ExS-6 were $5.50\times10^{-4}$ mol, $1.30\times10^{-4}$ mol, and $4.65\times10^{-5}$ mol, respectively, per mol of a silver halide.

ExS-4

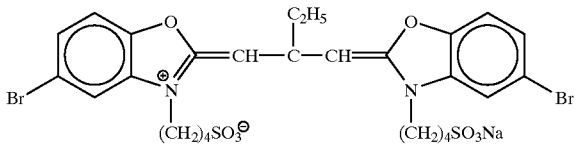

ExS-5

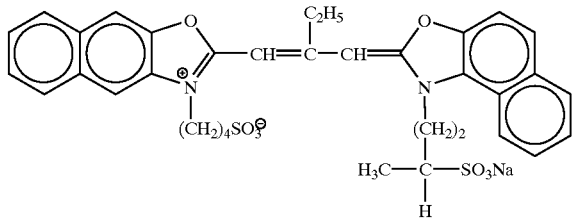

ExS-6

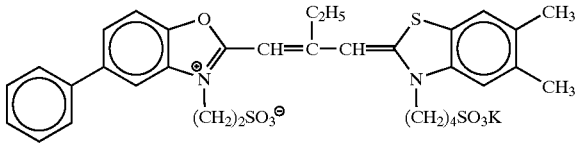

(Manufacturing Method of Emulsion I)

1,200 mL of an aqueous solution containing 0.75 g of gelatin-4 of Example 1 and 0.9 g of KBr were held at 39° C. and stirred with violence at pH 1.8. An aqueous solution containing 1.85 g of $AgNO_3$ and an aqueous KBr solution containing 1.5 mol % of KI were added over 16 sec by the double jet method. During the addition, the excess KBr concentration was held constant. The temperature was raised to 54° C. to ripen the material. After the ripening, 20 g of gelatin-2 of Example 1 were added. After the pH was adjusted to 5.9, 2.9 g of KBr were added. 288 mL of an aqueous solution containing 27.4 g of $AgNO_3$ and an aqueous KBr solution were added over 53 min by the double jet method. During the addition, an AgI fine grain emulsion having a grain size of 0.03 $\mu$m was simultaneously added such that the silver iodide content was 4.1 mol %. At the same time, the pAg of the bulk emulsion solution in the reaction vessel was held at 9.40. After 2.5 g of KBr were added, an aqueous solution containing 87.7 g of $AgNO_3$ and an aqueous KBr solution were added over 63 min by the double jet method while the flow rate was accelerated so that the final flow rate was 1.2 times the initial flow rate. During the addition, abovementioned AgI fine grain emulsion was simultaneously added such that the silver iodide content was 10.5 mol %. At the same time, the pAg of the bulk emulsion solution in the reaction vessel was held at 9.50. 132 mL of an aqueous solution containing 41.8 g of $AgNO_3$ and an aqueous KBr solution were added over 25 min by the double jet method. The addition of the aqueous KBr solution was so adjusted that the pAg of the bulk emulsion solution in the reaction vessel was 8.15 at the end of the addition. The pH was adjusted to 7.3, and 1 mg of thiourea dioxide was added. After KBr was added to adjust the pAg of the bulk emulsion solution in the reaction vessel to 9.50, the aforementioned AgI fine grain emulsion was added in an amount of 5.73 in terms of a KI weight. Immediately after the addition, 609 mL of an aqueous solution containing 66.4 g of $AgNO_3$ were added over 10 min. For the first 6 min of the addition, the pAg of the bulk emulsion solution in the reaction vessel was held at 9.50 by an aqueous KBr solution. After washing with water, gelatin-1 of Example 1 was added, and the pH and the pAg were adjusted to 6.5 and 8.2, respectively. The resultant emulsion was chemically sensitized in the same manner as for the emulsion H. Note that the use amounts of the sensitizing dyes ExS-4, ExS-5, and ExS-6 were $1.08\times10^{-3}$ mol, $2.56\times10^{-4}$ mol, and $9.16\times10^{-5}$ mol, respectively, per mol of a silver halide.

(Manufacturing Method of Emulsion J)

1,200 mL of an aqueous solution containing 0.70 g of gelatin-4 of Example 1, 0.9 g of KBr, 0.175 g of KI, and 0.2 g of the modified silicone oil used in the preparation of the emulsion D were held at 33° C. and stirred with violence at pH 1.8. An aqueous solution containing 1.8 g of $AgNO_3$ and an aqueous KBr solution containing 3.2 mol % of KI were added over 9 sec by the double jet method. During the addition, the excess KBr concentration was held constant. The temperature was raised to 62° C. to ripen the material. After the ripening, 27.8 g of gelatin-3 of Example 1 were added. After the pH was adjusted to 6.3, 2.9 g of KBr were added. 270 mL of an aqueous solution containing 27.58 g of $AgNO_3$ and an aqueous KBr solution were added over 37 min by the double jet method. During the addition, an AgI fine grain emulsion having a grain size of 0.008 $\mu$m was simultaneously added such that the silver iodide content was 4.1 mol %. This AgI fine grain emulsion was prepared, immediately before the addition, by mixing an aqueous solution of gelatin-4 of Example 1, an aqueous $AgNO_3$ solution, and an aqueous KI solution in another chamber having a magnetic coupling inductive stirrer described in JP-A-10-43570. At the same time, the pAg of the bulk emulsion solution in the reaction vessel was held at 9.15. After 2.6 g of KBr were added, an aqueous solution containing 87.7 g of $AgNO_3$ and an aqueous KBr solution were added over 49 min by the double jet method while the flow rate was accelerated so that the final flow rate was 3.1 times the initial flow rate. During the addition, the aforementioned AgI fine grain emulsion prepared by mixing immediately before addition was simultaneously added at an accelerated flow rate such that the silver iodide content was 7.9 mol %. At the same time, the pAg of the bulk emulsion solution in the reaction vessel was held at 9.30. After 1 mg of thiourea dioxide was added, 132 mL of an aqueous solution containing 41.8 g of $AgNO_3$ and an aqueous KBr solution were added over 20 min by the double jet method. The addition of the aqueous KBr solution was so adjusted that the pAg of the bulk emulsion solution in the reaction vessel as 7.90 at the end of the addition. After the temperature was raised to 78° C. and the pH was adjusted to 9.1, KBr was added to adjust the pAg of the bulk emulsion solution in the reaction vessel to 8.70. The AgI fine grain emulsion used in the preparation of the emulsion D was added in an amount of 5.73 g in terms of a KI weight. Immediately after the addition, 321 mL of an aqueous solution containing 66.4 g of $AgNO_3$ were added over 4 min. For the first 2 min of the addition, the pAg of the bulk emulsion solution in the reaction vessel was held at 8.70. The resultant emulsion was washed with water and chemically sensitized in substantially the same manner as for the emulsion H. Note that the use amounts of the sensitizing dyes ExS-4, ExS-5, and ExS-6 were $1.25\times10^{-3}$ mol, $2.85\times10^{-4}$ mol, $3.29\times10^{-5}$ mol, respectively, per mol of a silver halide.

(Manufacturing Method of Emulsion K)

An aqueous solution containing 17.8 g of gelatin-1 of Example 1, 6.2 g of KBr, and 0.46 g of KI was vigorously stirred at 45° C. An aqueous solution containing 11.85 g of $AgNO_3$ and an aqueous solution containing 3.8 g of KBr were added over 45 sec by the double jet method. After the temperature was raised to 63° C., 24.1 g of gelatin-1 of Example 1 were added to ripen the material. After the ripening, an aqueous solution containing 133.4 g of $AgNO_3$ and an aqueous KBr solution were added over 20 min by the double jet method such that the final flow rate was 2.6 times the initial flow rate. During the addition, the pAg of the bulk emulsion solution in the reaction vessel was held at 7.60. Also, ten minutes after the start of the addition 0.1 mg of $K_2IrCl_6$ was added. After 7 g of NaCl were added, an aqueous solution containing 45.6 g of $AgNO_3$ and an aqueous KBr solution were added over 12 min by the double jet method. During the addition, the pAg of the bulk emulsion solution in the reaction vessel was held at 6.90. Also, over 6 min from the start of the addition, 100 mL of an aqueous solution containing 29 mg of yellow prussiate were added. After 14.4 g of KBr were added, the AgI fine grain emulsion used in the preparation of the emulsion D was added in an amount of 6.3 g as a KI weight. Immediately after the addition, an aqueous solution containing 42.7 g of $AgNO_3$ and an aqueous KBr solution were added over 11 min by the double jet method. During the addition, the pAg of the bulk emulsion solution in the reaction vessel was held at 6.90. The resultant emulsion was washed with water and chemically sensitized substantially the same manner as for the emulsion H. Note that the use amounts of the sensitizing dyes EXS-4, ExS-5, and ExS-6 were $5.79\times10^{-4}$ mol, $1.32\times10^{-4}$ mol, $1.52\times10^{-5}$ mol, respectively, per mol of a silver halide.

(Manufacturing Method of Emulsion L)

An emulsion L was prepared following substantially the same procedures as for the emulsion K except that the nucleation temperature was changed to 35° C. Note that the use amounts of the sensitizing dyes ExS-4, ExS-5, and ExS-6 were $9.66\times10^{-4}$ mol, $2.20\times10^{-4}$ mol, and $2.54\times10^{-5}$ mol, respectively, per mol of a silver halide.

(Manufacturing Method of Emulsion M)

1,200 mL of an aqueous solution containing 0.75 g of gelatin-4 of Example 1 and 0.9 g of KBr were held at 39° C. and stirred with violence at pH 1.8. An aqueous solution containing 0.34 g of $AgNO_3$ and an aqueous KBr solution containing 1.5 mol % of KI were added over 16 sec by the double jet method. During the addition, the excess KBr concentration was held constant. The temperature was raised to 54° C. to ripen the material. After the ripening, 20 g of gelatin-2 of Example 1 were added. The pH was adjusted to 5.9, and 2.9 g of KBr were added. After 3 mg of thiourea dioxide were added, and 288 mL of an aqueous solution containing 28.8 g of $AgNO_3$ and an aqueous KBr solution were added over 58 min by the double jet method. During the addition, an AgI fine grain emulsion having a grain size of 0.03 $\mu$m was simultaneously added such that the silver iodide content was 4.1 mol %. At the same time, the pAg of the bulk emulsion solution in the reaction vessel was held at 9.40. After 2.5 g of KBr were added, an aqueous solution containing 87.7 g of $AgNO_3$ and an aqueous KBr solution were added over 69 min by the double jet method while the flow rate was accelerated so that the final flow rate was 1.2 times the initial flow rate. During the addition, the above-mentioned AgI fine grain emulsion was simultaneously added such that the silver iodide content was 10.5 mol %. At the same time, the pAg of the bulk emulsion solution in the reaction vessel was held at 9.50. 132 mL of an aqueous solution containing 41.8 g of $AgNO_3$ and an aqueous KBr solution were added over 27 min by the double jet method. The addition of the aqueous KBr solution was so adjusted that the pAg of the bulk emulsion solution in the reaction vessel was 8.15 at the end of the addition. After 2 mg of sodium benzenethiosulfonate were added, KBr was added to adjust the pAg of the bulk emulsion solution in the reaction vessel to 9.50, and the aforementioned AgI fine grain emulsion was added in an amount of 5.73 in terms of a KI weight. Immediately after the addition, 609 mL of an aqueous solution containing 66.4 g of $AgNO_3$ were added over 11 min. For the first 6 min of the addition, the pAg of the bulk emulsion solution in the reaction vessel was held at 9.50 by an aqueous KBr solution. After washing with water, gelatin was added, the pH and the pAg were adjusted to 6.5 and 8.2, respectively, and the temperature was raised to 56° C. The sensitizing dye ExS-4 and a sensitizing dye ExS-7 were added. After that, potassium thiocyanate, chloroauric acid, sodium thiosulfate, and N,N-dimethylselenourea were added to ripen and optimally chemically sensitize the emulsion. At the end of the chemical sensitization, compounds 3 and 4 were added. Note that the use amounts of the sensitizing dyes ExS-4 and ExS-7, which is set forth below, were $3.69\times10^{-4}$ mol and $8.19\times10^{-4}$ mol, respectively, per mol of a silver halide.

ExS-7

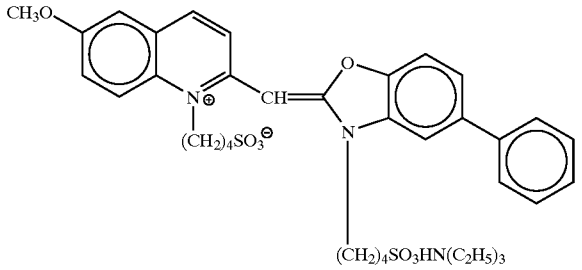

(Manufacturing Method of Emulsion N)

1,200 mL of an aqueous solution containing 0.38 g of gelatin-2 of Example 1 and 0.9 g of KBr were held at 60° C.

and stirred with violence at pH 2. An aqueous solution containing 1.03 g of $AgNO_3$ and an aqueous solution containing 0.88 g of KBr and 0.09 g of KI were added over 30 sec by the double jet method. After ripening, 12.8 g of gelatin-3 of Example 1 were added. After the pH was adjusted to 5.9, 2.99 g of KBr and 6.2 g of NaCl were added. 60.7 mL of an aqueous solution containing 27.3 g of $AgNO_3$ and an aqueous KBr solution were added over 39 min by the double jet method. During the addition, the pAg of the bulk emulsion solution in the reaction vessel was held at 9.05. An aqueous solution containing 65.6 g of $AgNO_3$ and an aqueous KBr solution were added over 46 min by the double jet method while the flow rate was accelerated so that the final flow rate was 2.1 times the initial flow rate. During the addition, the AgI fine grain emulsion used in the preparation of the emulsion D was simultaneously added at an accelerated flow rate such that the silver iodide content was 6.5 mol %. At the same time, the pAg of the bulk emulsion solution in the reaction vessel was held at 9.05. After 1.5 mg of thiourea dioxide were added, 132 mL of an aqueous solution containing 41.8 g and an aqueous KBr solution were added over 16 min by the double jet method. The addition of the aqueous KBr solution was so adjusted that the pAg of the bulk emulsion solution in the reaction vessel as 7.70 at the end of the addition. After 2 mg of sodium benzenethiosulfonate were added, KBr was added to adjust the pAg of the bulk emulsion solution in the reaction vessel to 9.80. The above-mentioned AgI fine grain emulsion was added in an amount of 6.2 g in terms of a KI weight. Immediately after the addition, 300 mL of an aqueous solution containing 88.5 g of $AgNO_3$ were added over 10 min. An aqueous KBr solution was added to adjust pAg of the bulk emulsion solution in the reaction vessel such that the pAg was 7.40 at the end of the addition. After washing with water, gelatin-1 of Example 1 was added, the pH and the pAg were adjusted to 6.5 and 8.2, respectively, and the temperature was raised to 58 ° C. The compounds represented by formula (1), (2) or (3) of the present invention were added where necessary (whether compounds were added or not is shown in the table of this example set forth below), and sensitizing dyes ExS-8, ExS-9, and ExS-10 were added. After that, $K_2IrCl_6$, potassium thiocyanate, chloroauric acid, sodium thiosulfate, and N,N-dimethylselenourea were added to optimally perform chemical sensitization. At the end of the chemical sensitization, the compounds 3 and 4 were added.

ExS-8

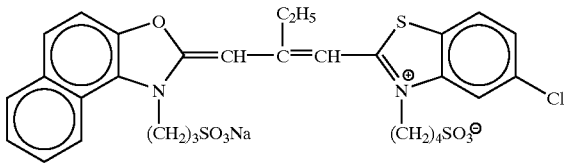

ExS-9

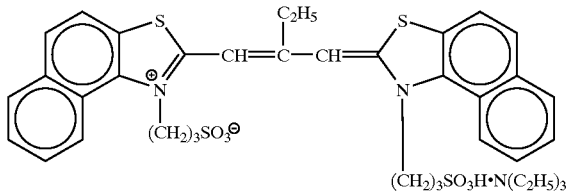

-continued

ExS-10

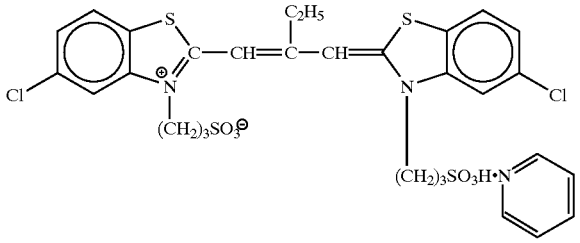

(Manufacturing Method of Emulsion O)

In the preparation of the emulsion N, the amounts of $AgNO_3$, KBr, and KI added during nucleation were changed to 1.96, 1.67, and 0.172 g, respectively. Also, the chemical sensitization temperature was changed from 58° C. to 61° C. An emulsion 0 was prepared following substantially the same procedures as for the emulsion N except the foregoing.

(Manufacturing Method of Emulsion P)

1,200 mL of an aqueous solution containing 4.9 g of gelatin-4 of Example 1 and 5.3 g of KBr were vigorously stirred at 40° C. 27 mL of an aqueous solution containing 8.75 g of $AgNO_3$ and 36 mL of an aqueous solution containing 6.45 g of KBr were added over 1 min by the double jet method. The temperature was raised to 75° C., and 21 mL of an aqueous solution containing 6.9 g of $AgNO_3$ were added over 2 min. After 26 g of $NH_4NO_3$ and 56 mL of 1 N NaOH were sequentially added, the material was ripened. After the ripening, the pH was adjusted to 4.8. 438 mL of an aqueous solution containing 141 g of $AgNO_3$ and 458 mL of an aqueous solution containing 102.6 g of KBr were added by the double jet method such that the final flow rate was 4 times the initial flow rate. The temperature was lowered to 55° C., 240 mL of an aqueous solution containing 7.1 g of $AgNO_3$ and an aqueous solution containing 6.46 g of KI were added over 5 min by the double jet method. After 7.1 g of KBr were added, 4 mg of sodium benzenethiosulfonate and 0.05 mg of $K_2IrCl_6$ were added. 177 mL of an aqueous solution containing 57.2 g of $AgNO_3$ and 223 mL of an aqueous solution containing 40.2 g of KBr were added over 8 min by the double jet method. The resultant emulsion was washed with water and chemically sensitized in substantially the same manner as for the emulsion N.

(Manufacturing Methods of Emulsion s Q and R)

Emulsions Q and R were prepared following substantially the same procedures as for the emulsions K and L, respectively, except that chemical sensitization was performed in substantially the same manner as for the emulsion O.

Characteristic values of the above silver halide emulsions are summarized in Table 7 below. The surface iodide content can be examined as follows by XPS. That is, a sample was cooled to −115° C. in a vacuum of 1×10 torr or less and irradiated with MgKα, as probe X-rays, at an X-ray source voltage of 8 kV and an X-ray current of 20 mA, thereby measuring Ag3d5/2, Br3d, and I3d5/2 electrons. The integral intensities of the measured peaks were corrected by a sensitivity factor, and the surface iodide content was calculated from these sensitivity ratios. Note that dislocation lines as described in JP-A-3-237450 were observed by a high-voltage electron microscope in silver halide grains of the emulsions D to R.

TABLE 7

| Emulsion No. | Equivalent-circular diameter (μm) Variation coefficient (%) | Thickness (μm) Variation coefficient (%) | Aspect ratio Variation coefficient (%) | Tabularity | Twin plane interval (μm) Variation coefficient (%) | Ratio (%) occupied in total projected area by tabular grains having (111) faces as major faces | Ratio (%) of (100) faces on side faces | AgI content (mol %) Variation coefficient (%) | AgCl content (mol %) | Surface AgI content (mol %) |
|---|---|---|---|---|---|---|---|---|---|---|
| D | 1.98 | 0.198 | 10 | 51 | 0.014 | 92 | 23 | 15 | 0 | 4.3 |
| | 23 | 28 | 35 | | 32 | | | 17 | | |
| E | 1.30 | 0.108 | 12 | 111 | 0.013 | 93 | 22 | 11 | 0 | 3.6 |
| | 25 | 27 | 38 | | 30 | | | 16 | | |
| F | 1.00 | 0.083 | 12 | 145 | 0.012 | 93 | 18 | 4 | 1 | 1.8 |
| | 27 | 26 | 37 | | 30 | | | 8 | | |
| G | 0.75 | 0.075 | 10 | 133 | 0.010 | 91 | 33 | 4 | 2 | 1.9 |
| | 31 | 18 | 29 | | 27 | | | 8 | | |
| H | 2.01 | 0.161 | 12.5 | 78 | 0.011 | 99 | 23 | 3.9 | 0 | 2.6 |
| | 18 | 18 | 21 | | 23 | | | 5 | | |
| I | 1.54 | 0.077 | 20 | 260 | 0.013 | 99 | 23 | 7 | 0 | 2.5 |
| | 26 | 18 | 33 | | 26 | | | 7 | | |
| J | 1.08 | 0.072 | 15 | 208 | 0.008 | 97 | 23 | 6 | 0 | 2.0 |
| | 18 | 15 | 19 | | 22 | | | 5 | | |
| K | 0.44 | 0.220 | 2 | 9 | 0.013 | 90 | 38 | 3 | 2 | 1.0 |
| | 16 | 13 | 9 | | 18 | | | 6 | | |
| L | 0.33 | 0.165 | 2 | 12 | 0.013 | 88 | 42 | 3 | 2 | 1.0 |
| | 17 | 13 | 12 | | 18 | | | 6 | | |
| M | 2.25 | 0.107 | 21 | 197 | 0.013 | 99 | 20 | 7.2 | 0 | 2.4 |
| | 31 | 19 | 34 | | 33 | | | 7 | | |
| N | 2.38 | 0.138 | 17 | 125 | 0.013 | 98 | 23 | 5 | 1 | 1.6 |
| | 20 | 20 | 23 | | 19 | | | 6 | | |
| O | 1.83 | 0.122 | 15 | 123 | 0.012 | 98 | 23 | 5 | 1 | 1.8 |
| | 18 | 20 | 22 | | 19 | | | 6 | | |
| P | 0.84 | 0.120 | 7 | 58 | 0.013 | 99 | 25 | 3 | 0 | 2.7 |
| | 17 | 18 | 19 | | 16 | | | 7 | | |
| Q | 0.44 | 0.220 | 2 | 9 | 0.013 | 88 | 42 | 2 | 2 | 1.0 |
| | 17 | 13 | 12 | | 18 | | | 6 | | |
| R | 0.33 | 0.165 | 2 | 12 | 0.013 | 88 | 46 | 1 | 2 | 0.5 |
| | 17 | 13 | 12 | | 18 | | | 6 | | |
| S | 0.07 | 0.070 | 1 | — | — | — | — | 1 | 0 | — |
| | — | — | — | | — | | | — | | |
| T | 0.07 | 0.070 | 1 | — | — | — | — | 0.9 | 0 | — |
| | — | — | — | | — | | | — | | |

1) Support

A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec, thereby obtaining a 90-μm thick PEN film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hr, manufacturing a support with a high resistance to curling.

2) Coating of Undercoat Layer

The two surfaces of the support were subjected to corona discharge, UV discharge, and glow discharge.

After that, each surface of the support was coated with an undercoat solution (10 cc/$m^2$, by using a bar coater) consisting of 0.1 g/$m^2$ of gelatin, 0.01 g/$m^2$ of sodium α-sulfodi-2-ethylhexylsuccinate, 0.04 g/$m^2$ of salicylic acid, 0.2 g/$m^2$ of p-chlorophenol, 0.012 g/$m^2$ of $(CH_2{=}CHSO_2CH_2CH_2NHCO)_2CH_2$, and 0.02 g/$m^2$ of a polyamido-epichlorohydrin polycondensation product, thereby forming an undercoat layer on a side at a high temperature upon orientation. Drying was performed at 115° C. for 6 min (all rollers and conveyors in the drying zone were at 115° C.).

3) Coating of Back Layers

One surface of the undercoated support was coated with an antistatic layer, magnetic recording layer, and slip layer having the following compositions as back layers.

3-1) Coating of Antistatic Layer

The surface was coated with 0.2 g/$m^2$ of a dispersion (secondary aggregation grain size =about 0.08 μm) of a fine-grain powder, having a specific resistance of 5 Ω·cm, of a tin oxide-antimony oxide composite material with an average grain size of 0.005 μm, together with 0.05 g/$m^2$ of gelatin, 0.02 g/$m^2$ of $(CH_2{=}CHSO_2CH_2CH_2NHCO)_2CH_2$, 0.005 g/$m^2$ of polyoxyethylene-p-nonylphenol (polymerization degree 10), and resorcin.

3-2) Coating of Magnetic Recording Layer

A bar coater was used to coat the surface with 0.06 g/$m^2$ of cobalt-γ-iron oxide (specific area 43 $m^2$/g, major axis 0.14 μm, minor axis 0.03 μm, saturation magnetization 89 emu/g, $Fe^{+2}/Fe^{+3}$=6/94, the surface was treated with 2 wt % of iron oxide by aluminum oxide silicon oxide) coated with 3-poly(polymerization degree 15)oxyethylene-propyloxytrimethoxysilane (15 wt %), together with 1.2 g/$m^2$ of diacetylcellulose (iron oxide was dispersed by an open kneader and sand mill), by using 0.3 g/$m^2$ of $C_2H_5C(CH_2OCONH{-}C_6H_3(CH_3)NCO)_3$ as a hardener and acetone, methylethylketone, and cyclohexane as solvents, thereby forming a 1.2-μm thick magnetic recording layer. 10 mg/$m^2$ of silica grains (0.3 μm) were added as a matting agent, and 10 mg/$m^2$ of aluminum oxide (0.15 μm) coated with 3-poly(polymerization degree 15)oxyethylene-propyloxytrimethoxysilane (15 wt %) were added as a polishing agent. Drying was performed at 115° C. for 6 min (all rollers and conveyors in the drying zone were at 115° C.). The color density increase of DB of the magnetic recording layer measured by an X-light (blue filter) was about 0.1. The saturation magnetization moment, coercive force, and squareness ratio of the magnetic recording layer were 4.2 emu/g, $7.3\times10^4$ A/m, and 65%, respectively.

3-3) Preparation of Slip Layer

The surface was then coated with diacetylcellulose (25 mg/m$^2$) and a mixture of $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$). Note that this mixture was melted in xylene/propylenemonomethylether (1/1) at 105° C. and poured and dispersed in propylenemonomethylether (tenfold amount) at room temperature. After that, the resultant mixture was formed into a dispersion (average grain size 0.01 μm) in acetone before being added. 15 mg/m$^2$ of silica grains (0.3 μm) were added as a matting agent, and 15 mg/m$^2$ of aluminum oxide (0.15 μm) coated with 3-poly (polymerization degree 15)oxyethylene-propyloxytrimethoxysiliane (15 wt %) were added as a polishing agent. Drying was performed at 115° C. for 6 min (all rollers and conveyors in the drying zone were at 115° C.). The resultant slip layer was found to have excellent characteristics; the coefficient of kinetic friction was 0.06 (5 mmø stainless steel hard sphere, load 100 g, speed 6 cm/min), and the coefficient of static friction was 0.07 (clip method). The coefficient of kinetic friction between an emulsion surface (to be described later) and the slip layer also was excellent, 0.12.

4) Coating of Sensitive Layers

The surface of the support on the side away from the back layers formed as above was coated with a plurality of layers having the following compositions to form a sample as a color negative sensitized material, thereby to prepare Samples 601 and 701 whose photographic properties will be tested using a red filter and a green filter, respectively.

(Compositions of Sensitive Layers)

The main ingredients used in the individual layers are classified as follows, however, the use thereof are not limited to those specified below.

ExC: Cyan coupler

ExM: Magenta coupler

ExY: Yellow coupler

UV: Ultraviolet absorbent

HBS: High-boiling organic solvent

H: Gelatin hardener (In the following description, practical compounds have numbers attached to their symbols. Formulas of these compounds will be presented later.) The number corresponding to each component indicates the coating amount in units of g/m$^2$. The coating amount of a silver halide is indicated by the amount of silver.

1st layer (1st antihalation layer)

| | | |
|---|---|---|
| Black colloidal silver | silver | 0.155 |
| Silver iodobromide emulsion T | silver | 0.01 |
| Gelatin | | 0.87 |
| ExC-1 | | 0.002 |
| ExC-3 | | 0.002 |
| Cpd-2 | | 0.001 |
| HBS-1 | | 0.004 |
| HBS-2 | | 0.002 |

-continued

2nd layer (2nd antihalation layer)

| | | |
|---|---|---|
| Black colloidal silver | silver | 0.011 |
| Gelatin | | 0.407 |
| ExM-1 | | 0.050 |
| ExF-1 | | $2.0\times10^{-3}$ |
| HBS-1 | | 0.074 |
| Solid disperse dye ExF-2 | | 0.014 |
| Solid disperse dye ExF-3 | | 0.020 |

3rd layer (Interlayer)

| | | |
|---|---|---|
| Silver iodobromide emulsion S | | 0.020 |
| ExC-2 | | 0.022 |
| Polyethylacrylate latex | | 0.085 |
| Gelatin | | 0.294 |

4th layer (Low-speed red-sensitive emulsion layer)

| | | |
|---|---|---|
| Silver iodobromide emulsion R | silver | 0.065 |
| Silver iodobromide emulsion Q | silver | 0.258 |
| ExC-1 | | 0.109 |
| ExC-3 | | 0.044 |
| ExC-4 | | 0.072 |
| ExC-5 | | 0.011 |
| ExC-6 | | 0.003 |
| Cpd-2 | | 0.025 |
| Cpd-4 | | 0.025 |
| HBS-1 | | 0.17 |
| Gelatin | | 0.80 |

5th layer (Medium-speed red-sensitive emulsion layer)

| | | |
|---|---|---|
| Silver iodobromide emulsion P | silver | 0.21 |
| Silver iodobromide emulsion O | silver | 0.62 |
| ExC-1 | | 0.14 |
| ExC-2 | | 0.026 |
| ExC-3 | | 0.020 |
| ExC-4 | | 0.12 |
| ExC-5 | | 0.016 |
| ExC-6 | | 0.007 |
| Cpd-2 | | 0.036 |
| Cpd-4 | | 0.028 |
| HBS-1 | | 0.16 |
| Gelatin | | 1.18 |

6th layer (High-speed red-sensitive emulsion layer)

| | | |
|---|---|---|
| Silver iodobromide emulsion N | silver | 1.47 |
| ExC-1 | | 0.18 |
| ExC-3 | | 0.07 |
| ExC-6 | | 0.029 |
| ExC-7 | | 0.010 |
| ExY-5 | | 0.008 |
| Cpd-2 | | 0.046 |
| Cpd-4 | | 0.077 |
| HBS-1 | | 0.25 |
| HBS-2 | | 0.12 |
| Gelatin | | 2.12 |

7th layer (Interlayer)

| | | |
|---|---|---|
| Cpd-1 | | 0.089 |
| Solid disperse dye ExF-4 | | 0.030 |
| HBS-1 | | 0.050 |
| polyethylacrylate latex | | 0.83 |
| Gelatin | | 0.84 |

8th layer (layer for donating interimage effect to red-sensitive layer)

| | | |
|---|---|---|
| Silver iodobromide emulsion M | silver | 0.560 |
| Cpd-3 | | 0.020 |
| Cpd-4 | | 0.030 |
| ExM-2 | | 0.096 |
| ExM-3 | | 0.028 |
| ExY-1 | | 0.031 |
| ExG-1 | | 0.006 |
| HBS-1 | | 0.085 |
| HBS-3 | | 0.003 |
| Gelatin | | 0.58 |

-continued

| | | |
|---|---|---|
| **9th layer (Low-speed green-sensitive emulsion layer)** | | |
| Silver iodobromide emulsion L | silver | 0.39 |
| Silver iodobromide emulsion K | silver | 0.28 |
| Silver iodobromide emulsion J | silver | 0.35 |
| ExM-2 | | 0.36 |
| ExM-3 | | 0.045 |
| ExG-1 | | 0.005 |
| Cpd-3 | | 0.010 |
| HBS-1 | | 0.28 |
| HBS-3 | | 0.01 |
| HBS-4 | | 0.27 |
| Gelatin | | 1.39 |
| **10th layer (Medium-speed green-sensitive emulsion layer)** | | |
| Silver iodobromide emulsion I | silver | 0.45 |
| ExC-6 | | 0.009 |
| ExM-2 | | 0.031 |
| ExM-3 | | 0.029 |
| ExY-1 | | 0.006 |
| ExM-4 | | 0.028 |
| ExG-1 | | 0.005 |
| Cpd-3 | | 0.006 |
| HBS-1 | | 0.064 |
| HBS-3 | | $2.1 \times 10^{-3}$ |
| Gelatin | | 0.44 |
| **11th layer (High-speed green-sensitive emulsion layer)** | | |
| Silver iodobromide emulsion H | silver | 0.99 |
| ExC-6 | | 0.004 |
| ExM-1 | | 0.016 |
| ExM-3 | | 0.036 |
| ExM-4 | | 0.020 |
| ExM-5 | | 0.004 |
| ExY-5 | | 0.003 |
| ExM-2 | | 0.013 |
| ExG-1 | | 0.005 |
| Cpd-3 | | 0.004 |
| Cpd-4 | | 0.007 |
| HBS-1 | | 0.18 |
| Polyethylacrylate latex | | 0.099 |
| Gelatin | | 1.11 |
| **12th layer (Yellow filter layer)** | | |
| Yellow colloidal silver | silver | 0.010 |
| Cpd-1 | | 0.16 |
| Oil-soluble dye ExF-5 | | 0.010 |
| Solid disperse dye ExF-6 | | 0.020 |
| HBS-1 | | 0.082 |
| Gelatin | | 1.057 |
| **13th layer (Low-speed blue-sensitive emulsion layer)** | | |
| Silver iodobromide emulsion G | silver | 0.18 |
| Silver iodobromide emulsion E | silver | 0.20 |
| Silver iodobromide emulsion F | silver | 0.07 |
| ExC-1 | | 0.041 |
| ExC-8 | | 0.012 |
| ExY-1 | | 0.035 |
| ExY-2 | | 0.71 |
| ExY-3 | | 0.10 |
| ExY-4 | | 0.005 |
| Cpd-2 | | 0.10 |
| Cpd-3 | | $4.0 \times 10^{-3}$ |
| HBS-1 | | 0.24 |
| Gelatin | | 1.41 |
| **14th layer (High-speed blue-sensitive emulsion layer)** | | |
| Silver iodobromide emulsion D | silver | 0.75 |
| ExC-1 | | 0.013 |
| ExY-2 | | 0.31 |
| ExY-3 | | 0.05 |
| ExY-6 | | 0.062 |
| Cpd-2 | | 0.075 |
| Cpd-3 | | $1.0 \times 10^{-3}$ |
| HBS-1 | | 0.10 |
| Gelatin | | 0.91 |

-continued

| | | |
|---|---|---|
| **15th layer (1st protective layer)** | | |
| Silver iodobromide emulsion S | silver | 0.30 |
| UV-1 | | 0.21 |
| UV-2 | | 0.13 |
| UV-3 | | 0.20 |
| UV-4 | | 0.025 |
| F-18 | | 0.009 |
| HBS-1 | | 0.12 |
| HBS-4 | | $5.0 \times 10^{-2}$ |
| Gelatin | | 2.3 |
| **16th layer (2nd protective layer)** | | |
| H-1 | | 0.40 |
| B-1 (diameter 1.7 μm) | | $5.0 \times 10^{-2}$ |
| B-2 (diameter 1.7 μm) | | 0.15 |
| B-3 | | 0.05 |
| S-1 | | 0.20 |
| Gelatin | | 0.75 |

In addition to the above components, to improve the storage stability, processability, resistance to pressure, antiseptic and mildewproofing properties, antistatic properties, and coating properties, the individual layers contained W-1 to W-5, B-4 to B-6, F-1 to F-18, iron salt, lead salt, gold salt, platinum salt, palladium salt, iridium salt, ruthenium salt, and rhodium salt. Additionally, a sample was manufactured by adding $8.5\times10^{-3}$ g and $7.9\times10^{-3}$ g, per mol of a silver halide, of calcium in the form of an aqueous calcium nitrate solution to the coating solutions of the 8th and 11th layers, respectively.

Preparation of Dispersions of Organic Solid Disperse Dyes

ExF-2 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700-mL pot mill, and 5.0 g of the dye ExF-2 and 500 mL of zirconium oxide beads (diameter 1 mm) were added to the mill. The contents were dispersed for 2 hr. This dispersion was done by using a BO type oscillating ball mill manufactured by Chuo Koki K.K. The dispersion was extracted from the mill and added to 8 g of a 12.5% aqueous solution of gelatin. The beads were filtered away to obtain a gelatin dispersion of the dye. The average grain size of the fine dye grains was 0.44 μm.

Following the same procedure as above, solid dispersions ExF-3, ExF-4, and ExF-6 were obtained. The average grain sizes of these fine dye grains were 0.24, 0.45, and 0.52 μm, respectively. ExF-2 was dispersed by a microprecipitation dispersion method described in Example 1 of EP549,489A. The average grain size was found to be 0.06 μm.

A solid dispersion ExF-6 was dispersed by the following method.

4.0 Kg of water and 376 g of a 3% solution of W-2 were added to 2,800 g of a wet cake of ExF-6 containing 18% of water, and the resultant material was stirred to form a slurry of ExF-6 having a concentration of 32%. Next, ULTRA VISCO MILL (UVM-2) manufactured by Imex K.K. was filled with 1,700 mL of zirconia beads having an average grain size of 0.5 mm. The slurry was milled by passing through the mill for 8 hr at a peripheral speed of about 10 m/sec and a discharge amount of 0.5 L/min.

Compounds used in the formation of each layer were as follows.

ExC-1
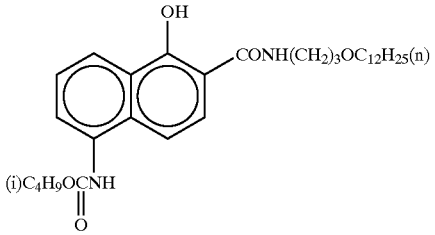
ExC-2
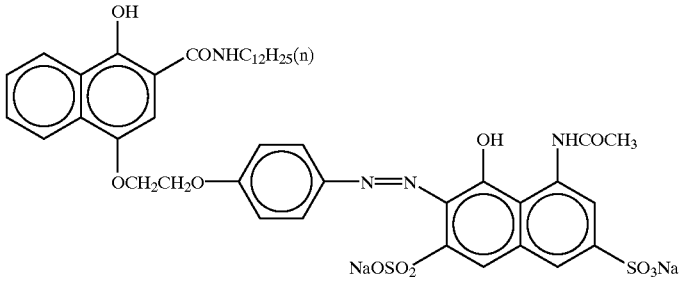
ExC-3
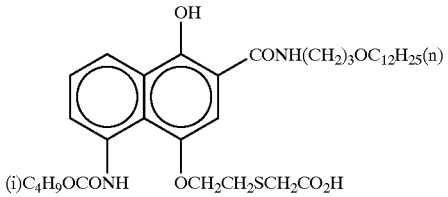
ExC-4
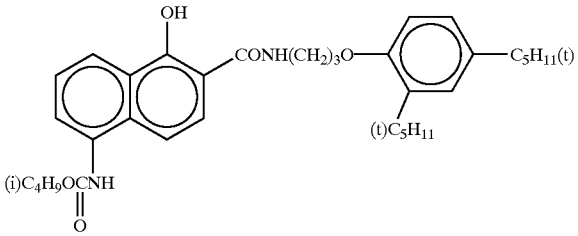
ExC-5
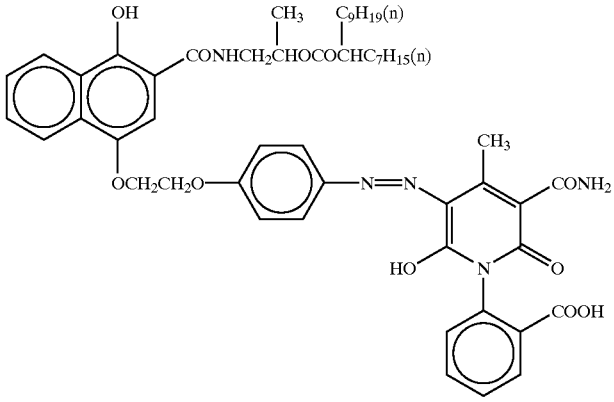
ExC-6
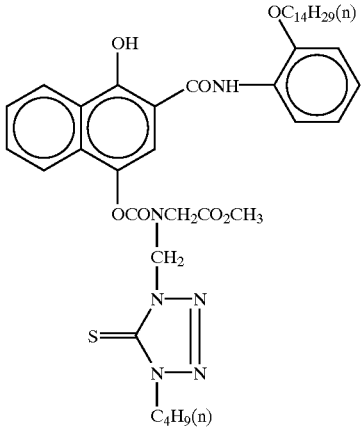
ExC-7
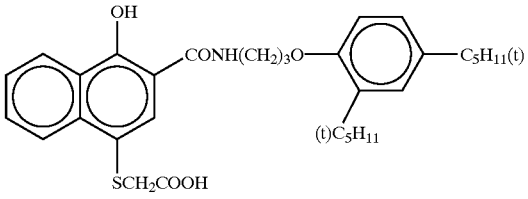

-continued
ExC-8
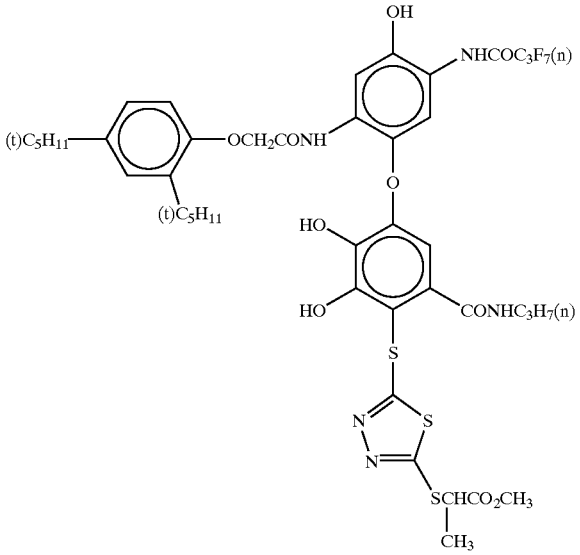
ExM-1
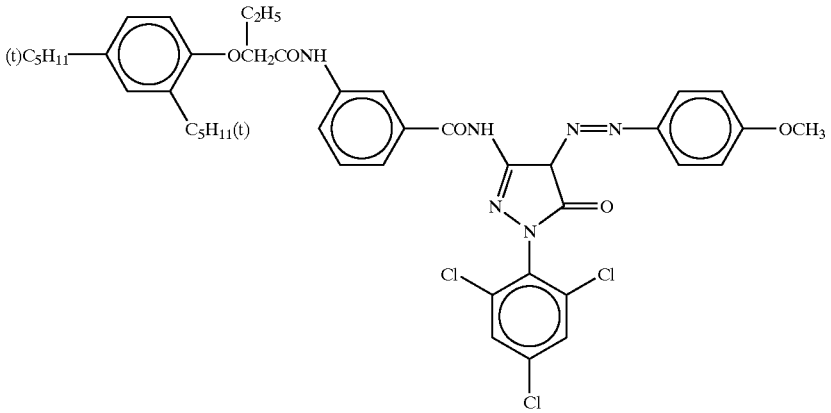
ExM-2
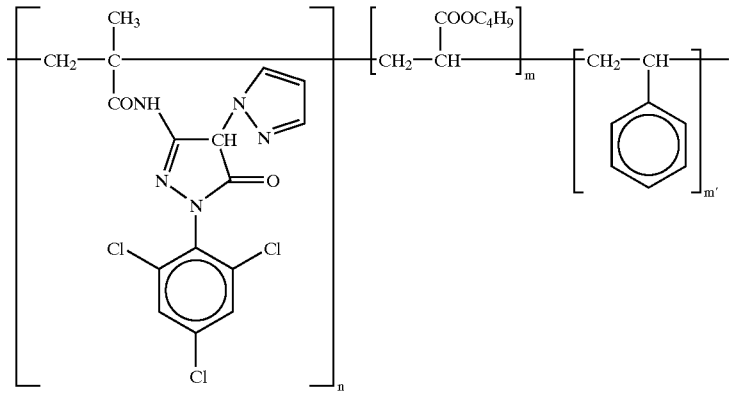
n=50
m=25
m'=25
Mol. wt.: about 20,000

-continued
ExM-3
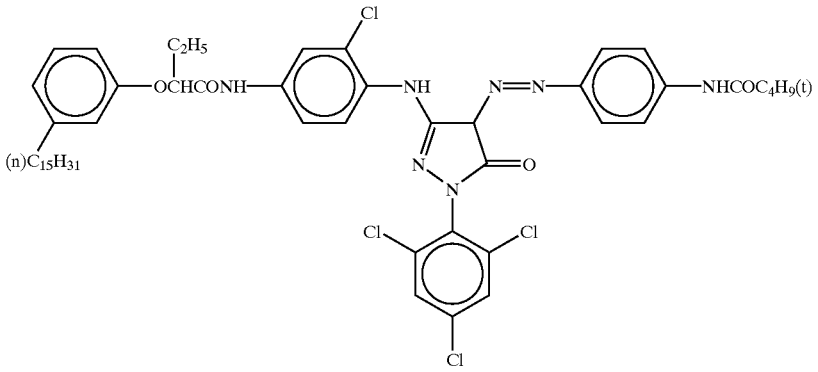
ExM-4
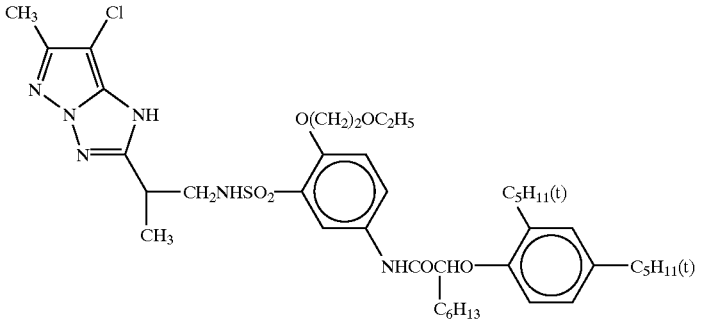
ExM-5
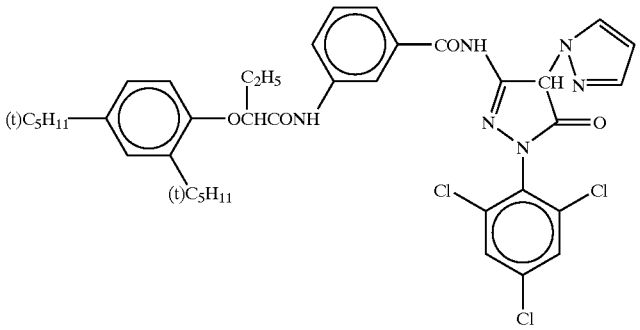
ExY-1
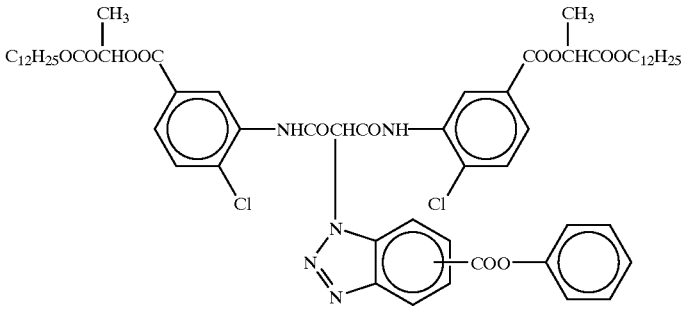
ExY-2
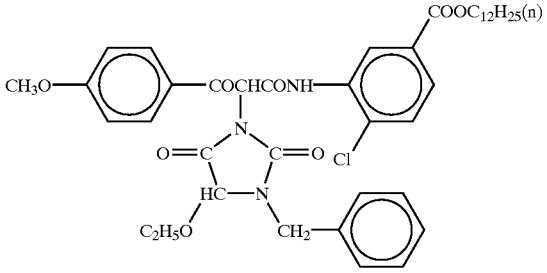

-continued
ExY-3
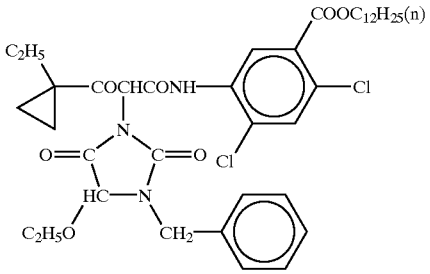
ExY-4
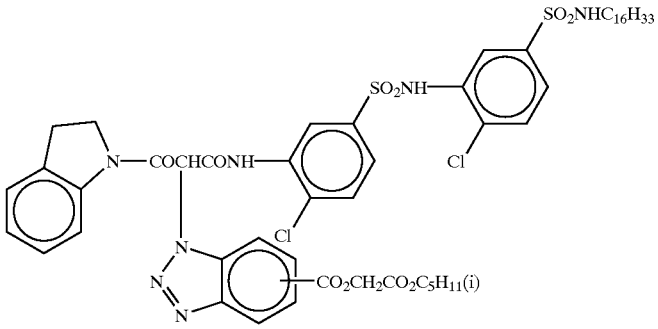
ExY-5
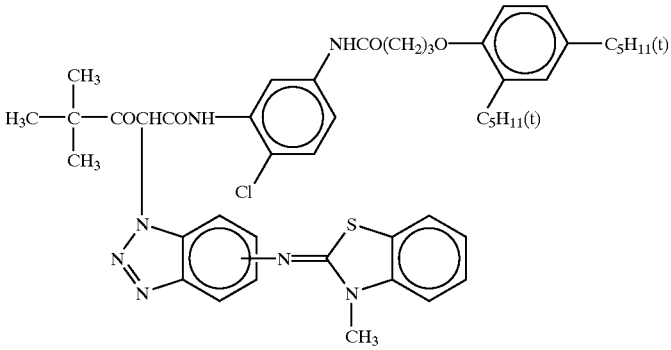
ExG-1
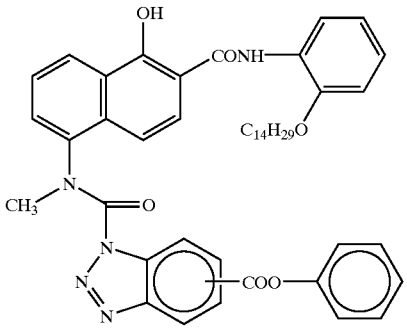
ExY-6
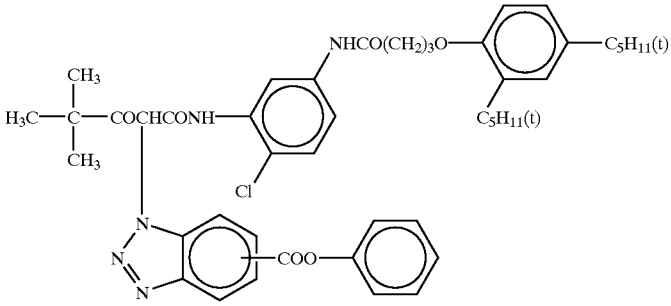

-continued
ExF-1
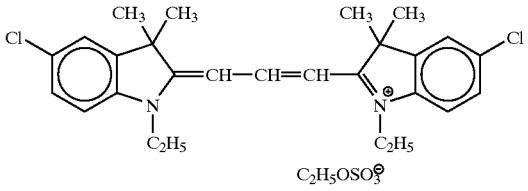
ExF-2
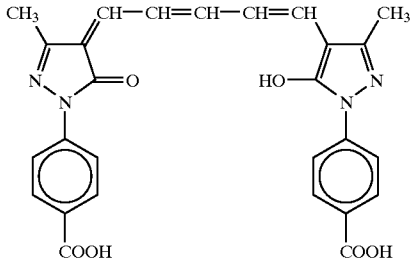
ExF-3
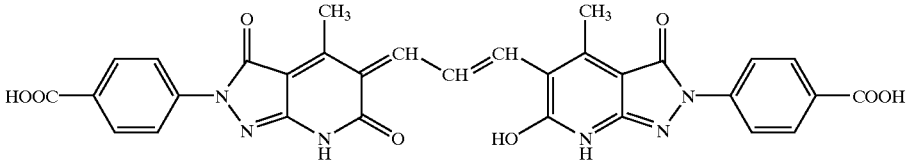
ExF-4
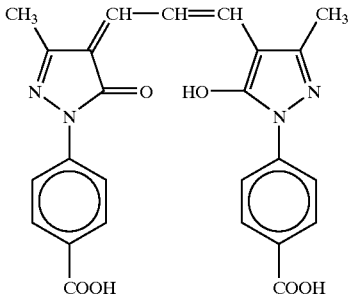
ExF-5
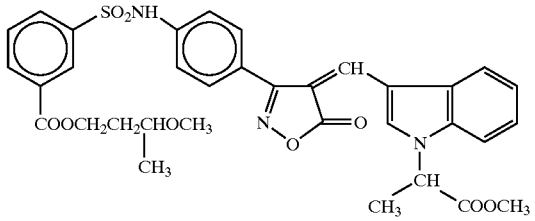
ExF-6
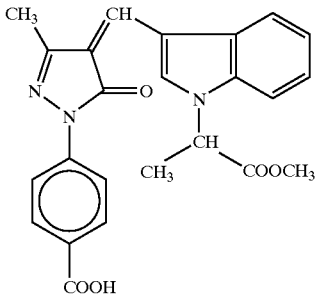
Cpd-1
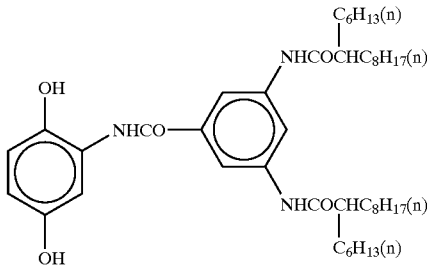
Cpd-2
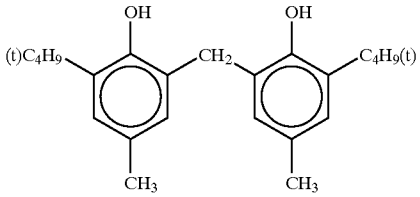
Cpd-3
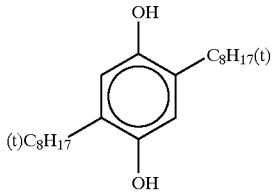
Cpd-4
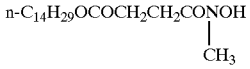
UV-1
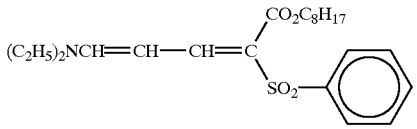
UV-2
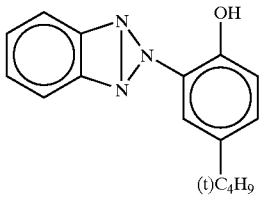
UV-3
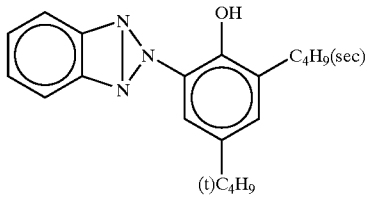

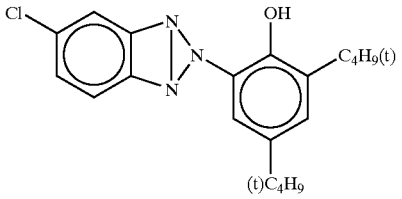
Di-n-butyl phthalate
Tri (2-ethylhexyl)phosphate
H-1
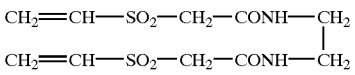
S-1
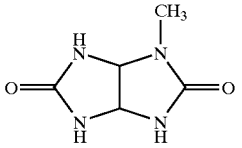
B-1
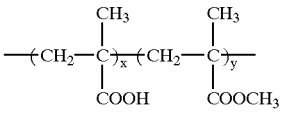
x/y = 10/90 (Wt. ratio)
Average mol. wt.: about 35,000
B-2
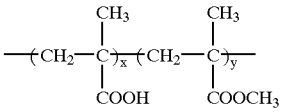
x/y = 40/60 (Wt. ratio)
Average mol. wt.: about 20,000
B-3
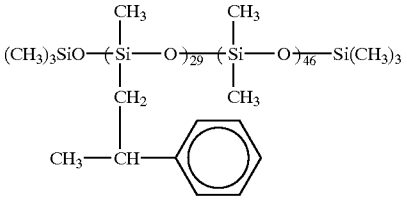
(Mole ratio)
Average mol. wt.: about 8,000
B-4
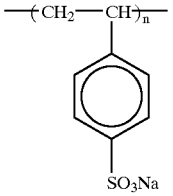
Average mol. wt.: about 750, 000
-continued
UV-4
Tricresyl phosphate
HBS-1
HBS-2
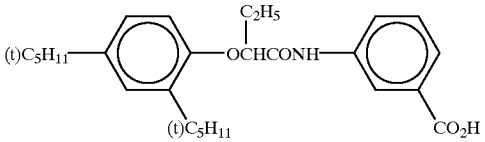
HBS-3
HBS-4
-continued
B-5
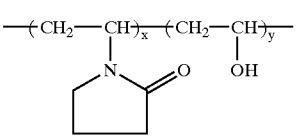
x/y = 70/30 (Wt. ratio)
Average mol. wt.: about 17, 000
B-6
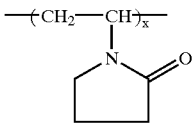
Average mol. wt.: about 10, 000
W-1
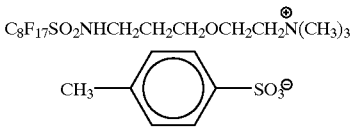
W-2
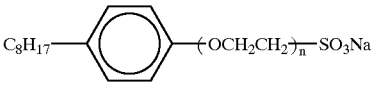
n = 2 to 4
W-3
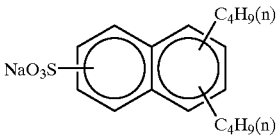
W-4
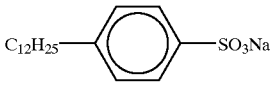
W-5
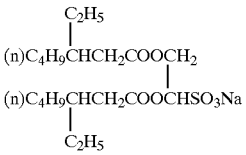
F-1
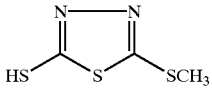

-continued

F-2

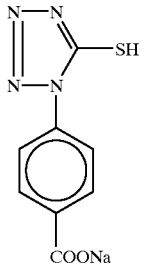

F-3

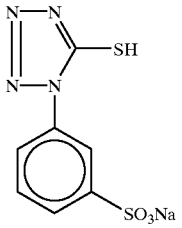

F-4

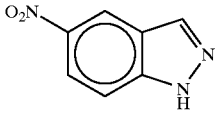

F-5

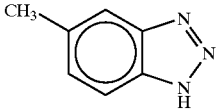

F-6

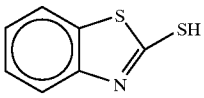

F-7

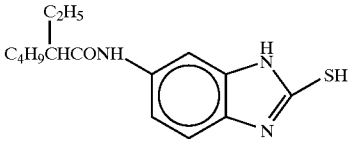

F-8

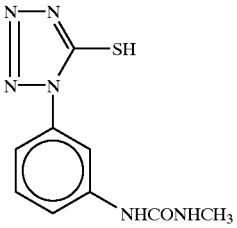

F-9

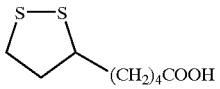

F-10

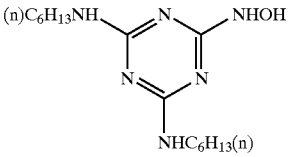

-continued

F-11

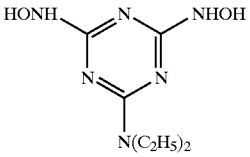

F-12

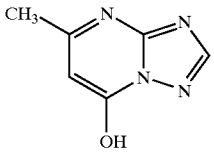

F-13

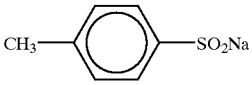

F-14

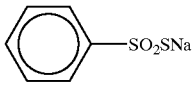

F-15

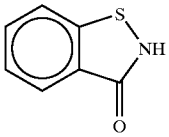

F-16

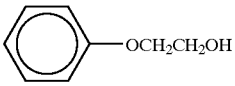

F-17

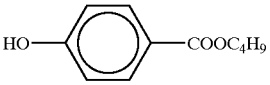

F-18

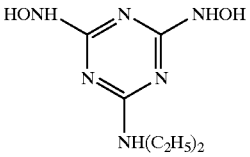

(Formation of Each Sample)

Whether compounds of the present invention were added or not and the addition amounts in the preparations of the emulsions H and N are shown in tables of this example below.

These samples were subjected to film hardening for 14 hr at 40° C. and a relative humidity of 70%. After that, the samples were exposed for 1/100 sec through a gelatin filter SC-39 (a long-wavelength light transmitting filter having a cutoff wavelength of 390 nm) manufactured by Fuji Photo Film Co., Ltd. and a continuous wedge. Development was performed as follows by using an automatic developer FP-360B manufactured by Fuji Photo Film Co., Ltd. Note that FP-360B was modified such that the overflow solution of the bleaching bath was entirely discharged to a waste solution tank without being supplied to the subsequent bath. This FP-360B includes an evaporation correcting means described in JIII Journal of Technical Disclosure No. 94-4992.

The processing steps and the processing solution compositions are presented below.

(Processing Steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60.0° C. | | |

*The replenishment rate was per 1.1 m of a 35-mm wide sensitized material (equivalent to one 24 Ex. 1)

The stabilizer and fixer were counterflowed from (2) to (1), and the overflow of washing water was entirely introduced to the fixing bath (2). Note that the amounts of the developer, bleaching solution, and fixer carried over to the bleaching step, fixing step, and washing step were 2.5 mL, 2.0 mL, and 2.0 mL, respectively, per 1.1 m of a 35-mm wide sensitized material. Note also that each crossover time was 6 sec, and this time was included in the processing time of each preceding step.

The aperture areas of the processor were 100 $cm^2$ for the color developer, 120 $cm^2$ for the bleaching solution, and about 100 $cm^2$ for the other processing solutions.

The compositions of the processing solutions are presented below.

| | Tank solution (g) | Replenisher (g) |
|---|---|---|
| (Color developer) | | |
| Diethylenetriamine pentaacetic acid | 3.0 | 3.0 |
| Disodium cathecol-3,5-disulfonate | 0.3 | 0.3 |
| Sodium sulfite | 3.9 | 5.3 |
| Potassium carbonate | 39.0 | 39.0 |
| Disodium-N,N-bis(2-sulfonateethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7-tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (controlled by potassium hydroxide and sulfuric acid) | 10.05 | 10.18 |
| (Bleaching solution) | | |
| Ferric aminonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (controlled by ammonia water) | 4.6 | 4.0 |

-continued

| | Tank solution (g) | Replenisher (g) |
|---|---|---|
| (Fixing (1) tank solution) | | |
| A 5:95 (volume ratio) mixture of the above bleaching tank solution and the following fixinq tank solution (pH 6.8). | | |
| (Fixer (2)) | | |
| Aqueous ammonium thiosulfate solution (750 g/L) | 240 mL | 720 mL |
| Imidazole | 7 | 21 |
| Ammonium methane thiosulfonate | 5 | 15 |
| Ammonium methane sulfinate | 10 | 30 |
| Ethylenediamine tetraacetic acid | 13 | 39 |
| Water to make | 1.0 L | 1.0 L |
| pH (controlled by ammonia water and acetic acid) | 7.4 | 7.45 |

(Washing Water) Common to Tank Solution and Replenisher

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

(Stabilizer) Common to Tank Solution and Replenisher

| | |
|---|---|
| Sodium p-toluenesulfinate | 0.03 |
| Polyoxyethylene-p-monononylphenylether (average polymerization degree 10) | 0.2 |
| 1,2-benzoisothiazoline-3-one•sodium | 0.10 |
| Disodium ethylenediaminetetraacetate | 0.05 |
| 1,2,4-triazole | 1.3 |
| 1,4-bis(1,2,4-triazole-1-isomethyl) piperazine | 0.75 |
| Water to make | 1.0 L |
| pH | 8.5 |

The emulsion H was subjected to reduction sensitization and had 10 or more dislocation lines per grain, an aspect ratio of 12.5, and an AgI content on the emulsion surface of 2.6%. Whether the compounds represented by formula (1), (2) or (3) of the present invention were added or not and the addition amounts thereof are shown in Tables 8 and 9 of this example below. The emulsion N was subjected to reduction sensitization and had 10 or more dislocation lines per grain, an aspect ratio of 17, and an AgI content on the emulsion surface of 2.4%. Whether compounds of the present invention were added or not and the addition amounts are shown in Tables 8 and 9 of this example below.

Samples 602 to 608 were prepared in the same manner as for Sample 601, except that Emulsions H and N were changed as set forth in Table 8 below.

The photographic properties of samples 601 to 608 were evaluated by measuring the densities of the processed samples through a red filter. Table 8 below shows the results. The sensitivity is represented by a relative value of the reciprocal of an exposure amount required to reach a density of fog density plus 0.2 (the sensitivity of the sample 601 is assumed to 100).

TABLE 8

| | High-speed green-sensitive emulsion layer: emulsion H | | High-speed red-sensitive emulsion layer: emulsion N | | | | |
|---|---|---|---|---|---|---|---|
| | | Addition amount (mol %) | | Addition amount (mol %) | Photographic properties through red filter | | |
| Sample No. | Compound No. | with respect to sensitizing dyes | Compound No. | with respect to sensitizing dyes | Sensitivity *1) | Fog density | Remarks |
| No. 601 | None | — | None | — | 100 | 0.35 | Comparative Example |
| No. 602 | None | — | Compound I-1 | 5 | 135 | 0.33 | Present invention |
| No. 603 | None | — | Compound I-25 | 5 | 129 | 0.32 | Present invention |
| No. 604 | None | — | Compound I-12 | 5 | 127 | 0.36 | Present invention |
| No. 605 | None | — | Compound I-14 | 5 | 127 | 0.34 | Present invention |
| No. 606 | None | — | Compound I-7 | 5 | 117 | 0.35 | Present invention |
| No. 607 | None | — | Compound I-8 | 5 | 118 | 0.33 | Present invention |
| No. 608 | None | — | Compound I-15 | 5 | 119 | 0.36 | Present invention |

*1) Each sensitivity is expressed in relative value assuming the sensitivity of the sample 601 to 100.

As shown in Table 8, the use of the compounds of the present invention enhanced the sensitivity increasing effect. Table 8 shows that the compound of formula (3) is particularly preferable.

Samples 702 to 708 were prepared in the same manner as Sample 701, except that Emulsions H and N were changed as set forth in Table 9 below.

The photographic properties of the samples 701 to 708 were evaluated by measuring the densities of the processed samples through a green filter. Table 9 below shows the results. The sensitivity is represented by a relative value of the reciprocal of an exposure amount required to reach a density of fog density plus 0.2 (the sensitivity of the sample 701 is assumed to 100).

TABLE 9

| | High-speed green-sensitive emulsion layer: emulsion H | | High-speed red-sensitive emulsion layer: emulsion N | | | | |
|---|---|---|---|---|---|---|---|
| | | Addition amount (mol %) | | Addition amount (mol %) | Photographic properties through red filter | | |
| Sample No. | Compound No. | with respect to sensitizing dyes | Compound No. | with respect to sensitizing dyes | Sensitivity *1) | Fog density | Remarks |
| No. 701 | None | — | None | — | 100 | 0.35 | Comparative Example |
| No. 702 | Compound I-1 | 5 | None | — | 110 | 0.34 | Present invention |
| No. 703 | Compound I-25 | 5 | None | — | 109 | 0.36 | Present invention |
| No. 704 | Compound I-12 | 5 | None | — | 108 | 0.37 | Present invention |
| No. 705 | Compound I-14 | 5 | None | — | 109 | 0.35 | Present invention |
| No. 706 | Compound I-7 | 5 | None | — | 105 | 0.34 | Present invention |
| No. 707 | Compound I-8 | 5 | None | — | 106 | 0.36 | Present invention |
| No. 708 | Compound I-15 | 5 | None | — | 105 | 0.33 | Present invention |

*1) Each sensitivity is expressed in relative value assuming the sensitivity of the sample 701 to 100.

As shown in Table 9, the use of the compounds represented by formula (1), (2) or (3) of the present invention enhanced the sensitivity increasing effect. However, the effect attained by the use of the emulsion N that is sensitive to read color shown in Table 8 is more remarkable than the effect attained by the use of the emulsion H that is sensitive to green color shown in Table 9.

EXAMPLE 7

Full multilayered silver halide color reversal photographic light-sensitive materials 801 to 808 were manufactured following the same procedures as for a sample 201 in Example 2 described in JP-A-9-5912, except that the emulsion in the 6th high-speed red-sensitive emulsion layer was changed. That is, in the chemical sensitization step in the preparation of the 6th layer emulsion, the compounds represented by formula (1), (2) or (3) of the present invention were added as shown in Table 10 at the beginning of the chemical sensitization step (whether the compounds were added or not and the addition amounts are shown in Table 10). The manufactured samples were wedge-exposed for 1/100 sec by using a white light source and subjected to the same processing, sensitometry, as in Example 1 described in JP-A-9-5912. The sensitivity of the 6th layer is represented by a relative value of the reciprocal of an exposure amount required to reach an density of 2.0. The sensitivity of the sample is assumed to 100.

TABLE 10

| | High-speed red-sensitive emulsion layer: The 6th emulsion layer of Sample 201 in Example 2 of FP-A-9-5912 | | | | | |
|---|---|---|---|---|---|---|
| Sample No. | Compound No. | Addition amount (mol %) with respect to sensitizing dyes | Aspect ratio | Presence/absence of 10 or more dislocation lines per grain | Photo-graphic properties Sensitivity *1) | Remarks |
| No. 801 | None | — | 7.1 | Present | 100 | Comparative Example |
| No. 802 | Compound I-1 | 5 | 7.1 | Present | 130 | Present invention |
| No. 803 | Compound I-25 | 5 | 7.1 | Present | 128 | Present invention |
| No. 804 | Compound I-12 | 5 | 7.1 | Present | 125 | Present invention |
| No. 805 | Compound I-14 | 5 | 7.1 | Present | 123 | Present invention |
| No. 806 | Compound I-7 | 5 | 7.1 | Present | 112 | Present invention |
| No. 807 | Compound I-8 | 5 | 7.1 | Present | 113 | Present invention |
| No. 808 | Compound I-15 | 5 | 7.1 | Present | 114 | Present invention |

*1) Each sensitivity is expressed in relative value assuming the sensitivity of the sample 801 to 100.

As can be seen from Table 10, the use of the compounds of the present invention enhanced the sensitivity increasing effect. Table 10 shows that a compound of formula (3) is particularly preferable.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photographic light-sensitive emulsion containing tabular silver halide grains wherein, 50% or more of the total projected area of all the silver halide grains are occupied by tabular grains each having {111} faces as parallel major faces and an aspect ratio of 2 or more and including 10 or more dislocation lines per grain; and at least one compound represented by formula (1) or (2) below is contained in said emulsion:

Formula (1)

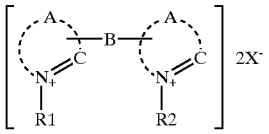

Formula (2)

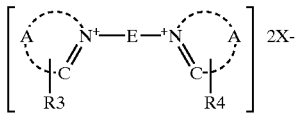

wherein A represents an atomic group required to form a nitrogen-containing hetero ring; each of B and E independently represents a divalent group containing at least one divalent group selected from the group consisting of alkylene, arylene, —O—, —S—, —$SO_2$—, —$CO_2$—, and —N(R5)-, wherein R5 represents a hydrogen atom, an alkyl group, or an aryl group, provided that each of —O—, —S—, —$SO_2$—, —$CO_2$—, and —N(R5)- is adjacent to and connects with alkylene or arylene at both ends thereof, and that B does not bond to the nitrogen atom which forms the nitrogen-containing hetero ring and which bonds to the carbon atom by a double bond; each of R1 and R2 independently represents an alkyl group or an aralkyl group; each of R3 and R4 represents a substituent; and X represents an anion group, provided that no X exists in the case of intramolecular salt.

2. The emulsion according to claim 1, wherein the silver halide grains are made red-sensitive by a sensitizing dye, and the addition amount of the compound represented by formula (1) or (2) is not more than 25 mol % of the addition amount of the sensitizing dye.

3. The emulsion according to claim 2, wherein the surface silver iodide content of each of the silver halide grains is 10 mol % or less.

4. The emulsion according to claim 2, wherein the surface silver iodide content of each of the silver halide grains is 5 mol % or less.

5. The emulsion according to claim 2, wherein the silver halide grains are subjected to reduction sensitization.

6. The emulsion according to claim 2, wherein the compound represented by formula (2) is represented by formula (3) below:

Formula (3)

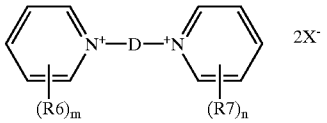

wherein D represents a divalent group selected from the group consisting of alkylene, —O—, and an alternate combination of alkylene and —O—, provided that —O— is adjacent to and connects with alkylene at both ends therof; each of m and n independently represents 0, 1, or 2; each of R6 and R7 represents a 4- to 20-carbon alkyl group, a 6- to 20-carbon aryl group, or a 7- to 20-carbon aralkyl group, provided that when m=2 and n=2, each of R6 and R7 can form a condensed ring to the pyridyl ring as a benzene ring; and X represents an anion group, provided that no X is necessary in the case of intramolecular salt.

7. A silver halide photographic light-sensitive material having at least one silver halide light-sensitive emulsion layer on a support, wherein the silver halide light-sensitive emulsion layer contains the light-sensitive emulsion according to claim 2.

8. The emulsion according to claim 1, wherein the surface silver iodide content of each of the silver halide grains is 10 mol % or less.

9. The emulsion according to claim 8, wherein the silver halide grains are subjected to reduction sensitization.

10. The emulsion according to claim 8, wherein the compound represented by formula (2) is represented by formula (3) below:

Formula (3)

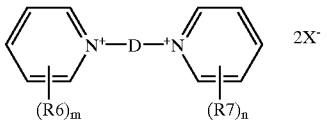

wherein D represents a divalent group selected from the group consisting of alkylene, —O—, and an alternate combination of alkylene and —O—, provided that —O— is adjacent to and connects with alkylene at both ends thereof; each of m and n independently represents 0, 1, or 2; each of R6 and R7 represents a 4- to 20-carbon alkyl group, a 6- to 20-carbon aryl group, or a 7- to 20-carbon aralkyl group, provided that when m=2 and n=2, each of R6 and R7 can form a condensed ring to the pyridyl ring as a benzene ring; and X represents an anion group, provided that no X is necessary in the case of intramolecular salt.

11. A silver halide photographic light-sensitive material having at least one silver halide light-sensitive emulsion layer on a support, wherein the silver halide light-sensitive emulsion layer contains the light-sensitive emulsion according to claim 8.

12. The emulsion according to claim 1, wherein the silver halide grains are subjected to reduction sensitization.

13. The emulsion according to claim 12, wherein the compound represented by formula (2) is represented by formula (3) below:

Formula (3)

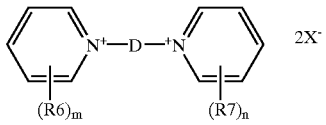

wherein D represents a divalent group selected from the group consisting of alkylene, —O—, and an alternate combination of alkylene and —O—, provided that —O— is adjacent to and connects with alkylene at both ends thereof; each of m and n independently represents 0, 1, or 2; each of R6 and R7 represents a 4- to 20-carbon alkyl group, a 6- to 20-carbon aryl group, or a 7- to 20-carbon aralkyl group, provided that when m=2 and n=2, each of R6 and R7 can form a condensed ring to the pyridyl ring as a benzene ring; and X represents an anion group, provided that no X is necessary in the case of intramolecular salt.

14. A silver halide photographic light-sensitive material having at least one silver halide light-sensitive emulsion layer on a support, wherein the silver halide light-sensitive emulsion layer contains the light-sensitive emulsion according to claim 12.

15. The emulsion according to claim 1, wherein the compound represented by formula (2) is represented by formula (3) below:

Formula (3)

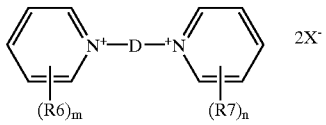

wherein D represents a divalent group selected from the group consisting of alkylene, —O—, and an alternate combination of alkylene and —O—, provided that —O— is adjacent to and connects with alkylene at both ends thereof; each of m and n independently represents 0, 1, or 2; each of R6 and R7 represents a 4- to 20-carbon alkyl group, a 6- to 20-carbon aryl group, or a 7- to 20-carbon aralkyl group, provided that when m=2 and n=2, each of R6 and R7 can form a condensed ring to the pyridyl ring as a benzene ring; and X represents an anion group, provided that no X is necessary in the case of intramolecular salt.

16. A silver halide photographic light-sensitive material having at least one silver halide light-sensitive emulsion layer on a support, wherein the silver halide light-sensitive emulsion layer contains the light-sensitive emulsion according to claim 15.

17. The emulsion according to claim 1, wherein the surface silver iodide content of each of the silver halide grains is 5 mol % or less.

18. A silver halide photographic light-sensitive material having at least one silver halide light-sensitive emulsion layer on a support, wherein the silver halide light-sensitive emulsion layer contains the light-sensitive emulsion according to claim 1.

* * * * *